US009604251B2

(12) United States Patent
Lizotte et al.

(10) Patent No.: US 9,604,251 B2
(45) Date of Patent: Mar. 28, 2017

(54) THERMOPLASTIC FORMULATIONS FOR ENHANCED PAINTABILITY, TOUGHNESS AND MELT PROCESSABILITY

(75) Inventors: Jeremy Richard Lizotte, Gray, TN (US); Caroline Joan Wilson, Kingsport, TN (US); Emerson Eston Sharpe, Jr., Kingsport, TN (US); Tony Wayne Helton, Kingsport, TN (US); Subramanian Easwaran Iyer, Blountville, TN (US); James Wilson Mercer, Jr., Kingsport, TN (US); David Gayle Salyer, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

(21) Appl. No.: 13/616,672

(22) Filed: Sep. 14, 2012

(65) Prior Publication Data

US 2013/0011563 A1 Jan. 10, 2013

Related U.S. Application Data

(62) Division of application No. 12/503,675, filed on Jul. 15, 2009.

(Continued)

(51) Int. Cl.
*B05D 7/08* (2006.01)
*B05D 7/00* (2006.01)

(52) U.S. Cl.
CPC ..... *B05D 7/08* (2013.01); *B05D 7/54* (2013.01); *B05D 2508/00* (2013.01); *Y10T 428/31786* (2015.04)

(58) Field of Classification Search
CPC .. B05D 2508/00; B05D 2420/01; B05D 7/08; B05D 7/54

(Continued)

(56) References Cited

U.S. PATENT DOCUMENTS 2,216,519 A 10/1940 Quarnstrom
2,926,729 A 3/1960 Zanini (Continued)

FOREIGN PATENT DOCUMENTS

CA 2133696 A1 5/1995
CN 201626102 U 11/2010

(Continued)

OTHER PUBLICATIONS

"Blendex BMAT Data Sheet Styrene Acrylonitrile", http://www.ides.com/info/datasheet/E737g8/BLENDEX-BMAT, Sep. 13, 2012.

(Continued)

*Primary Examiner* — Alexander Weddle
(74) *Attorney, Agent, or Firm* — Tammye L. Taylor

(57) ABSTRACT

The present disclosure relates to polymer coating compositions that comprise at least one thermoplastic resin, at least one opacity modifier, at least one gloss modifier, and at least one impact modifier, articles at least partially coated with the polymer coating composition, paintable polymer coated articles and method for making the polymer coated and painted polymer coated articles. These compositions exhibit enhanced paintability (including paintability with water-based paints) and mechanical properties for fabrication (cutting, nailing, routing, etc.), while maintaining acceptable visual appearance, such as, for example, opacity, gloss, surface appearance, and surface roughness.

11 Claims, 11 Drawing Sheets a) control b) GNP glass beads

Related U.S. Application Data

(60) Provisional application No. 61/081,201, filed on Jul. 16, 2008.

(58) Field of Classification Search
USPC ..... 427/289, 290, 291, 355, 407.1, 408
See application file for complete search history.

(56) References Cited

U.S. PATENT DOCUMENTS 2,991,273 A 7/1961 Hechelhammer et al.
2,999,835 A 9/1961 Goldberg
2,999,846 A 9/1961 Schnell et al.
3,028,365 A 4/1962 Schnell et al.
3,084,662 A 4/1963 Badger et al.
3,148,172 A 9/1964 Fox
3,153,008 A 10/1964 Fox
3,169,121 A 2/1965 Goldberg
3,207,814 A 9/1965 Goldberg
3,271,367 A 9/1966 Schnell et al.
3,402,682 A 9/1968 Penden et al.
3,544,669 A 12/1970 Schock
3,599,286 A 8/1971 Karet
3,694,538 A 9/1972 Okamoto et al.
3,720,027 A 3/1973 Christensen
3,741,843 A 6/1973 Louis
3,772,405 A 11/1973 Hamb
3,852,933 A 12/1974 Guzzo
3,853,462 A 12/1974 Smith
3,941,904 A 3/1976 Hoh et al.
3,980,005 A 9/1976 Buonaiuto
4,000,219 A 12/1976 Smejkal
4,123,436 A 10/1978 Holub et al.
4,124,574 A 11/1978 Preston et al.
4,143,187 A 3/1979 Pilgrim et al.
4,156,069 A 5/1979 Prevorsek et al.
4,181,764 A 1/1980 Totten
4,190,686 A 2/1980 Muis
4,197,038 A 4/1980 Hipp et al.
4,209,475 A 6/1980 Herrington
4,222,911 A 9/1980 Christenson
4,301,053 A 11/1981 Wolfrey
4,397,986 A 8/1983 Hornbaker
4,430,484 A 2/1984 Quinn
4,433,088 A 2/1984 Haaf et al.
4,452,933 A 6/1984 McCready
4,465,820 A 8/1984 Miller et al.
4,558,096 A 12/1985 Boon et al.
4,567,142 A 1/1986 Lloyd
4,576,846 A 3/1986 Noel
4,613,653 A 9/1986 Kitchens et al.
4,740,556 A 4/1988 Abolins et al.
4,757,110 A 7/1988 Sato
4,760,114 A 7/1988 Haaf et al.
4,774,794 A 10/1988 Grieb
4,775,597 A 10/1988 Birkmeyer et al.
4,790,851 A 12/1988 Suire et al.
4,872,907 A 10/1989 Areaux
4,935,306 A 6/1990 Ohtsuka et al.
4,963,435 A 10/1990 Hara et al.
4,981,898 A 1/1991 Bassett
4,982,014 A 1/1991 Freitag et al.
4,984,406 A 1/1991 Friesen
4,987,702 A 1/1991 Anschutz
5,010,162 A 4/1991 Serini et al.
5,084,511 A 1/1992 Abe et al.
5,095,069 A 3/1992 Ambrose et al.
5,162,058 A 11/1992 Uenaka et al.
5,166,237 A 11/1992 Abe et al.
5,286,547 A 2/1994 Tyerman
5,288,559 A 2/1994 Oka et al.
5,312,863 A 5/1994 Van Rheenen et al.
5,321,056 A 6/1994 Carson et al.
5,344,700 A 9/1994 McGath et al.
5,382,401 A 1/1995 Pickett et al.
5,415,943 A * 5/1995 Groger et al. ..... 428/537.1
5,417,904 A 5/1995 Razi et al.
5,484,632 A 1/1996 Mercer, Jr. et al.
5,625,999 A 5/1997 Buzza et al.
5,654,347 A 8/1997 Khemani et al.
5,672,391 A 9/1997 Santarossa
5,674,928 A 10/1997 Chisholm et al.
5,696,176 A 12/1997 Khemani et al.
5,725,944 A 3/1998 Jones et al.
5,824,373 A 10/1998 Biller et al.
5,858,522 A 1/1999 Turk
5,897,708 A 4/1999 Hsu
5,898,043 A 4/1999 Uemae et al.
5,907,006 A 5/1999 Rennie et al.
5,914,083 A 6/1999 Yada et al.
5,925,698 A 7/1999 Steckel
5,962,573 A 10/1999 Berta
5,965,075 A 10/1999 Pauley et al.
5,972,471 A 10/1999 Jasenof et al.
5,976,676 A * 11/1999 Miki et al. ..... 428/201
5,985,397 A 11/1999 Witt et al.
5,997,456 A * 12/1999 Butters et al. ..... 492/56
6,020,414 A 2/2000 Nelson et al.
6,074,727 A 6/2000 Miller et al.
6,083,601 A 7/2000 Prince et al.
6,093,773 A 7/2000 Evans et al.
6,114,021 A 9/2000 Pankratz
6,153,264 A 11/2000 Schmid et al.
6,168,866 B1 1/2001 Clark
6,203,915 B1 3/2001 Prissok et al.
6,206,965 B1 3/2001 Rao et al.
6,298,626 B2 10/2001 Rudden
6,306,507 B1 10/2001 Brunelle et al.
6,336,265 B1 1/2002 Niedermair
6,352,657 B1 3/2002 Veldhuis et al.
6,352,784 B1 3/2002 Katagiri
6,353,050 B1 3/2002 Bastiaens et al.
6,391,461 B1 5/2002 Ryntz et al.
6,394,784 B1 5/2002 Gellert et al.
6,448,328 B1 9/2002 Kappler et al.
6,455,161 B1 9/2002 Regnier et al.
6,461,792 B1 10/2002 Kawamura et al.
6,500,895 B1 12/2002 Bastiaens et al.
6,540,624 B1 * 4/2003 Isogawa ..... 473/371
6,551,662 B1 4/2003 Schmid et al.
6,576,309 B2 6/2003 Dalgewicz, III et al.
6,579,611 B1 6/2003 Iwashita et al.
6,583,189 B1 6/2003 King
6,584,743 B2 7/2003 Paxton et al.
6,592,668 B2 7/2003 Rao et al.
6,596,784 B1 7/2003 King
6,601,357 B2 8/2003 Tunis
6,616,998 B2 9/2003 Greer et al.
6,660,086 B1 12/2003 Prince et al.
6,667,367 B1 12/2003 Berta
6,673,293 B1 1/2004 Mistopoulos
6,680,104 B2 1/2004 Boris et al.
6,716,522 B2 4/2004 Matsumoto et al.
6,852,765 B2 2/2005 Decker et al.
6,933,043 B1 8/2005 Son et al.
6,991,632 B2 1/2006 Ritland
6,994,752 B2 2/2006 Estrada et al.
7,022,257 B1 4/2006 Ohkido et al.
7,022,768 B1 4/2006 Lacroix et al.
7,034,072 B2 4/2006 Milic
7,081,488 B2 7/2006 Bardman et al.
7,097,879 B2 8/2006 Bolton et al.
7,160,977 B2 1/2007 Hale et al.
7,175,905 B2 2/2007 Curtis et al.
7,226,985 B2 6/2007 Hale et al.
7,318,958 B2 1/2008 Wang
7,335,399 B2 2/2008 Bolton et al.
7,368,511 B2 5/2008 Hale et al.
7,374,795 B2 5/2008 Prince et al.
7,435,483 B2 10/2008 Lee et al.
7,644,553 B2 1/2010 Knauseder
7,687,768 B2 3/2010 Hashizume et al.
7,694,468 B2 4/2010 Prince et al.
7,695,498 B2 4/2010 Ritland
7,766,915 B2 8/2010 Jackson

(56) References Cited

U.S. PATENT DOCUMENTS

| | | | | |
|---|---|---|---|---|
| 7,901,435 | B2 | 3/2011 | Slivka et al. | |
| 8,065,848 | B2 | 11/2011 | Carlson et al. | |
| 8,071,198 | B2 | 12/2011 | Michalczyk et al. | |
| 8,071,695 | B2 | 12/2011 | Strand et al. | |
| 8,113,143 | B2 | 2/2012 | Prince et al. | |
| 8,197,733 | B2 | 6/2012 | Sudano | |
| 8,394,784 | B2 | 3/2013 | Stroumpoulis et al. | |
| 8,734,909 | B2 | 5/2014 | Iyer et al. | |
| 8,865,261 | B2 | 10/2014 | Helton et al. | |
| 2001/0013211 | A1 | 8/2001 | Rudden | |
| 2001/0055671 | A1 | 12/2001 | Pickett et al. | |
| 2002/0136911 | A1 | 9/2002 | Yamamoto et al. | |
| 2002/0192451 | A1 | 12/2002 | Kobayashi et al. | |
| 2003/0093078 | A1 | 5/2003 | Ritland | |
| 2003/0108735 | A1 | 6/2003 | Hoppe et al. | |
| 2003/0211347 | A1 | 11/2003 | Rabinovitch et al. | |
| 2004/0003903 | A1 | 1/2004 | Wenrick et al. | |
| 2004/0023052 | A1 | 2/2004 | Ambroise | |
| 2004/0109946 | A1 | 6/2004 | Prince et al. | |
| 2004/0131871 | A1 | 7/2004 | Lee et al. | |
| 2004/0236063 | A1 | 11/2004 | Suzuki et al. | |
| 2005/0037176 | A1* | 2/2005 | Domine | 428/138 |
| 2005/0050814 | A1 | 3/2005 | Prince et al. | |
| 2005/0102963 | A1 | 5/2005 | Nien et al. | |
| 2005/0106406 | A1 | 5/2005 | Curtis et al. | |
| 2005/0137356 | A1 | 6/2005 | Hale et al. | |
| 2005/0288401 | A1 | 12/2005 | Pearson et al. | |
| 2006/0022376 | A1 | 2/2006 | Prince et al. | |
| 2006/0111519 | A1* | 5/2006 | Strand et al. | 525/444 |
| 2006/0255496 | A1 | 11/2006 | Wells | |
| 2006/0258801 | A1 | 11/2006 | Martin et al. | |
| 2006/0270806 | A1 | 11/2006 | Hale | |
| 2007/0000568 | A1 | 1/2007 | Bohme et al. | |
| 2007/0059463 | A1 | 3/2007 | Melkonian | |
| 2007/0292569 | A1 | 12/2007 | Bohme et al. | |
| 2008/0118741 | A1* | 5/2008 | Michalczyk et al. | 428/331 |
| 2008/0145564 | A1* | 6/2008 | Allam et al. | 427/514 |
| 2008/0145637 | A1 | 6/2008 | Frank | |
| 2008/0153984 | A1 | 6/2008 | Renken et al. | |
| 2009/0035581 | A1 | 2/2009 | Sudano | |
| 2009/0036581 | A1 | 2/2009 | Joshi et al. | |
| 2009/0064627 | A1 | 3/2009 | Struthers et al. | |
| 2009/0260313 | A1 | 10/2009 | Segaert | |
| 2010/0003410 | A1 | 1/2010 | King et al. | |
| 2010/0021677 | A1 | 1/2010 | West et al. | |
| 2010/0036007 | A1 | 2/2010 | Journee | |
| 2010/0211180 | A1 | 8/2010 | Helmuth et al. | |
| 2011/0223342 | A1 | 9/2011 | Iyer et al. | |
| 2011/0245876 | A1 | 10/2011 | Brumfield | |
| 2013/0005892 | A1 | 1/2013 | Lizotte et al. | |
| 2013/0011563 | A1 | 1/2013 | Lizotte et al. | |
| 2013/0060345 | A1 | 3/2013 | Tepie | |

FOREIGN PATENT DOCUMENTS

| | | | |
|---|---|---|---|
| DE | 9316759 | U1 | 2/1994 |
| DE | 44 24 767 | C1 | 11/1995 |
| DE | 198 57 045 | A1 | 6/2000 |
| DE | 20 2011 003953 | U1 | 5/2011 |
| DE | 10 2012 001910 | A1 | 8/2013 |
| EP | 0 132 218 | A2 | 1/1985 |
| EP | 0 210 297 | A1 | 2/1987 |
| EP | 0 488 711 | A2 | 6/1992 |
| EP | 0 510 463 | A1 | 10/1992 |
| EP | 0 653 469 | A2 | 5/1995 |
| FR | 2 861 738 | A1 | 5/2005 |
| GB | 1 397 270 | A | 6/1975 |
| GB | 2 024 658 | A | 1/1980 |
| JP | S52 103465 | A | 8/1977 |
| JP | 58-118231 | A | 7/1983 |
| JP | S59 155024 | A | 9/1984 |
| JP | 60-085921 | A | 5/1985 |
| JP | 1-225647 | A | 9/1989 |
| JP | 3-26752 | A | 2/1991 |
| JP | 8-34866 | A | 2/1996 |
| JP | 1996034866 | A | 2/1996 |
| JP | 08300590 | A | 11/1996 |
| JP | 09-302078 | | 11/1997 |
| JP | 9324135 | A | 12/1997 |
| JP | 11-90827 | A | 4/1999 |
| JP | 1999245590 | A | 9/1999 |
| JP | 2002-337291 | A | 11/2002 |
| JP | 2003-056168 | A | 2/2003 |
| JP | 2004-211039 | A | 7/2004 |
| JP | 2005-154731 | | 6/2005 |
| JP | 2005-264136 | A | 9/2005 |
| JP | 2006-281544 | A | 10/2006 |
| KR | 20110073672 | A | 6/2011 |
| WO | WO 96/18685 | A1 | 6/1996 |
| WO | WO 97/46627 | A1 | 12/1997 |
| WO | WO 98/27159 | A1 | 6/1998 |
| WO | WO 01/27200 | A3 | 4/2001 |
| WO | WO 01/58663 | | 8/2001 |
| WO | WO 2006/093916 | A2 | 9/2006 |
| WO | WO 2006/102705 | | 10/2006 |
| WO | WO 2008/040498 | A1 | 4/2008 |

OTHER PUBLICATIONS

USPTO Office Action dated Apr. 2, 2012 for copending U.S. Appl. No. 12/503,675.

Copending U.S. Appl. No. 13/616,681, filed Sep. 14, 2012, Jeremy Richard Lizotte et al.

December, Timothy S., et al.; "The Effects of TPO Composition on Adhesion and Proposed Chemical Mechanism"; Paint and Coatings Industry; Mar. 2008; www.pcimag.com; pp. 76-82.

Berta, Dominic A.; "Formulating Plastics for Paint Adhesion"; Chapter 3 from Coatings of Polymers and Plastics, 2003, edited by Ryntz, Rose, A. and Yaneff, Phillip V.; pp. 85-119.

Notification of Transmittal of the International Search Report and the Written Opinion of the International Searching Authority dated Jan. 22, 2010 for International Application No. PCT/US2009/004107.

Notification of Transmittal of the International Search Report and the Written Opinion of the International Searching Authority dated Apr. 28, 2011 for International Application No. PCT/US2011/026942.

Copending U.S. Appl. No. 12/721,080, filed Mar. 10, 2010, Subramanian Iyer et al.

USPTO Office Action dated May 7, 2012 for copending U.S. Appl. No. 12/721,080.

Copending U.S. Appl. No. 12/503,675, filed Jul. 15, 2009, Jeremy Richard Lizotte et al.

Notification of Transmittal of the International Search Report and the Written Opinion of the International Searching Authority dated Jul. 18, 2013 for International Application No. PCT/US2013/037957.

USPTO Office Action dated Aug. 23, 2013 in copending U.S. Appl. No. 12/721,080.

USPTO Office Action dated Sep. 13, 2013 in copending U.S. Appl. No. 13/616,681.

Fred W. Billmeyer, Jr., Textbook of Polymer Science, 3rd Edition, John Wiley & Sons, Inc., New York, p. 153 (1984).

Carraher, Introduction to Polymer Chemistry 3rd Edition, CRC Press, Taylor & France Group, Boca Raton FL p. 240 (2013).

USPTO Office Action dated Jan. 6, 2014 in copending U.S. Appl. No. 12/503,675.

Notification of Transmittal of the International Search Report and the Written Opinion of the International Searching Authority, or the Declaration—International Application No. PCT/US2013/072546 with a mailing date of Mar. 11, 2014.

Copending U.S. Appl. No. 14/487,355, filed Septemner 16, 2014, Tony Wayne HeltonA.

ASTM D3330.

"Blendex BMAT Modifier Resin"; Chemtura; www.chemtura.com; Effective Jun. 4, 2008; (2007).

"Butyl acrylate-methyl methacrylate polymers"; Chemical Book; www.chemicalbook.com; (2008).

(56) References Cited

OTHER PUBLICATIONS

"Paraloid KM-377 Impact Modifier"; Material Safety Data Sheet, DOW; Revision Date: Feb. 7, 2004.
Turner, S. R., et al.; "Polyesters Based on 1,4-Cyclohexanedimethanol"; Modern Polyesters: Chemistry and Technology of Polyesters and Copolyesters; (2003); pp. 280-282.
"Chlorocarbons and Chlorohydrocarbons-$C_2$To Combustion Technology"; Encyclopedia of Chemical Technology; $4^{th}$ Edition, vol. 6, (1993), pp. 620-623.
Strasser, CFD Investigation of Gear Pump Mixing Using Deforming/Agglomerating Mesh, J. Fluids Eng.—Apr. 2007—vol. 129, Issue 4, 476 (9 pages).
USPTO Office Action dated Dec. 6, 2012 for copending U.S. Appl. No. 12/503,675.
Copending U.S. Appl. No. 13/706,408, filed Dec. 6, 2012, Tony Wayne Helton.
USPTO Office Action dated Jan. 11, 2013 for copending U.S. Appl. No. 12/721,080.
USPTO Office Action dated Feb. 27, 2013 for copending U.S. Appl. No. 13/616,681.
Copending U.S. Appl. No. 13/861,412, filed Apr. 12, 2013, Gordon L. King.
USPTO Office Action dated Jul. 16, 2013 for copending U.S. Appl. No. 13/706,408.
Notice of Allowance received in Co-pending U.S. Appl. No. 12/721,080 dated Apr. 10, 2014.
Notice of Allowance received in Co-pending U.S. Appl. No. 13/706,408 dated May 12, 2014.
USPTO Notice of Allowance dated Jun. 20, 2014 in co-pending U.S. Appl. No. 13/706,408.
USPTO Office Action dated Aug. 29, 2014 in copending U.S. Appl. No. 12/503,675.
Copending U.S. Appl. No. 14/487,355, filed Sep. 16, 2014, Tony Wayne Helton.
Copending U.S. Appl. No. 14/496,549, filed Sep. 25, 2014, Jennifer Lynne Peavey.
ASTM D1037; "Evaluating Properties of Wood-Based Fiber and Particle Panel Materials"; Published Jun. 2012.
ASTM D882; "Standard Test Method for Tensile Properties of Thin Plastic Sheeting"; Published Sep. 2012.
Copending U.S. Appl. No. 14/496,529, filed Sep. 25, 2014, Jennifer Lynne Peavey.
Copending U.S. Appl. No. 14/496,483, filed Sep. 25, 2014, Jennifer Lynne Peavey.
Copending U.S. Appl. No. 14/496,567, filed Sep. 25, 2014, Chad Alan Frazier.
Copending U.S. Appl. No. 14/496,508, filed Sep. 25,2014, Jennifer Lynne Peavey.
ASTM D4541; "Standard Test Method for Pull-Off Strength of Coatings Using Portable Adhesion Testers"; Published Apr. 2009.
Copending U.S. Appl. No. 14/571,568, filed Dec. 16,2014, Kevin Michael Cable.
Notification of Transmittal of the International Search Report and the Written Opinion of the International Searching Authority, or the Declaration—International Application No. PCT/US2014/059839 with a mailing date of Jan. 22, 2015.
USPTO Office Action dated Mar. 25, 2015 in copending U.S. Appl. No. 14/496,567.
Notification of Transmittal of the International Search Report and the Written Opinion of the International Searching Authority, or the Declaration—International Application No. PCT/US2014/059824 with a mailing date of Mar. 30, 2015.
Notification of Transmittal of the International Search Report and the Written Opinion of the International Searching Authority, or the Declaration—International Application No. PCT/US2015/065681 with a mailing date of Mar. 8, 2016.
Office Action notification date Jan. 6, 2016 received in co-pending U.S. Appl. No. 14/487,355.
Office Communication notification date Mar. 2, 2016 received in copending U.S. Appl. No. 14/496,567.
Office Communication notification date Apr. 11, 2016 received in co-pending U.S. Appl. No. 12/503,675.
Office Communication notification date Apr. 7, 2016 received in co-pending U.S. Appl. No. 14/496,529.
Chemical Abstract Services No. 25852-37-3.
Office Communication notification date Jul. 12, 2016 received in co-pending U.S. Appl. No. 14/496,508.
Office Communication notification date Apr. 27, 2016 received in co-pending U.S. Appl. No. 14/496,483.
Chemical Abstract Services No. 25852-37-3, (2015).
USPTO Office Action dated May 11, 2015 in copending U.S. Appl. No. 12/503,675.
Office Communication notification date Oct. 27, 2015 received in co-pending U.S. Appl. No. 12/503,675.
USPTO Office Action dated Apr. 27, 2015 in co-pending U.S. Appl. No. 13/616,681.
Office Communication notification date Sep. 14, 2015 received in co-pending U.S. Appl. No. 13/616,681.
USPTO Office Action dated Sep. 25, 2012 for copending U.S. Appl. No. 12/721,080.
USPTO Office Action dated Nov. 18, 2015 in copending U.S. Appl. No. 14/496,567.
Office Communication notification date Sep. 23, 2016 received in co-pending U.S. Appl. No. 12/503,675.
Office Communication notification date Oct. 14, 2016 received in co-pending U.S. Appl. No. 13/616,681.
Office Communication notification date Sep. 28, 2016 received in co-pending U.S. Appl. No. 14/496,549.
Office Communication notification date Dec. 12, 2016 received in co-pending U.S. Appl. No. 14/496,508.
Office Communication notification date Sep. 7, 2016 received in co-pending U.S. Appl. No. 14/496,529.
Office Communication notification date Oct. 26, 2016 received in co-pending U.S. Appl. No. 14/496,483.
Office Communication notification date Aug. 18, 2016 received in co-pending U.S. Appl. No. 14/496,567.
Office Communication notification date Nov. 3, 2016 received in co-pending U.S. Appl. No. 14/571,568.

* cited by examiner

Figure 1: Optical and SEM micrographs of blasting media and the resultant surfaces. (media, optical micrograph 155x, SEM micrograph 1000x)
a) control – Figure 1a
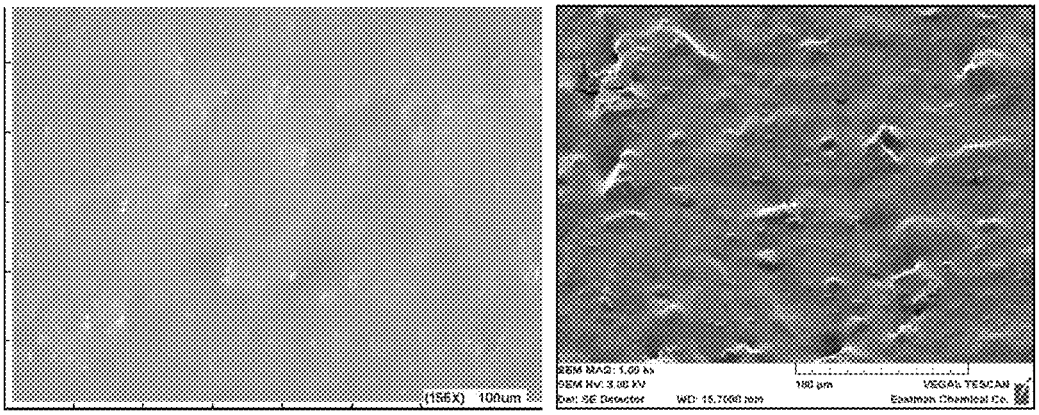
b) GNP glass beads – Figure 1b
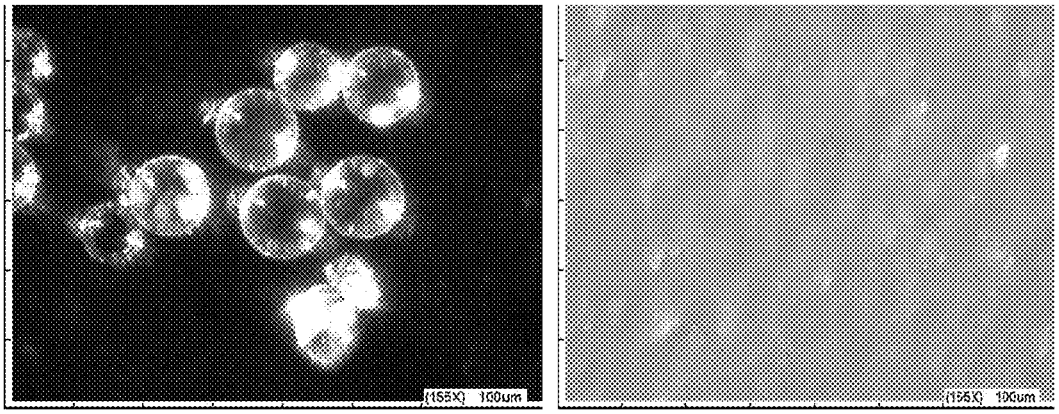
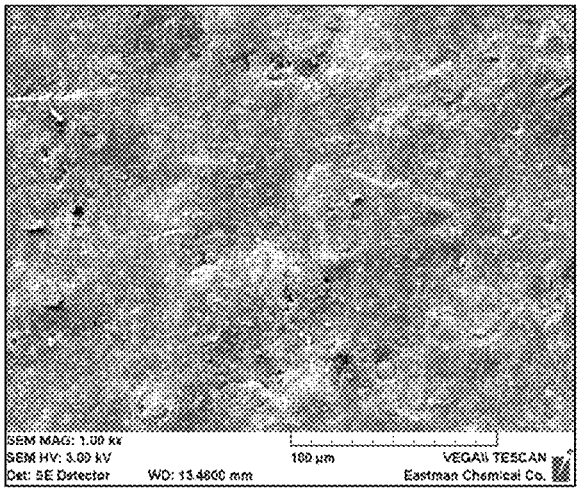

c) Eastman glass beads – Figure 1c
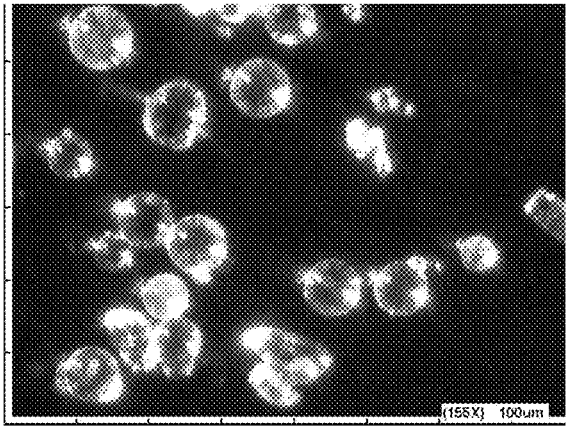
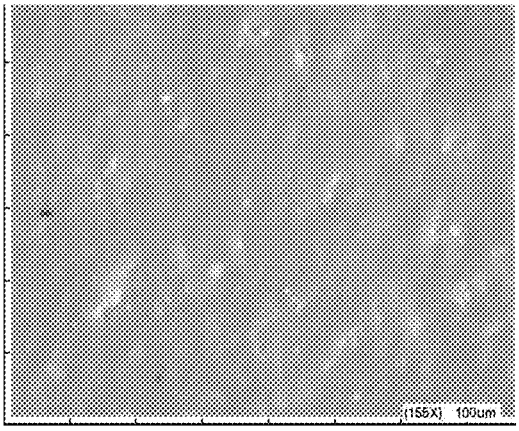
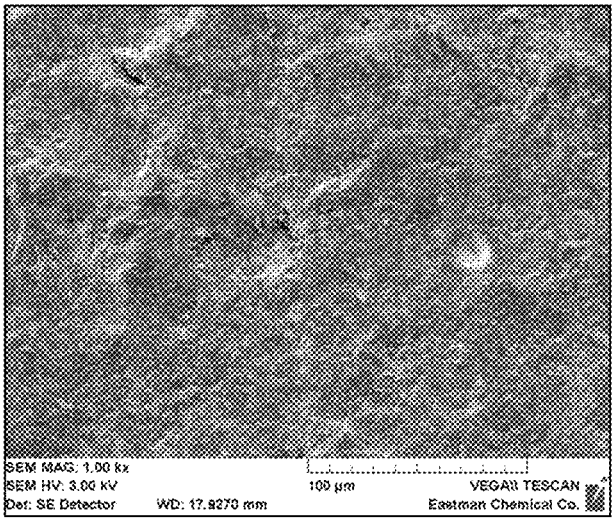

d) aluminum oxide – Figure 1d
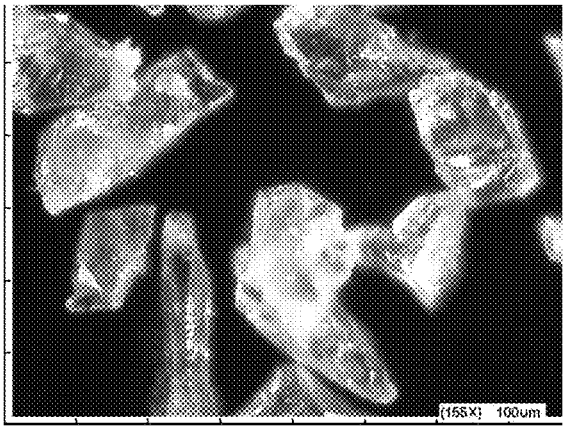
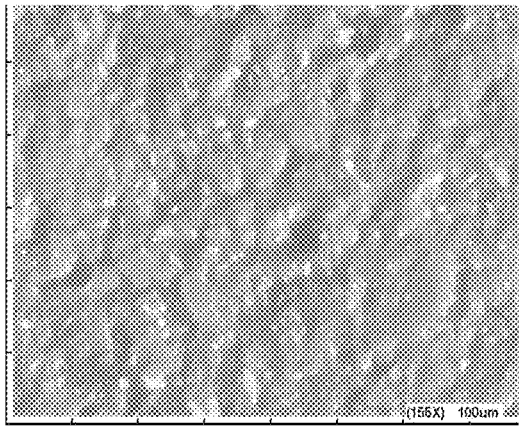
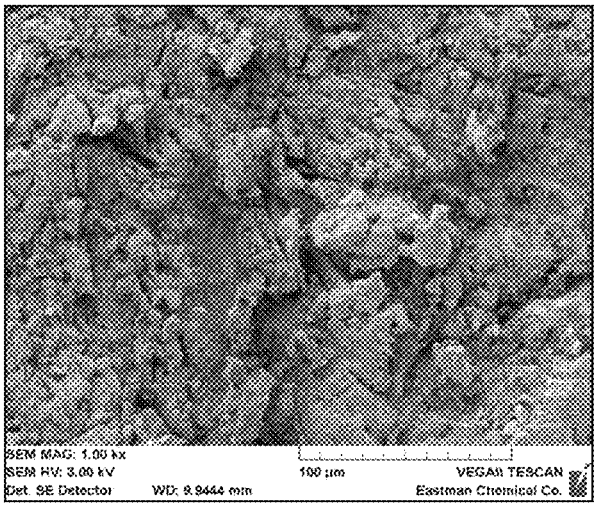

e) crushed glass – Figure 1e
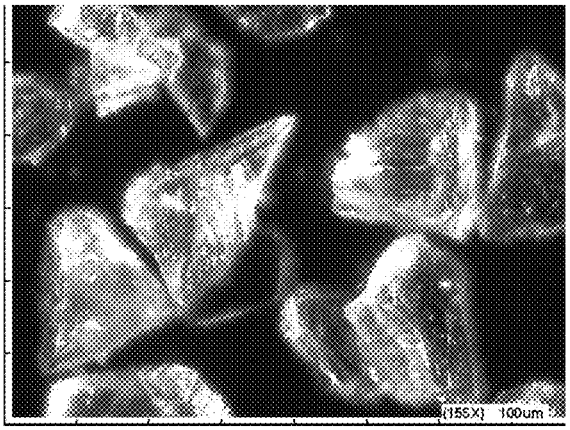
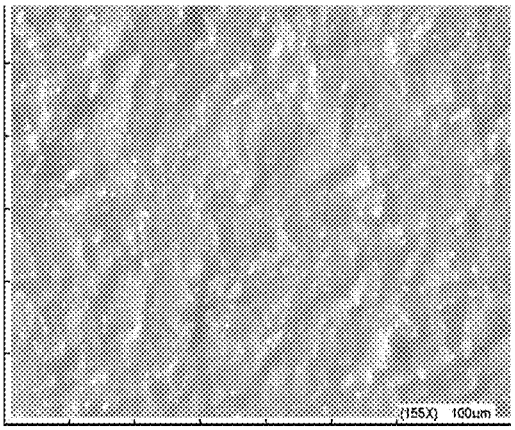
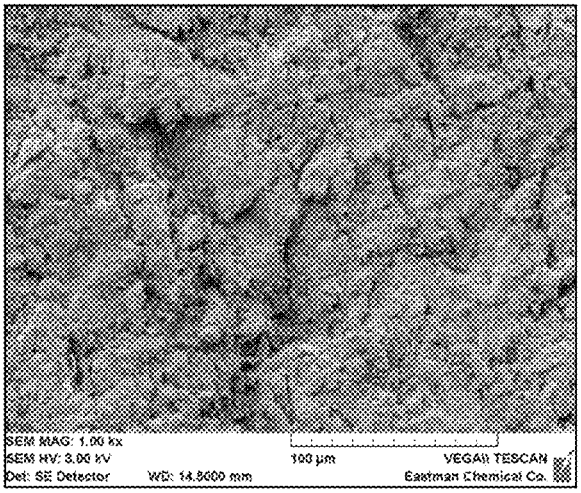

f) walnut shells – Figure 1f
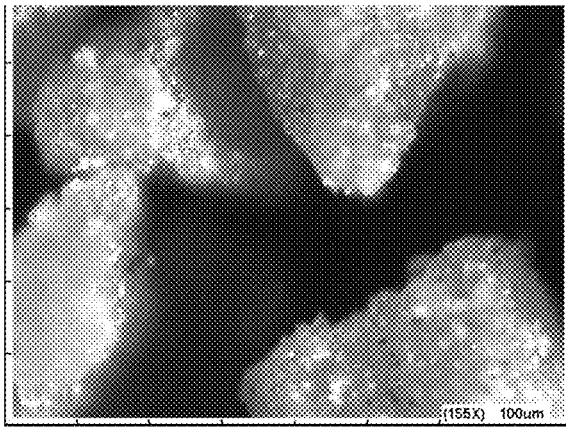
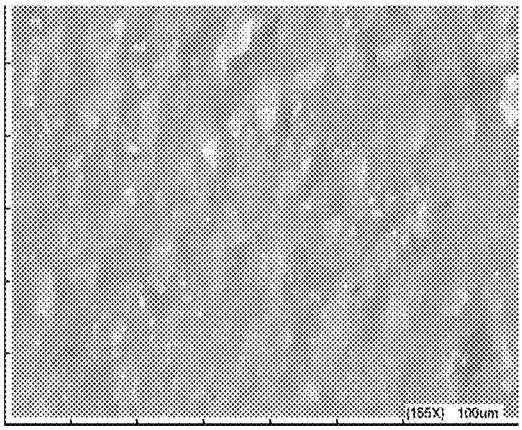
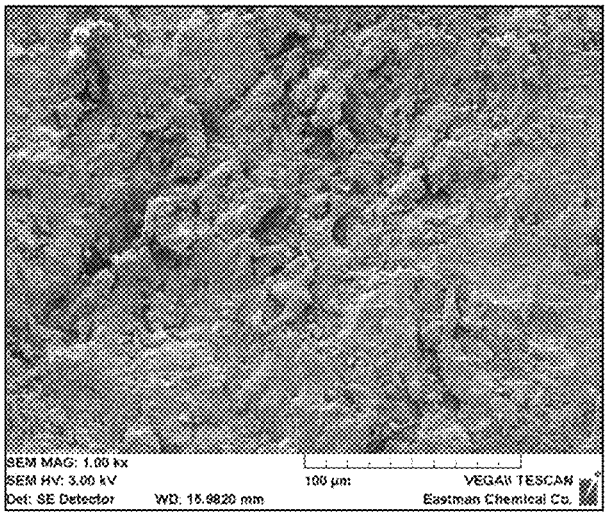

Figure 2: Various sized aluminum oxide particles and the resultant treated surfaces.
a) control – Figure 2a
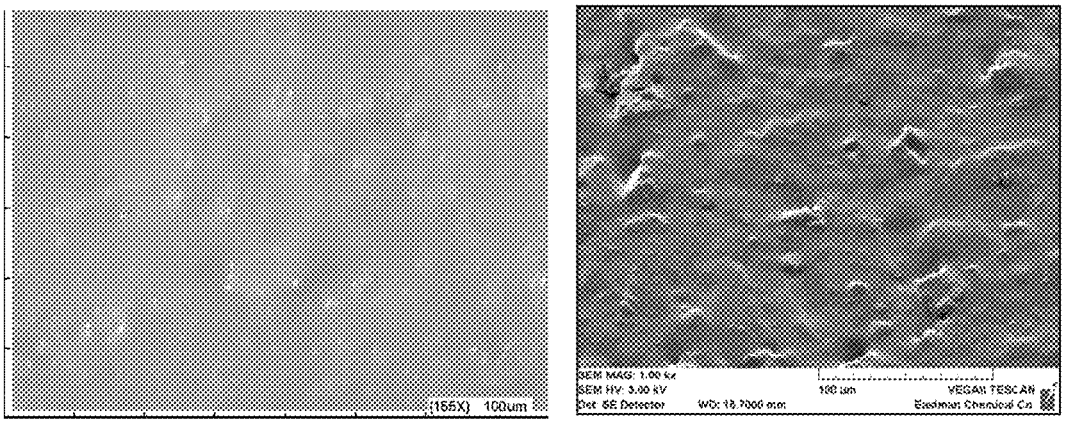
b) 60 grit – Figure 2b
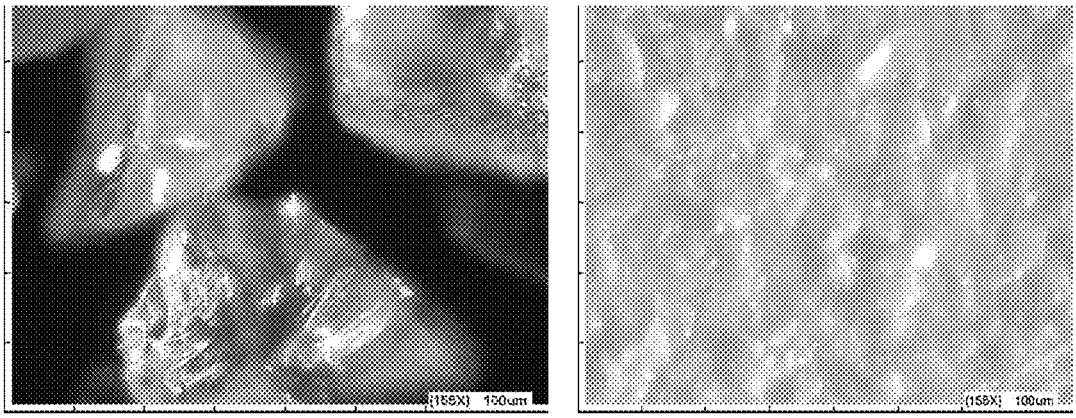
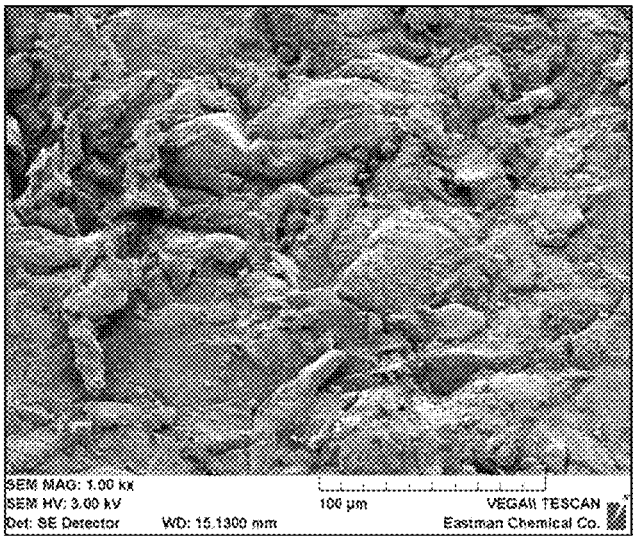

c) 70 grit – Figure 2c
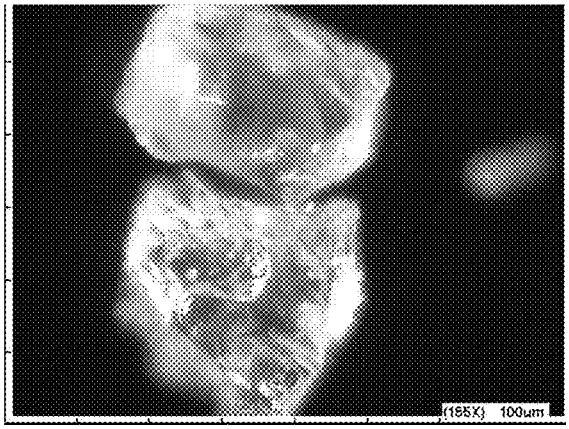
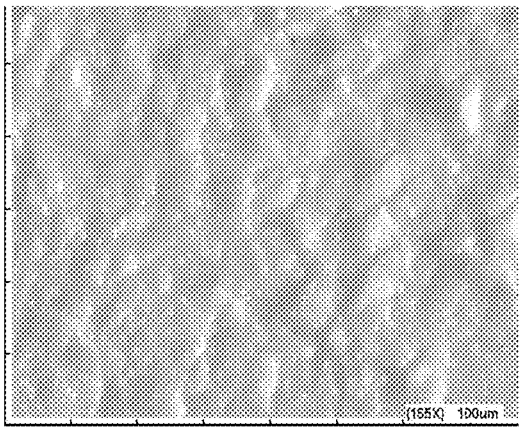
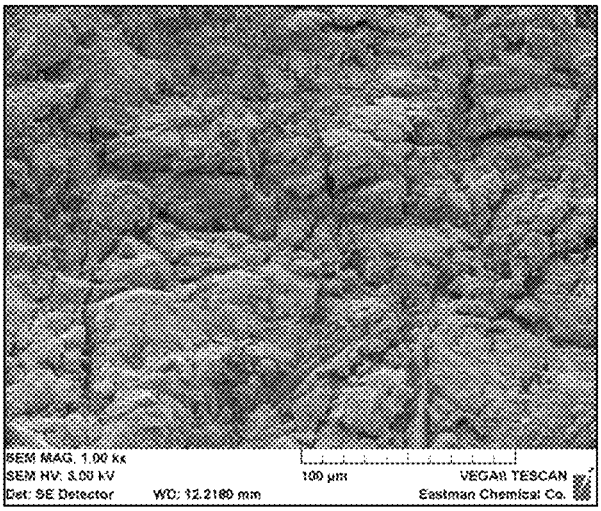

d) 80 grit – Figure 2d
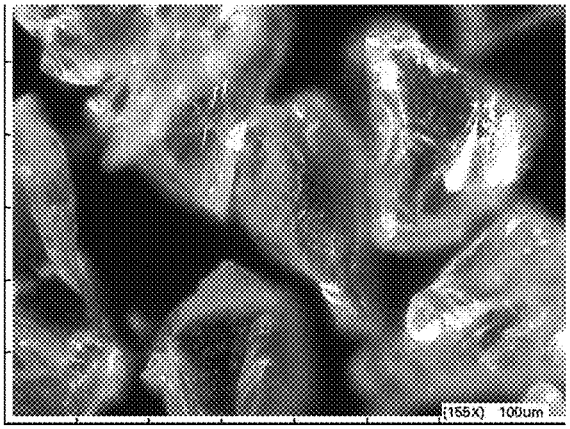
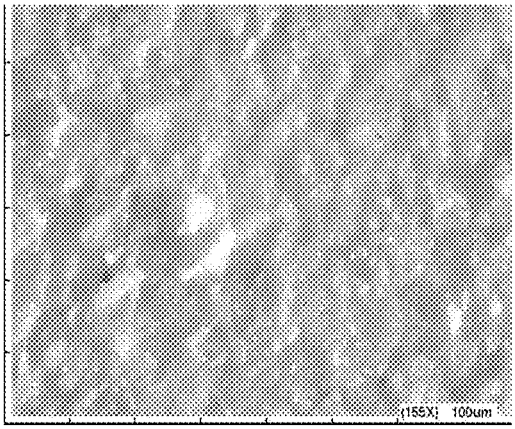
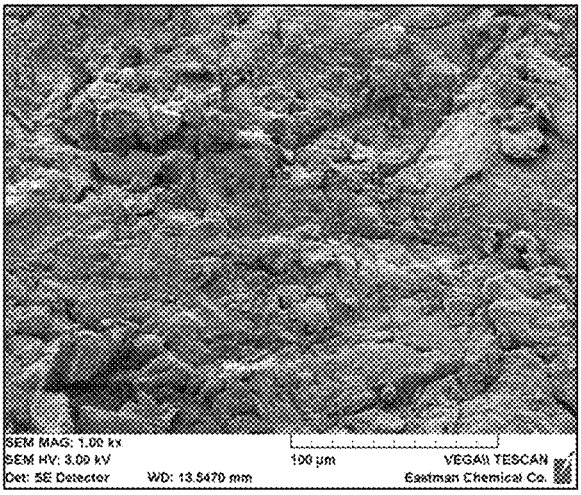

e) 150 grit – Figure 2e
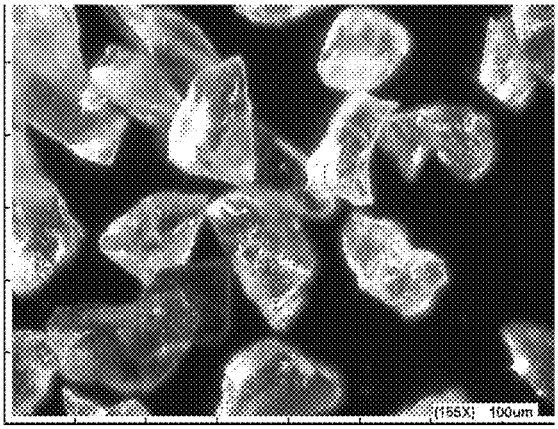
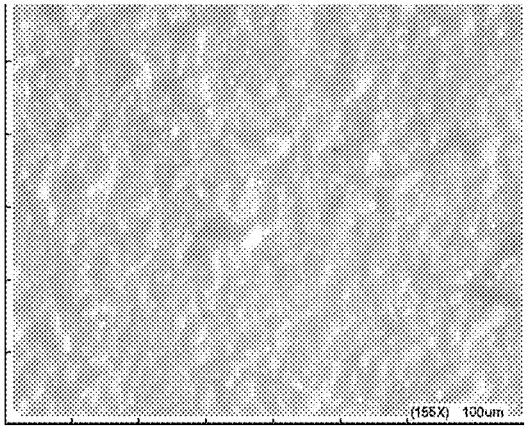
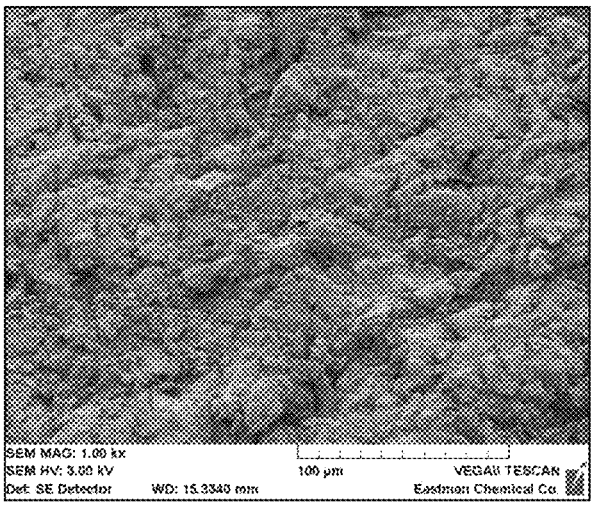

f) 220 grit – Figure 2f
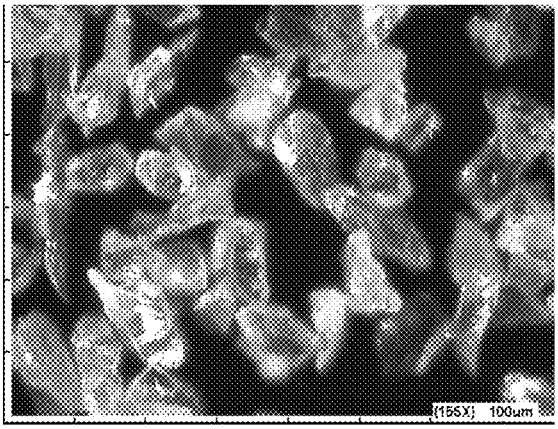
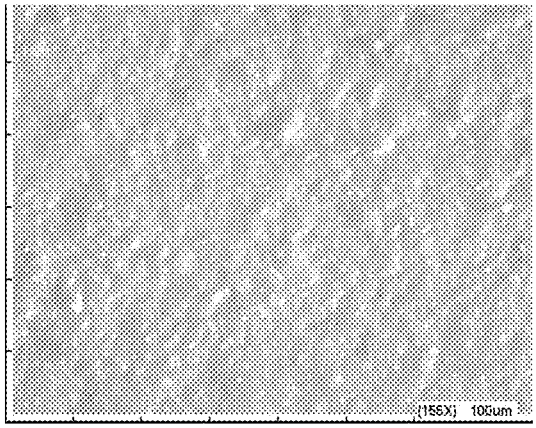
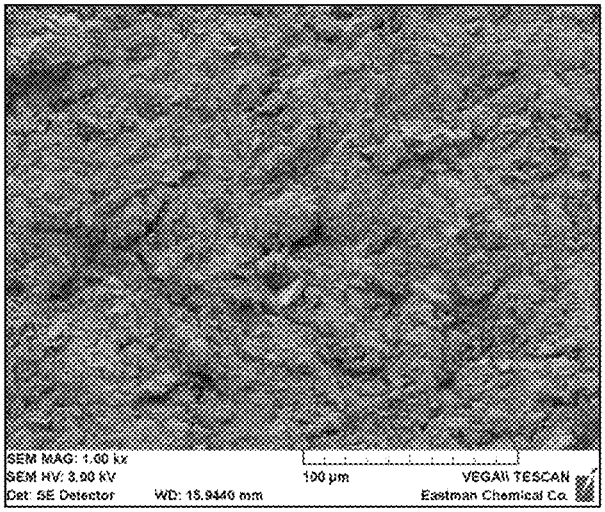

g) 320 grit – Figure 2g
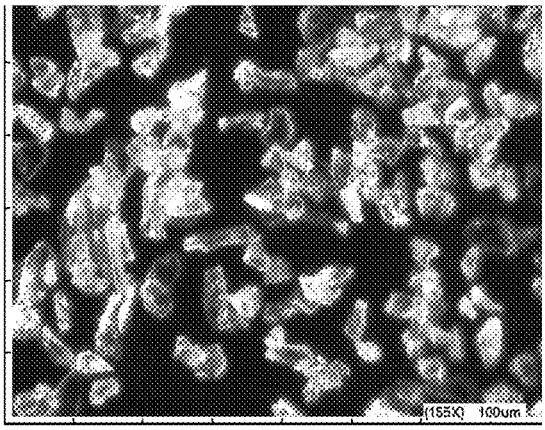
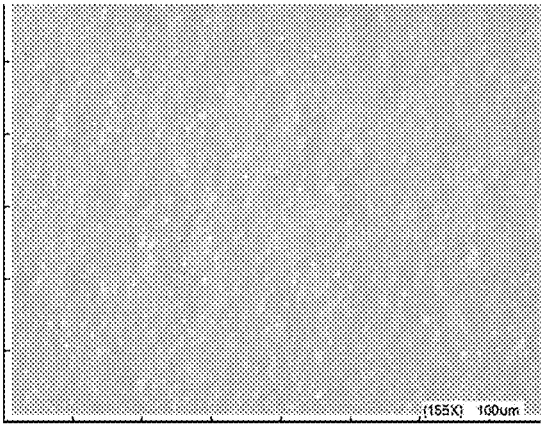
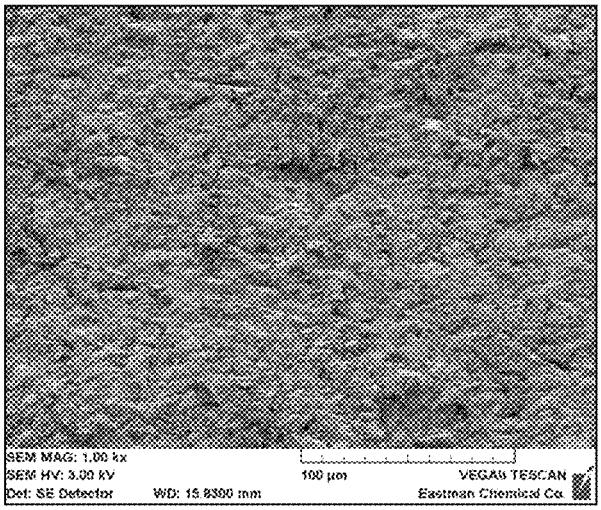

THERMOPLASTIC FORMULATIONS FOR ENHANCED PAINTABILITY, TOUGHNESS AND MELT PROCESSABILITY

CROSS REFERENCE TO RELATED APPLICATIONS

This application is a divisional of Ser. No. 12/503,675, filed Jul. 15, 2009, and claims the priority benefit of the provisional application U.S. Ser. No. 61/081,201, filed Jul. 16, 2008, which are incorporated by reference herein.

FIELD OF INVENTION

The present disclosure relates to thermoplastic compositions that are useful as extrusion coatings on various substrates, such as, for example, wood, medium density fiberboard (MDF), and synthetic substrates, articles comprising a substrate coated with the thermoplastic compositions and processes for making the articles. The compositions exhibit one or more of enhanced paintability (including paintability with water-based paints) and mechanical properties for fabrication (cutting, nailing, routing, etc.), while maintaining acceptable visual appearance, including opacity, gloss, surface appearance, and surface roughness.

BACKGROUND OF THE INVENTION

In general, solvent-based paints will exhibit acceptable adhesion to thermoplastic resin-based compositions regardless of the choice of filler(s) in the composition. However, the use of solvent based paints has been steadily decreasing with the increase in environmentally-conscience suppliers and more stringent regulatory efforts. Accordingly, water-based latex paints have become the standard for a variety of applications.

The ability to use water-based paints to color or cover polymer-based articles is limited at least by interactions between the highly polar aqueous paint solution and the relatively non-polar polymeric material. The carbon-to-carbon linkages that are characteristic of most polymer backbones used for commodity or semi-commodity thermoplastic resins lead to relatively non-polar resins. Two methods for increasing the polarity of polymers include functionalization and compounding or blending.

Functionalization involves incorporation of polar functional groups such as carbonyls, amines, hydroxyls, into the main polymeric chain and/or as side chains. However, the addition of such groups often leads to distinct and detrimental changes in the mechanical properties of the resins. Compounding or blending is an alternative to functionalization of the polymer chain. However, compounding or blending may result in a blended polymer that has extremely different chemistries than any of its components.

Accordingly, manufacturers have long struggled to develop coating compositions capable of coating a variety of substrates that exhibit enhanced paintability (including paintability with water-based paints) and mechanical properties for fabrication (cutting, nailing, routing, etc.), while maintaining acceptable visual appearance, including opacity, gloss, surface appearance, and surface roughness.

For example, one of the most common coatings for MDF interior molding and trim available in the North American market is known as a Gesso coating. Gesso, typically used by suppliers from South America or Asia, is a thick paste that is applied using a wipe-on/wipe-off type process. Drying after coating is required, and a second coating is often applied to provide the surface with a desired look; the second coating must also be dried and buffed. Thus, Gesso coating is relatively labor intensive. Furthermore, although the Gesso coating can yield a smooth, attractive finished surface that is able to hide at least minor imperfections in the surface of the underlying substrate, it can be brittle. Brittleness of the coating may lead to unacceptable handling and fabrication performance, for example, when the molding or trim is sawed, mitered, coped, nailed, and/or routed.

Another common coating available in the North American market is a coating of water-based latex paint. The paint is typically vacuum- or spray-coated onto the substrate. This type of coating is typically used by North American suppliers. Basically, a high volume of water-based latex paint is vacuum-coated or spray-coated to prime the surface of the molding or trim. That coating not only must be dried, as with the Gesso coating, but also must be sanded or buffed. A second coating and drying are also required. Furthermore, unlike the Gesso process, vacuum- and spray-coating can lead to direct telegraphing of the underlying substrate surface to the observable paint surface, revealing structural features of the underlying substrate. Accordingly, the smoothness of the coated surface depends on the quality of the milling of the molding or trim.

Accordingly, there remains a need in the art for coating compositions that, when applied to an underlying substrate, such as, for example, molding or trim, using extrusion technology, can result in a primed substrate having the smooth finish of a Gesso coating but with increased paintability and toughness, and also having acceptable visual appearance.

SUMMARY OF THE INVENTION

Certain embodiments of the present invention provide thermoplastic resin-based compositions and coating comprising additives designed to improve paintability (e.g., adhesion of an aqueous paint to its surface) and/or mechanical properties (e.g., modulus and toughness), while maintaining acceptable visual appearance, including at least one of opacity, gloss, surface appearance, or surface roughness.

One embodiment of the present disclosure provides coating compositions that comprise at least one thermoplastic resin, at least one opacity modifier, optionally at least one gloss modifier, and optionally at least one impact modifier. These compositions exhibit at least one of enhanced paintability or mechanical properties for fabrication (cutting, nailing, routing, etc.), while maintaining acceptable visual appearance.

One embodiment according to the present invention comprises a resin coating comprising a thermoplastic resin, wherein the coating is an extruded coating, wherein the thermoplastic resin has a solubility parameter ranging from about 9.4 to about 14.0 $(cal/cm^3)^{0.5}$; and wherein the thermoplastic resin has a Tg greater than about 70° C. and less than about 150° C.

In one aspect the resin coating comprises a thermoplastic resin selected from the group consisting of polyesters which includes copolyesters, polycarbonates, polymethyl methacrylate (PMMA), poly(acrylonitrile-styrene-acrylate) (ASA), poly(acrylonitrile-butadine-styrene) (ABS), poly (styrene-acrylonitrile) (SAN), cellulose esters and mixtures thereof.

In one aspect the resin coating comprises a copolyester comprising at least 80 mole % acid residues from terephthalic acid, derivatives of terephthalic acid and mixtures thereof, at least 80 mole % glycol residues from ethylene glycol and 1,4-cyclohexanedimethanol, wherein the acid residues are based on 100 mole % acid residues and the glycol residues are based on 100 mole % glycol residues.

In one aspect the resin coating comprises a polyester comprising 70 to 100 mole % acid residues from terephthalic acid, 0 to 30 mole % aromatic dicarboxylic acid residues having up to 20 carbon atoms, and 0 to 10 mole % of aliphatic dicarboxylic acid residues having up to 16 carbon atoms wherein the acid residues are based on 100 mole % acid residue. In one aspect the resin coating comprises a polyester comprising 80 to 100 mole % acid residues from terephthalic acid, 0 to 20 mole % aromatic dicarboxylic acid residues having up to 20 carbon atoms, and 0 to 10 mole % of aliphatic dicarboxylic acid residues having up to 16 carbon atoms wherein the acid residues are based on 100 mole % acid residues. In one aspect the resin coating comprises a polyester comprising 90 to 100 mole % acid residues from terephthalic acid, 0 to 10 mole % aromatic dicarboxylic acid residues having up to 20 carbon atoms, and 0 to 10 mole % of aliphatic dicarboxylic acid residues having up to 16 carbon atoms wherein the acid residues are based on 100 mole % acid residues.

In another aspect the present invention provides an article comprising a polyester comprising: (a) at least 80 mole % acid residues from terephthalic acid, derivatives of terephthalic acid and mixtures thereof, (b) at least 80 mole % glycol residues from ethylene glycol and 1,4-cyclohexanedimethanol, wherein the acid residues are based on 100 mole % acid residues and the glycol residues are based on 100 mole % glycol residues.

In another aspect the present invention provides an article comprising a polyester comprising: (i) an acid component comprising: (a) at least 70 mole % acid residues from terephthalic acid, derivatives of terephthalic acid and mixtures thereof; (b) from 0 to 30 mole % acid residues from aromatic dicarboxylic acids; and (c) from 0 to 10 mole % acid residues from aliphatic dicarboxylic acids having up to 20 carbon atoms; and (ii) a glycol component comprising: (a) from 20 to 70 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

In another aspect the present invention provides an article comprising a polyester comprising: (i) an acid component comprising: (a) at least 70 mole % acid residues from terephthalic acid, derivatives of terephthalic acid and mixtures thereof; (b) from 0 to 30 mole % acid residues from aromatic dicarboxylic acids; and (c) from 0 to 10 mole % acid residues from aliphatic dicarboxylic acids having up to 20 carbon atoms; (ii) a glycol component comprising: (a) from 20 to 81 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

In one aspect, certain polyesters useful in the invention are amorphous or semicrystalline. In one aspect, certain polyesters useful in the invention can have a relatively low crystallinity.

In one aspect, of the invention, the crystallization half-times are greater than 5 minutes at 170° C., or greater than 1,000 minutes at 170° C., or greater than 10,000 minutes at 170° C.

In one aspect the resin coating composition comprises a thermoplastic resin having a solubility parameter ranging from about 10.5 to about 14.0 $(cal/cm^3)^{0.5}$.

In one aspect the resin coating composition further comprises an opacity modifier.

In one aspect the resin coating composition further comprises an impact modifier.

In one aspect the resin coating composition further comprises a gloss modifier.

In one embodiment according to the present invention, the coating composition comprises from about 40 wt % to about 100 wt % of a thermoplastic resin selected from the group consisting of polyesters, polycarbonates, polymethyl methacrylate (PMMA), poly(acrylonitrile-styrene-acrylate) (ASA), poly(styrene-acrylonitrile) (SAN), poly(acrylonitrile-butadine-styrene) (ABS), and mixtures thereof; from about 0 wt % to about 15 wt % of an opacity modifier; from about 0 wt % to about 50 wt % of an impact modifier; and from about 0 wt % to about 40 wt % of a gloss modifier, wherein at least one of the opacity modifier, impact modifier or gloss modifier is greater than 0 wt %, wherein the weight percents are based on the total weight of the coating composition.

The present disclosure also provides a coating composition comprising:

- 30% by weight to 95% by weight of at least one thermoplastic polymer;
- 1% by weight to 15% by weight of at least one opacity modifier;
- 0% by weight to 50% by weight of at least one gloss modifier; and
- 0% by weight to 20% by weight of at least one impact modifier, The present disclosure additionally provides a coating composition comprising:

- 30% by weight to 70% by weight of at least one copolyester;
- 1% by weight to 10% by weight of titanium dioxide;
- 10% by weight to 40% by weight of calcium carbonate; and
- 5% by weight to 20% by weight of at least one impact modifier comprising at least one polymer chosen from polybutadiene, polyisoprene, polyurethanes, polyethers, polyesters, polyacrylates, and polyolefins, wherein the weight percents are based on the total weight of the composition. In an embodiment, the at least one polymer is not a homopolymer.

In another aspect the present invention provides an article comprising a coating composition comprising at least one thermoplastic resin, at least one opacity modifier, optionally at least one gloss modifier, and optionally at least one impact modifier; and a substrate at least partially coated with the coating composition.

One embodiment according to the present invention comprises an article comprising (a) a wood or wood composite substrate at least partially covered with a thermoplastic resin coating; (b) the thermoplastic resin having a solubility parameter ranging from about 9.4 to about 14.0 $(cal/cm^3)^{0.5}$; and (c) paint covering at least a portion of the resin coating; wherein the coating is an extruded coating; wherein the thermoplastic resin has a Tg greater than about 70° C. and less than about 150° C.; and wherein the paint has a performance score of at least 6.

In one aspect the article comprises a thermoplastic resin coating comprising a polyester having a solubility parameter ranging from about 10.4 to about 11.5 $(cal/cm^3)^{0.5}$.

In one aspect the performance score of the paint on the untreated polymer coating on the article comprises a tape peel value of at least 3, or of at least 4 or at least 5.

In one aspect the performance score of the paint on the untreated polymer coating on the article comprises a cross hatch value of at least 3, or of at least 4 or at least 5.

In one aspect the performance score of the paint on the untreated polymer coating on the article comprises a cross hatch value and a tape peel value each at least 3, or of at least 4 or at least 5.

In one aspect the performance score of the paint on the treated polymer coating on the article comprises a combined tape peel value and cross hatch value of at least 6, or of at least 7 or at least 8 or at least 9 or at least 10.

In one aspect the performance score of the paint on the treated polymer coating on the article comprises a combined tape peel value and cross hatch value of at least 6, or of at least 7 or at least 8 or at least 9 or at least 10 and a scratch adhesion value at least 50% or at least 100% larger than the scratch adhesion value of the untreated polymer coating.

In one aspect the present invention provides a method of making an article comprising a wood or wood composite substrate at least partially covered with a thermoplastic resin coating comprising a polyester, the method comprising; (a) extruding the polyester coating wherein the polyester has a solubility parameter ranging from about 9.4 to about 14.0 $(cal/cm^3)^{0.5}$ onto the wood or wood substrate; and (b) applying a water-based paint covering to at least a portion of the polyester coating to form a paint coating; wherein the thermoplastic resin has a Tg greater than about 70° C. and less than about 150° C.; and wherein the paint coating on the polyester coating has a performance score, comprising tape peel value and cross hatch value, ranging from 6 to 10.

In one aspect the present invention provides a method of making an article, wherein the polyester coating is abraded with a blasting media to form an abraded polyester resin surface before the paint coating is applied.

In another aspect the present invention provides a method of making an article wherein the polyester comprises: (a) at least 80 mole % acid residues from terephthalic acid, derivatives of terephthalic acid and mixtures thereof, (b) at least 80 mole % glycol residues from ethylene glycol and 1,4-cyclohexanedimethanol, wherein the acid residues are based on 100 mole % acid residues and the glycol residues are based on 100 mole % glycol residues.

In another aspect the present invention provides a method of making an article wherein the polyester comprises: (i) an acid component comprising: (a) at least 70 mole % acid residues from terephthalic acid, derivatives of terephthalic acid and mixtures thereof; (b) from 0 to 30 mole % acid residues from aromatic dicarboxylic acids; and (c) from 0 to 10 mole % acid residues from aliphatic dicarboxylic acids having up to 20 carbon atoms; and (ii) a glycol component comprising: (a) from 20 to 70 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

In another aspect the present invention provides a method of making an article wherein the polyester is amorphous.

In another aspect the present invention provides a method of making an article wherein the polyester comprises: (i) an acid component comprising: (a) at least 70 mole % acid residues from terephthalic acid, derivatives of terephthalic acid and mixtures thereof; (b) from 0 to 30 mole % acid residues from aromatic dicarboxylic acids; and (c) from 0 to 10 mole % acid residues from aliphatic dicarboxylic acids having up to 20 carbon atoms; (ii) a glycol component comprising: (a) from 20 to 81 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

In one aspect the present invention provides a method of making an article, wherein the abraded polyester resin surface has a surface roughness ranging from 10 to 370 micro inches.

In one aspect the present invention provides a method of making an article, wherein the blasting media is granular.

In one aspect the present invention provides a method of making an article, wherein the blasting media is selected from the group of aluminum oxide, crushed glass, silicon carbide, steel grit, walnut shells, sand, jet mag, and calcium carbonate.

In one aspect the present invention provides a method of making an article, wherein the performance score of the paint on the abraded polyester resin surface has a cross-hatch value of at least 3.

In one aspect the present invention provides a method of making an article, wherein the performance score of the paint on the abraded polyester resin surface has a tape peel value of at least 3.

In one aspect the present invention provides a method of making an article, wherein the performance score of the paint on the abraded polyester resin surface has a scratch adhesion value at least 50% higher than the scratch adhesion value on the untreated surface.

BRIEF DESCRIPTION OF THE DRAWINGS

FIG. 1*a* shows optical and SEM micrographs of a control sample of polyester prior to media blasting treatment.

FIG. 1*b* shows optical and SEM micrographs of a sample of polyester after media blasting treatment with GNP glass beads.

FIG. 1*c* shows optical and SEM micrographs of a sample of polyester after media blasting treatment with Eastman glass beads.

FIG. 1*d* shows optical and SEM micrographs of a sample of polyester after media blasting treatment with aluminum oxide.

FIG. 1*e* shows optical and SEM micrographs of a sample of polyester after media blasting treatment with crushed glass.

FIG. 1*f* shows optical and SEM micrographs of a sample of polyester after media blasting treatment with walnut shells.

FIG. 2*a* shows optical and SEM micrographs of a control sample of polyester prior to alumina oxide blasting treatment.

FIG. 2*b* shows optical and SEM micrographs of a sample of polyester after media blasting treatment with 60 grit alumina oxide.

FIG. 2*c* shows optical and SEM micrographs of a sample of polyester after media blasting treatment with 70 grit alumina oxide.

FIG. 2*d* shows optical and SEM micrographs of a sample of polyester after media blasting treatment with 80 grit alumina oxide.

FIG. 2*e* shows optical and SEM micrographs of a sample of polyester after media blasting treatment with 150 grit alumina oxide.

FIG. 2*f* shows optical and SEM micrographs of a sample of polyester after media blasting treatment with 220 grit alumina oxide.

FIG. 2*g* shows optical and SEM micrographs of a sample of polyester after media blasting treatment with 320 grit alumina oxide.

DETAILED DESCRIPTION OF THE INVENTION

The present invention may be understood more readily by reference to the following detailed description of certain embodiments of the invention and the working examples.

In accordance with the purpose(s) of this invention, certain embodiments of the invention are described in the Summary of the Invention and are further described herein below. Also, other embodiments of the invention are described herein.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, each numerical parameter should at least be construed in light of the number of reported significant digits and by applying ordinary rounding techniques. Further, the ranges stated in this disclosure and the claims are intended to include the entire range specifically and not just the endpoint (s). For example, a range stated to be 0 to 10 is intended to disclose all whole numbers between 0 and 10 such as, for example 1, 2, 3, 4, etc., all fractional numbers between 0 and 10, for example 1.5, 2.3, 4.57, 6.1113, etc., and the endpoints 0 and 10. Also, a range associated with chemical substituent groups such as, for example, "$C_1$ to $C_5$ hydrocarbons", is intended to specifically include and disclose $C_1$ and $C_5$ hydrocarbons as well as $C_2$, $C_3$, and $C_4$ hydrocarbons.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

As used in the specification and the appended claims, the singular forms "a," "an" and "the" include their plural referents unless the context clearly dictates otherwise. For example, reference a "plasticizer," or a "cellulose ester," is intended to include a plurality of plasticizers or cellulose ester. References to a composition containing or including "an" plasticizer or "a" cellulose ester is intended to include other plasticizer or other cellulose ester, respectively, in addition to the one named.

By "comprising" or "containing" or "including" we mean that at least the named compound, element, particle, or method step, etc., is present in the composition or article or method, but does not exclude the presence of other compounds, catalysts, materials, particles, method steps, etc, even if the other such compounds, material, particles, method steps, etc., have the same function as what is named, unless expressly excluded in the claims.

It is also to be understood that the mention of one or more method steps does not preclude the presence of additional method steps before or after the combined recited steps or intervening method steps between those steps expressly identified. Moreover, the lettering of process steps or ingredients is a convenient means for identifying discrete activities or ingredients and the recited lettering can be arranged in any sequence, unless otherwise indicated.

Certain embodiments of the present disclosure provide methods for increasing paintability and mechanical properties of a coating composition, comprising combining at least one thermoplastic resin with: 1) at least one opacity modifier; 2) optionally at least one gloss modifier; and 3) optionally at least one impact modifier.

The coating compositions according to the present invention are useful in coating any material having a linear profile that is currently being painted, wrapped, or Gessoed, including but not limited to door jambs, window jambs, other door or window parts, flat-panel shelving, pull-trusion articles, interior and exterior molding and trim, and exterior and interior siding. The substrate material to be coated is only limited by the ability of the formulation to adhere during the coating process and may be chosen from, for example, MDF, particle board, oriented strand board, fiberglass, natural woods, composite wood products, and synthetic substrates.

In addition, the coating compositions according to the present invention may permit the use of a much less refined substrate surface than that currently used in commercial applications, since defects from the milling process may not be telegraphed through into the primed surface. These coatings may eliminate the need for at least one of sanding or buffing the coated substrate and drying the coated substrate, both of which are required by current coating technologies.

The thermoplastic resin-based coating compositions disclosed herein exhibit enhanced paintability and/or mechanical properties for fabrication (cutting, nailing, routing, etc.), while maintaining acceptable visual appearance, including opacity, gloss, surface appearance, and/or surface roughness.

As used herein, "enhanced paintability" refers to superior adhesion of a paint to a coating composition as determined using at least one of the Cross-Hatch test, the Scratch test for media blasted samples, and the Tape Line test as defined herein.

"Enhanced mechanical properties" as used herein refers to superior toughness as compared to Gesso and vacuum coatings currently available in the North American market as determined using the tests set forth herein.

As used herein, "visual appearance" refers to at least opacity, gloss, surface appearance, and surface roughness. "Opacity" as used herein refers to the degree to which light is blocked. Opacity is determined using the method set forth herein. "Gloss" as used herein refers to the degree of surface shininess and is determined using ASTM Test Method D 2457, as set forth below. "Surface appearance," as used herein, refers to visible flaws in the surface of a coating composition, including telegraphing of the surface (revelation of structural features of the underlying substrate) and flaws in the surface due to the method of production and/or coating (e.g., bumps due to rollers, etc.). As used herein, "surface roughness" refers to the degree of inequalities, ridges, or projections on the surface, and is determined using the test set forth herein. "Acceptable" visual appearance as used herein means at least as good as Gesso and vacuum coatings currently available in the North American market.

The ability to concurrently provide acceptable performance in the aforementioned properties is unexpected since each performance property may be affected differently and in an unpredictable manner by each of the various components of the composition. Furthermore, each of the components may, and generally does, influence more than one performance property of the composition. Accordingly, the balance between the effect(s) of each of the components on the performance properties that must be obtained in order to provide thermoplastic resin-based compositions with enhanced paintability and enhanced mechanical properties for fabrication (cutting, nailing, routing, etc.) as well as an acceptable visual appearance is highly unpredictable.

For example, the paintability of a thermoplastic resin-based composition primarily depends on two factors: 1) the ability of the paint to wet the composition and 2) the surface of the thermoplastic resin-based composition, in particular the availability of some surface texture on the composition to provide mechanical interlocking for the dried paint.

In turn, the ability to wet the surface of the composition is strongly dependent on the mismatch in the solubility parameter of the paint and the solubility parameter of the surface of the composition, which, in turn, is affected by the nature of the base resin. The major factor affecting the solubility parameter of the composition is the nature of the base resin. Generally, the more polar the resin, the better the water-based paint will wet out on the resin and not bead up. Resins such as polyesters, polycarbonates, polyacrylates, polyurethanes, and polyamides are generally considered to be some of the more polar thermoplastics, whereas polyolefins such as polypropylene and polyethylene are considered to be less polar.

If the solubility parameter of the surface of the paint and the solubility parameter of the composition are similar, the interfacial surface energy will be lower, and will allow the paint to intimately contact the surface of the composition. As the paint dries and coalesces, porous surfaces on the composition will allow the paint to form mechanical interlocks with the surface. The sizes of latex particles in paint are on the order of nanometers. Accordingly, a microporous surface structure can be designed on a sub-micron scale, which will not affect the macroscale appearance or feel.

The addition of metal salts may increase the polarity of a coating composition, which may improve the wetting that occurs during painting. However, the size, shape, and concentration of the metal salts will affect the amount of surface area that is exposed on the substrate surface. On the other hand, the addition of impact modifiers often lowers the overall solubility parameter, because the most effective impact modifiers are based on polyethylene, which has a solubility parameter of approximately 8.0 $(cal/cm^3)^{1/2}$. Phase separation of the impact modifier and base resin can potentially lead to blooming on the surface which will further reduce the solubility parameter on the substrate surface due to an increased concentration of the non-polar polymer segments. Reactive impact modifiers may offer a potential route to reduce the blooming effect. In addition, impact modifiers based on more polar rubber segments, such as, for example, acrylics such as butyl acrylate; and polyether and polybutadiene are also potential candidates.

In addition to adhesion of the paint onto the coating, the coating must exhibit sufficient adhesion to the substrate material. Low adhesion of the coating could lead to wide ranging delamination during fabrication and installation. Adhesion of the coating to a substrate is a result of two factors: 1) the ability of the coating to wet the surface of the substrate, which is related to solubility parameter interactions and 2) the ability of the coating to flow on the substrate surface and mechanical interlocking with the substrate surface. Unlike the paint adhesion, where the viscosity is very low and the solubility parameter interaction is the limiting factor, adhesion of a coating to a substrate will depend on the viscosity of the coating during melt processing. As the coating cools after it leaves the die, its ability to flow will decrease, and the ability to adhere to the substrate will also decrease. The time before the coating has cooled to a temperature and a viscosity that prevents adhesion to the substrate depends on 1) the relationship of the viscosity of the coating to the processing temperature and 2) temperature of the substrate, as it could potentially absorb a significant amount of heat from the melted coating.

Another desired characteristic in a thermoplastic resin-based coating composition is sufficient mechanical toughness to endure fabrication, such as cutting, nailing, routing, etc.

However, certain possible additives to a thermoplastic resin-based coating may increase the mechanical toughness of the composition, while others may decrease it. For example, metal salts and other inorganic fillers will tend to make the composition more brittle to varying degrees, depending on the chemical nature and shape of the particles. Increasing particle size and concentration tend to decrease the overall toughness of the composition. On the other hand, impact modifiers may improve the toughness.

Impact modifiers are generally resins. The effectiveness of impact modifiers on the toughness of the composition is dependent on 1) the toughness of the base resin, 2) the miscibility of the impact modifier with the base resin, and 3) the chemical composition of the impact modifier.

The opacity of a thermoplastic resin-based coating composition may be affected by 1) the presence or absence of organic or inorganic dyes, 2) the concentration(s) of organic or inorganic dyes, and 3) the thickness of the coating composition.

The surface gloss of a thermoplastic resin-based coating composition may be, and generally is, affected by 1) the presence of agents that disrupt the surface of the composition, even on a microscopic scale, and 2) by the presence of agents that prevent reflection of light from the surface of the composition. Small inorganic particles, such as, for example, talc and calcium carbonate, may be used to modify the surface gloss of a thermoplastic resin-based coating composition. However, such particles may also affect the polarity of the surface of the composition, the visual appearance and feel of the surface of the composition, and toughness of the composition. For example, generally, the larger the size of the particles, the more visual surface roughness will be observed. On the other hand, the toughness of the composition is generally reduced as the particle size increases.

The surface smoothness of a thermoplastic resin-based coating composition is a complicated parameter that is influenced by almost all of the possible components of the composition as well as the processing conditions, such as, for example, die or mold design and extruder/injection molder conditions. For example, particles of a gloss or opacity modifier that do not melt during processing may lead to a rough surface if the processing conditions are not properly set. Further for example, reactive components of the compositions may also affect the resulting surface if they are exposed to extreme processing conditions, such as, for example, high heats and long residence times. The nature of the die or injection mold may also control the resulting surface finish. In general, additives or processing conditions that generate a fluid smooth melt will generate a smooth "attractive surface". Increasing processing temperatures may yield a smoother, lower viscosity melt but limits must be recognized so as to avoid degradation of the composition or overreacting the reactive components.

In certain embodiments according to the present invention, the coating compositions of the present disclosure comprise at least one thermoplastic resin, at least one opacity modifier, optionally at least one gloss modifier, and optionally at least one impact modifier. These compositions may exhibit enhanced paintability and mechanical properties for fabrication (cutting, nailing, routing, etc.), while maintaining acceptable visual appearance, including opacity, gloss, surface appearance, and surface roughness. In an embodiment, the coating composition is not a powder coating composition.

In one aspect the thermoplastic resin comprises a polycarbonate and the performance score of the paint on the article comprises a cross hatch value of at least 3 and/or a tape peel value of at least 3.

In one aspect the thermoplastic resin comprises a polymethyl methacrylate and the performance score of the paint on the article comprises a cross hatch value of at least 3 and/or a tape peel value of at least 3

In one aspect the thermoplastic resin comprises a poly (acrylonitrile-styrene-acrylate) and the performance score of the paint on the article comprises a cross hatch value of at least 3 and/or a tape peel value of at least 3.

In one aspect the thermoplastic resin comprises a poly (styrene-acrylonitrile) and the performance score of the paint on the article comprises a cross hatch value of at least 3 and/or a tape peel value of at least 3.

In one aspect the thermoplastic resin comprises a cellulose ester and the performance score of the paint on the article comprises a cross hatch value of at least 3 and/or a tape peel value of at least 3.

In one embodiment according to the present invention, the present disclosure also relates to a coating composition comprising (1) 30% by weight to 95% by weight, relative to the weight of the total composition, of at least one thermoplastic polymer (for example, copolyester or ABS or SAN), (2) 1% by weight to 15% by weight, relative to the weight of the total composition, of at least one opacity modifier (for example, titanium dioxide), (3) 0% by weight to 50% by weight, relative to the weight of the total composition, of at least one gloss modifier (for example, calcium carbonate), and (4) 0% by weight to 20% by weight, relative to the weight of the total composition, of at least one impact modifier (for example, polyurethane, polyether, polyester, polyolefin, vinyl acetate, polyethylene, polyamide, polycarbonate, polyisoprene, polybutadiene or polyethylene methyl acrylate). In an embodiment, the at least one impact modifier is not a homopolymer.

Thermoplastic Resin

The at least one thermoplastic resin can be any thermoplastic resin capable of being melt-processed. For example, the at least one thermoplastic resin may be chosen from linear thermoplastic resins, branched thermoplastic resins, hyperbranched thermoplastic resins, and star-shaped thermoplastic resins. Non-limiting examples of suitable thermoplastic resins include polyesters, copolyesters, acrylics, polycarbonates. Additional non-limiting examples include poly(ethylene terephthalate) (PET), PETG copolyester, and poly(methyl methacrylate) (PMMA), poly(acrylonitrile-styrene-acrylate) (ASA), and poly(acrylonitrile-butadiene-styrene) (ABS), poly(styrene-acrylonitrile) (SAN). Examples of thermoplastic resins include, but are not limited to, EASTAR copolyester 6763, a PETG available from Eastman Chemical Company; LURAN HD, a SAN available from BASF; TERLURAN GP-22, an ABS available from BASF; Modified Acrylate, a PMMA available from Degussa; and CENTREX 833, an ASA available from Lanxess.

The term "polyester", as used herein, is intended to include "copolyesters" and is understood to mean a synthetic polymer prepared by the reaction of one or more difunctional carboxylic acids and/or multifunctional carboxylic acids with one or more difunctional hydroxyl compounds and/or multifunctional hydroxyl compounds. Typically the difunctional carboxylic acid can be a dicarboxylic acid and the difunctional hydroxyl compound can be a dihydric alcohol such as, for example, glycols and diols. The term "glycol" as used in this application includes, but is not limited to, diols, glycols, and/or multifunctional hydroxyl compounds. Alternatively, the difunctional carboxylic acid may be a hydroxy carboxylic acid such as, for example, p-hydroxybenzoic acid, and the difunctional hydroxyl compound may be an aromatic nucleus bearing 2 hydroxyl substituents such as, for example, hydroquinone. The term "residue", as used herein, means any organic structure incorporated into a polymer through a polycondensation and/or an esterification reaction from the corresponding monomer. The term "repeating unit", as used herein, means an organic structure having a dicarboxylic acid residue and a diol residue bonded through a carbonyloxy group. Thus, for example, the dicarboxylic acid residues may be derived from a dicarboxylic acid monomer or its associated acid halides, esters, salts, anhydrides, or mixtures thereof. Furthermore, as used in this application, the term "diacid" includes multifunctional acids such as branching agents. As used herein, therefore, the term dicarboxylic acid is intended to include dicarboxylic acids and any derivative of a dicarboxylic acid, including its associated acid halides, esters, half-esters, salts, half-salts, anhydrides, mixed anhydrides, or mixtures thereof, useful in a reaction process with a diol to make polyester. As used herein, the term "terephthalic acid" is intended to include terephthalic acid itself and residues thereof as well as any derivative of terephthalic acid, including its associated acid halides, esters, half-esters, salts, half-salts, anhydrides, mixed anhydrides, or mixtures thereof or residues thereof useful in a reaction process with a diol to make polyester.

In certain embodiments according to the present invention, PETG is defined herein as a polyester comprising residues of an aromatic dicarboxylic acid, for example, terephthalic acid, and ethylene glycol and one or more other glycols, for example, ethylene glycol and 1,4-cyclohexanedimethanol. In certain embodiments of the present invention, PETG comprises from 80 to 100 mole % terephthalic acid, 10 to 60 mole % 1,4-cyclohexanedimethanol and 80 to 40 mole % ethylene glycol, based on the mole percentages for the acid component totaling 100 mole % and the mole percentages for the hydroxyl component totaling 100 mole %, respectively. Additional non-limiting examples include PETG comprising from 80 to 100 mole % terephthalic acid, 15 to 50 mole % 1,4-cyclohexanedimethanol and 70 to 50 mole % ethylene glycol, based on the mole percentages for the acid component totaling 100 mole % and the mole percentages for the hydroxyl component totaling 100 mole %, respectively.

In certain embodiments, the at least one thermoplastic resin comprises a polyester comprising:

(a) a carboxylic acid component comprising at least 80 mole %, at least 90 mole percent, at least 92 mole percent, at least 93 mole percent, or at least 96 mole percent of the residues of terephthalic acid or derivatives of terephthalic acid, or mixtures thereof, and (b) a hydroxyl component comprising at least 80 mole %, at least 90 mole percent, at least 92 mole percent, at least 93 mole percent, or at least 96 mole percent of the residues of ethylene glycol and 1,4-cyclohexanedimethanol, based on 100 mole percent of carboxylic acid component residues and 100 mole percent of hydroxyl component residues in the polyester polymer.

In certain embodiments, the at least one thermoplastic resin comprises a polyester comprising:

(a) a carboxylic acid component comprising at least 80 mole %, at least 90 mole percent, at least 92 mole percent, at least 93 mole percent, or at least 96 mole percent of the residues of terephthalic acid or derivatives of terephthalic acid, or mixtures thereof, and (b) a hydroxyl component comprising from 25 to 70 mole percent residues from cyclohexanedimethanol, from 30 to 75 mole percent residues from ethylene glycol, and based on 100 mole percent of carboxylic acid component residues and 100 mole percent of hydroxyl component residues in the polyester polymer.

In another aspect the present invention provides an article comprising a polyester comprising: (i) an acid component comprising: (a) at least 70 mole % acid residues from terephthalic acid, derivatives of terephthalic acid and mixtures thereof;

(b) from 0 to 30 mole % acid residues from aromatic dicarboxylic acids; and (c) from 0 to 10 mole % acid residues from aliphatic dicarboxylic acids having up to 20 carbon atoms; and (ii) a glycol component comprising: (a) from 20 to 70 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

In another aspect the present invention provides an article comprising a polyester comprising: (i) an acid component comprising: (a) at least 70 mole % acid residues from terephthalic acid, derivatives of terephthalic acid and mixtures thereof; (b) from 0 to 30 mole % acid residues from aromatic dicarboxylic acids; and (c) from 0 to 10 mole % acid residues from aliphatic dicarboxylic acids having up to 20 carbon atoms; (ii) a glycol component comprising: (a) from 20 to 81 mole % glycol residues from cyclohexanedimethanol; (b) from 0 to 80 mole % glycol residues from ethylene glycol; and (c) from 0 to 80 mole % glycol residues from glycols having up to 20 carbon atoms, wherein the acid residues are based on 100 mole % acid residues and the glycol residues are based on 100 mole % glycol residues.

Other examples of copolyesters useful in the present invention include EASTAR™ copolyester resins, CADENCE™ copolyester resins, PROVISTA™ copolyester resins, DURASTAR™ copolyester resins and EMBRACE™ copolyesters resins, all available from Eastman Chemical Company in Kingsport, Tenn., USA.

Certain polyesters useful in the invention can thus have a substantially amorphous morphology, meaning that the polyesters comprise substantially unordered regions of polymer. Because of the long crystallization half-times (e.g., greater than 5 minutes) at 170° C. exhibited by certain polyesters useful in the present invention, it is possible to produce the thermoplastic coating compositions and coated articles of the invention. Certain polyesters useful in the invention are "amorphous" which is defined herein as having a crystallization half-time of greater than 5 minutes at 170° C.

The crystallization half time of the polyester, as used herein, may be measured using methods well-known to persons of skill in the art. The crystallization half time of the polyester, $t_{1/2}$, was determined by measuring the light transmission of a sample via a laser and photo detector as a function of time on a temperature controlled hot stage. This measurement was done by exposing the polymers to a temperature, $T_{max}$, and then cooling it to the desired temperature. The sample was then held at the desired temperature by a hot stage while transmission measurements were made as a function of time. Initially, the sample was visually clear with high light transmission and became opaque as the sample crystallizes. The crystallization half-time is the time at which the light transmission was halfway between the initial transmission and the final transmission. $T_{max}$ is defined as the temperature required to melt the crystalline domains of the sample (if crystalline domains are present). The sample is heated to $T_{max}$ to condition the sample prior to crystallization half time measurement. The absolute $T_{max}$ temperature is different for each composition. For example PCT would need to be heated to some temperature greater than 290 C to melt the crystalline domains.

Polycarbonates useful in this invention comprise the divalent residue of dihydric phenols bonded through a carbonate linkage and are represented by structural formulae II and III.

Formula II

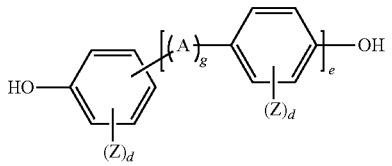

Formula III

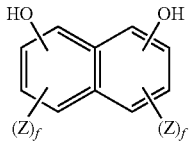

wherein: A denotes an alkylene group with 1 to 8 carbon atoms; an alkylidene group with 2 to 8 carbon atoms; a cycloalkylene group with 5 to 15 carbon atoms; a cycloalkylidene group with 5 to 15 carbon atoms; a carbonyl group; an oxygen atom; a sulfur atom; —SO— or —$SO_2$; or a radical conforming to e and g both denote the number 0 to 1; Z denotes F, Cl, Br or $C_{1-4}$.alkyl; and if several Z radicals are substituents in one aryl radical, they may be identical or different from one another; d denotes an integer of from 0 to 4; and f denotes an integer of from 0 to 3.

By the term "alkylene" is meant a bivalent saturated aliphatic radical wherein the two valences are on different carbon atoms, e.g., ethylene; 1,3-propylene; 1,2-propylene; 1,4-butylene; 1,3-butylene; 1,2-butylene, amylene, isoamylene, etc. By the term "alkylidene" is meant a bivalent radical wherein the two valences are on the same carbon atoms, e.g., ethylidene, propylidene, isopropylidine, butylidene, isobutylidene, amylidene, isoamylidene, 3,5,5,-trimethylhexylidene. Examples of "cycloalkylene" are cyclopropylene, cyclobutylene, and cyclohexylene. Examples of "cycloalkylidene" are cyclopropylidene, cyclobutylidene, and cyclohexylidene. Examples of $C_{1-4}$.alkyl are methyl, ethyl, propyl, isopropyl, butyl, and isobutyl.

The dihydric phenols employed are known, and the reactive groups are thought to be the phenolic hydroxyl groups. Typical of some of the dihydric phenols employed are bis-phenols such as 2,2-bis-(4-hydroxyphenyl)-propane (bisphenol A), 3,3,5-trimethyl-1,1-bis(4-hydroxyphenyl)-cyclohexane, 2,4-bis-(4-hydroxyphenyl)-2-methyl-butane, 1,1-bis-(4-hydroxyphenyl)-cyclohexane, alpha,alpha'-bis-(4-hydroxyphenyl)-p-diisopropylbenzene, 2,2-bis-(3-methyl-4-hydroxyphenyl)-propane, 2,2-bis-(3-chloro-4-hydroxyphenyl)propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfide, bis-(3,5-dimethyl-4-hydroxyphenyl)-sulfoxide, bis-(3,5-dimethyl-4-hydroxyphenyl)-sulfone, dihydroxy-benzophenone, 2,4-bis-(3,5-dimethyl-4-hydroxyphenyl)-cyclohexane, alpha,alpha'-bis-(3,5-dimethyl-4-hydroxyphenyl)-p-diisopropylbenzene and 4,4'-sulfonyl diphenol. Other dihydric phenols might include hydroquinone, resorcinol, bis-(hydroxyphenyl)-alkanes, bis-(hydroxyphenyl)ethers, bis-(hydroxyphenyl)-ketones, bis-(hydroxyphenyl)-sulfoxides, bis-(hydroxyphenyl)-sulfides, bis-(hydroxyphenyl)-sulfones, and alpha, alpha-bis-(hydroxyphenyl)diisopropylbenzenes, as well as their nuclear-alkylated compounds. These and further suitable dihydric phenols are described, for example, in U.S. Pat. Nos. 2,991,273; 2,999,835; 2,999,846; 3,028,365; 3,148,172; 3,153,008; 3,271,367; 4,982,014; 5,010,162 all incorporated herein by reference. The polycarbonates of the invention may entail in their structure, units derived from one or more of the suitable bisphenols. The most preferred dihydric phenol is 2,2-bis-(4-hydroxyphenyl)-propane (bisphenol A).

The carbonate precursors are typically a carbonyl halide, a diarylcarbonate, or a bishaloformate. The carbonyl halides include, for example, carbonyl bromide, carbonyl chloride, and mixtures thereof. The bishaloformates include the bishaloformates of dihydric phenols such as bischloroformates of 2,2-bis(4-hydroxyphenyl)-propane, hydroquinone, and the like, or bishaloformates of glycol, and the like. While all of the above carbonate precursors are useful, carbonyl chloride, also known as phosgene, and diphenyl carbonate are preferred.

The aromatic polycarbonates can be manufactured by any processes such as by reacting a dihydric phenol with a carbonate precursor, such as phosgene, a haloformate or carbonate ester in melt or solution. Suitable processes are disclosed in U.S. Pat. Nos. 2,991,273; 2,999,846; 3,028,365; 3,153,008; 4,123,436; all of which are incorporated herein by reference. Polycarbonates useful in the invention may be prepared according to other known procedures, for example, by reacting the dihydroxyaromatic compound with a carbonate precursor such as phosgene, a haloformate or a carbonate ester, a molecular weight regulator, an acid acceptor and a catalyst. Methods for preparing polycarbonates are known in the art and are described, for example, in U.S. Pat. No. 4,452,933, whose disclosure regarding preparation of polycarbonates is hereby incorporated by reference herein.

Examples of suitable carbonate precursors include, but are not limited to, carbonyl bromide, carbonyl chloride, or mixtures thereof; diphenyl carbonate; a di(halophenyl)carbonate, e.g., di(trichlorophenyl)carbonate, di(tribromophenyl)carbonate, and the like; di(alkylphenyl)carbonate, e.g., di(tolyl)carbonate; di(naphthyl)carbonate; di(chloronaphthyl)carbonate, or mixtures thereof; and bis-haloformates of dihydric phenols.

Examples of suitable molecular weight regulators include, but are not limited to, phenol, cyclohexanol, methanol, alkylated phenols, such as octylphenol, para-tertiary-butylphenol, and the like. In one embodiment, the molecular weight regulator is phenol or an alkylated phenol.

The acid acceptor may be either an organic or an inorganic acid acceptor. A suitable organic acid acceptor is a tertiary amine and includes such materials as pyridine, triethylamine, dimethylaniline, tributylamine, and the like. The inorganic acid acceptor can be either a hydroxide, a carbonate, a bicarbonate, or a phosphate of an alkali or alkaline earth metal.

The catalysts that can be used are those that typically aid the polymerization of the monomer with phosgene. Suitable catalysts include, but are not limited to, tertiary amines such as triethylamine, tripropylamine, N,N-dimethylaniline, quaternary ammonium compounds such as, for example, tetraethylammonium bromide, cetyl triethyl ammonium bromide, tetra-n-heptylammonium iodide, tetra-n-propyl ammonium bromide, tetramethyl ammonium chloride, tetramethyl ammonium hydroxide, tetra-n-butyl ammonium iodide, benzyltrimethyl ammonium chloride and quaternary phosphonium compounds such as, for example, n-butyltriphenyl phosphonium bromide and methyltriphenyl phosphonium bromide.

The polycarbonates useful in the polyester compositions which are useful in the invention also may be copolyestercarbonates such as those described in U.S. Pat. Nos. 3,169,121; 3,207,814; 4,194,038; 4,156,069; 4,430,484, 4,465,820, and 4,981,898, the disclosure regarding copolyestercarbonates from each of them is incorporated by reference herein.

Copolyestercarbonates useful in this invention can be available commercially or can be prepared by known methods in the art. For example, they are typically obtained by the reaction of at least one dihydroxyaromatic compound with a mixture of phosgene and at least one dicarboxylic acid chloride, especially isophthaloyl chloride, terephthaloyl chloride, or both.

Typically, polyesters and copolyesters such as polyethylene terephthalate are made by reacting a diol such as ethylene glycol with a dicarboxylic acid as the free acid or its $C_1$-$C_4$ dialkyl ester to produce an ester monomer and/or oligomers, which are then polycondensed to produce the polyester incorporating the corresponding residues. More than one compound containing carboxylic acid group(s) or derivative(s) thereof can be reacted during the process. All the compounds that enter the process containing carboxylic acid group(s) or derivative(s) thereof that become part of said polyester product comprise the "carboxylic acid component." The mole % of all the compounds containing carboxylic acid group(s) or derivative(s) thereof that are in the product add up to 100. The "residues" of compound(s) containing carboxylic acid group(s) or derivative(s) thereof that are in the said polyester product refers to the portion of said compound(s) which remains in the said polyester product after said compound(s) is condensed with a compound(s) containing hydroxyl group(s) and further polycondensed to form polyester polymer chains of varying length. The polyesters of the present invention, therefore, can contain substantially equal molar proportions of acid residues (100 mole %) and diol (and/or multifunctional hydroxyl compound) residues (100 mole %) such that the total moles of repeating units is equal to 100 mole %. The mole percentages provided in the present disclosure, therefore, may be based on the total moles of acid residues, the total moles of diol residues, or the total moles of repeating units. For example, a polyester containing 30 mole % isophthalic acid, based on the total acid residues, means the polyester contains 30 mole % isophthalic acid residues out of a total of 100 mole % acid residues. Thus, there are 30 moles of isophthalic acid residues among every 100 moles of acid residues. In another example, a polyester containing 25 mole % 2,2,4,4-tetramethyl-1,3-cyclobutanediol, based on the total diol residues, means the polyester contains 25 mole % 2,2,4,4-tetramethyl-1,3-cyclobutanediol residues out of a total of 100 mole % diol residues. Thus, there are 25 moles of 2,2,4,4-tetramethyl-1,3-cyclobutanediol residues among every 100 moles of diol residues.

More than one compound containing hydroxyl group(s) or derivatives thereof can become part of the polyester polymer product(s). All the compounds that enter the process containing hydroxyl group(s) or derivatives thereof that become part of said polyester product(s) comprise the hydroxyl component. The mole % of all the compounds containing hydroxyl group(s) or derivatives thereof that become part of said product(s) add up to 100. The "residues" of hydroxyl functional compound(s) or derivatives thereof that become part of said polyester product refers to the portion of said compound(s) which remains in said polyester product after said compound(s) is condensed with a compound(s) containing carboxylic acid group(s) or derivative(s) thereof and further polycondensed to form polyester polymer chains of varying length.

The mole % of the hydroxyl residues and carboxylic acid residues in the product(s) can be determined by proton NMR.

The polyester portion of the polyester compositions useful in the invention can be made by processes known from the literature such as, for example, by processes in homogenous solution, by transesterification processes in the melt, and by two phase interfacial processes. Suitable methods include, but are not limited to, the steps of reacting one or more dicarboxylic acids with one or more glycols at a temperature of 100° C. to 315° C. at a pressure of 0.1 to 760 mm Hg for a time sufficient to form a polyester. See U.S. Pat. No. 3,772,405 for methods of producing polyesters, the disclosure regarding such methods is hereby incorporated herein by reference.

Dicarboxylic Acids

Esters of terephthalic acid and the other modifying dicarboxylic acids or their corresponding esters and/or salts may be used instead of the dicarboxylic acids. Suitable examples of dicarboxylic acid esters include, but are not limited to, the dimethyl, diethyl, dipropyl, diisopropyl, dibutyl, and diphenyl esters. In one embodiment, the esters are chosen from at least one of the following: methyl, ethyl, propyl, isopropyl, and phenyl esters. Derivatives of terephthalic acid include $C_1$-$C_4$ dialkylterephthalates.

In certain embodiments, terephthalic acid, an ester thereof, such as, for example, dimethyl terephthalate, or a mixture of terephthalic acid and an ester thereof, makes up most or all of the dicarboxylic acid component used to form the polyesters useful in the invention. In certain embodiments, terephthalic acid residues can make up a portion or all of the dicarboxylic acid component used to form the present polyester at a concentration of at least 70 mole %, such as at least 80 mole %, at least 90 mole %, at least 95 mole %, at least 99 mole %, or a mole % of 100. In certain embodiments, higher amounts of terephthalic acid can be used in order to produce a higher impact strength polyester. For the purposes of this disclosure, the terms "terephthalic acid" and dimethyl terephthlate" are used interchangeably herein. In one embodiment, dimethyl terephthalate is part or all of the dicarboxylic acid component used to make the polyesters useful in the present invention. In all embodiments, ranges of from 70 to 100 mole %; or 80 to 100 mole %; or 90 to 100 mole %; or 99 to 100 mole %; or 100 mole % terephthalic acid and/or dimethyl terephthalate and/or mixtures thereof may be used.

In addition to a diacid component of terephthalic acid, derivatives of terephthalic acid, or mixtures thereof, the carboxylic acid component(s) of the present polyester may include one or more additional modifier carboxylic acid compounds. Such additional modifier carboxylic acid compounds include dicarboxylic acid compounds, and compounds with a higher number of carboxylic acid groups. Examples include aromatic dicarboxylic acids preferably having 8 to 14 carbon atoms, aliphatic dicarboxylic acids preferably having 4 to 12 carbon atoms, or cycloaliphatic dicarboxylic acids preferably having 8 to 12 carbon atoms. More specific examples of modifier dicarboxylic acids useful as an acid component(s) are phthalic acid, isophthalic acid, naphthalene-2,6-dicarboxylic acid, cyclohexane-1,4-dicarboxylic acid, cyclohexanediacetic acid, diphenyl-4,4'-dicarboxylic acid, succinic acid, glutaric acid, adipic acid, azelaic acid, sebacic acid, and the like, with isophthalic acid, naphthalene-2,6-dicarboxylic acid, and cyclohexanedicarboxylic acid being most preferable. It should be understood that use of the corresponding acid anhydrides, esters, and acid chlorides of these acids is included in the term "carboxylic acid". It is also possible for tricarboxyl compounds and compounds with a higher number of carboxylic acid groups to modify the polyester.

In addition to terephthalic acid residues, the dicarboxylic acid component of the polyesters useful in the certain embodiments of the invention can comprise up to 30 mole %, up to 20 mole %, up to 10 mole %, up to 5 mole %, or up to 1 mole % modifying aromatic dicarboxylic acids. Yet another embodiment contains 0 mole % modifying aromatic dicarboxylic acids. Thus, if present, it is contemplated that the amount of one or more modifying aromatic dicarboxylic acids can range from any of these preceding endpoint values including, for example, from 0.01 to 30 mole %, 0.01 to 20 mole %, from 0.01 to 10 mole %, from 0.01 to 5 mole % and from 0.01 to 1 mole. In one embodiment, modifying aromatic dicarboxylic acids that may be used in the present invention include but are not limited to those having up to 20 carbon atoms, and which can be linear, para-oriented, or symmetrical. Examples of modifying aromatic dicarboxylic acids which may be used in this invention include, but are not limited to, isophthalic acid, 4,4'-biphenyldicarboxylic acid, 1,4-, 1,5-, 2,6-, 2,7-naphthalenedicarboxylic acid, and trans-4,4'-stilbenedicarboxylic acid, and esters thereof. In one embodiment, the modifying aromatic dicarboxylic acid is isophthalic acid.

The carboxylic acid component of the polyesters useful in the invention can be further modified with up to 10 mole %, up to 5 mole % or up to 1 mole % of one or more aliphatic dicarboxylic acids containing 2-16 carbon atoms, such as, for example, malonic, succinic, glutaric, adipic, pimelic, suberic, azelaic and dodecanedioic dicarboxylic acids. Certain embodiments can also comprise 0.01 or more mole %, 0.1 or more mole %, 1 or more mole %, 5 or more mole %, or 10 or more mole % of one or more modifying aliphatic dicarboxylic acids. Yet another embodiment contains 0 mole % modifying aliphatic dicarboxylic acids. Thus, if present, it is contemplated that the amount of one or more modifying aliphatic dicarboxylic acids can range from any of these preceding endpoint values including, for example, from 0.01 to 10 mole % and from 0.1 to 10 mole %. The total mole % of the dicarboxylic acid component is 100 mole %.

In another aspect, the invention relates to thermoplastic articles comprising a polyester produced by a process comprising:

(I) heating a mixture comprising the monomers useful in any of the polyesters in the invention in the presence of a catalyst at a temperature of about to 240° C. for a time sufficient to produce an initial polyester;

(II) heating the initial polyester of step (I) at a temperature of 240 to 320° C. for about 1 to 4 hours; and (III) removing any unreacted glycols.

Suitable catalysts for use in this process include organozinc or tin compounds. The use of this type of catalyst is well known in the art. Examples of catalysts useful in the present invention include, but are not limited to, zinc acetate, butyltin tris-2-ethylhexanoate, dibutyltin diacetate, and dibutyltin oxide. Other catalysts may include those based on titanium, zinc, manganese, lithium, germanium, and cobalt. Catalyst amounts typically range from about 10 ppm to about 500 ppm based on the catalyst metal. The process can be carried out in a batch or continuous process.

Typically, step (I) is carried out until about 50% by weight or more of the glycol has been reacted. Step (I) maybe carried out under pressure, ranging from atmospheric pressure to 100 psig. The term "reaction product" as used in connection with any of the catalysts useful in the invention refers to any product of a polycondensation and/or esterification reaction with the catalyst and any of the monomers used in making the polyester as well as the product of a polycondensation or esterification reaction between the catalyst and any other type of additive.

Glycols

In addition to a hydroxyl component comprising ethylene glycol, 1,4-cyclohexanedimethanol, or mixtures thereof, the hydroxyl component of the present polyester may include additional modifier diols or compounds with a higher number of hydroxyl groups. Examples of modifier hydroxyl compounds include cycloaliphatic diols preferably having 6 to 20 carbon atoms and/or aliphatic diols preferably having 3 to 20 carbon atoms. More specific examples of such diols include, but are not limited to, diethylene glycol; triethylene glycol; 1,4-cyclohexanedimethanol; propane-1,3-diol; butane-1,4-diol; pentane-1,5-diol; hexane-1,6-diol; 3-methylpentane-2,4-diol; 2-methylpentane-1,4-diol; 2,2,4-trimethylpentane-1,3-diol; 2,5-ethylhexane-1,3-diol; 2,2-diethyl propane-diol-(1,3); hexane-1,3-diol; 1,4-di-(hydroxyethoxy)-benzene; 2,2-bis-(4-hydroxycyclohexyl)-propane; 2,2,4,4-tetramethylcyclobutane-1,3-diol; 2,2-bis-(3-hydroxyethoxyphenyl)-propane; and 2,2-bis-(4-hydroxypropoxyphenyl)-propane. The 1,4-cyclohexanedimethanol may be cis, trans, or a mixture thereof, such as a cis/trans ratio of 60:40 to 40:60. In another embodiment, the trans-1,4-cyclohexanedimethanol can be present in an amount of 60 to 80 mole %.

The glycol component of the polyester portion of the polyester composition useful in the invention can contain 25 mole % or less of one or more modifying glycols which are not ethylene glycol or 1,4-cyclohexanedimethanol; in one embodiment, the polyester useful in the invention may contain less than 15 mole % or of one or more modifying glycols. In another embodiment, the polyesters useful in the invention can contain 10 mole % or less of one or more modifying glycols. In another embodiment, the polyesters useful in the invention can contain 5 mole % or less of one or more modifying glycols. In another embodiment, the polyesters useful in the invention can contain 3 mole % or less of one or more modifying glycols. In another embodiment, the polyesters useful in the invention can contain 0 mole % modifying glycols. Thus, if present, it is contemplated that the amount of one or more modifying glycols can range from any of these preceding endpoint values including, for example, from 0.01 to 15 mole % and from 0.1 to 10 mole %.

As modifiers, the polyester polymer may contain such comonomers as isophthalic acid, naphthalene dicarboxylic acid, and diethylene glycol.

The polyesters and/or the polycarbonates useful in the coating compositions of the invention can comprise from 0 to 10 mole percent, for example, from 0.01 to 5 mole percent, from 0.01 to 1 mole percent, from 0.05 to 5 mole percent, from 0.05 to 1 mole percent, or from 0.1 to 0.7 mole percent, or 0.1 to 0.5 mole percent, based the total mole percentages of either the diol or diacid residues; respectively, of one or more residues of a branching monomer, also referred to herein as a branching agent, having 3 or more carboxyl substituents, hydroxyl substituents, or a combination thereof. In certain embodiments, the branching monomer or agent may be added prior to and/or during and/or after the polymerization of the polyester. The polyester(s) useful in the invention can thus be linear or branched. The polycarbonate can also be linear or branched. In certain embodiments, the branching monomer or agent may be added prior to and/or during and/or after the polymerization of the polycarbonate.

Examples of branching monomers include, but are not limited to, multifunctional acids or multifunctional alcohols such as trimellitic acid, trimellitic anhydride, pyromellitic dianhydride, trimethylolpropane, glycerol, pentaerythritol, citric acid, tartaric acid, 3-hydroxyglutaric acid and the like. In one embodiment, the branching monomer residues can comprise 0.1 to 0.7 mole percent of one or more residues chosen from at least one of the following: trimellitic anhydride, pyromellitic dianhydride, glycerol, sorbitol, 1,2,6-hexanetriol, pentaerythritol, trimethylolethane, and/or trimesic acid. The branching monomer may be added to the polyester reaction mixture or blended with the polyester in the form of a concentrate as described, for example, in U.S. Pat. Nos. 5,654,347 and 5,696,176, whose disclosure regarding branching monomers is incorporated herein by reference.

Inherent Viscosity

In certain embodiments of the present invention, the thermoplastic resins, particularly the polyesters, have inherent viscosity (I.V.) values in the range of 0.5 dL/g to 1.4 dL/g measured at 25° C. in 60/40 wt/wt phenol/tetrachloroethane. In other embodiments of the present invention, the thermoplastic resin has an I.V. ranging from 0.65 dL/g to 1.0 dL/g, or 0.65 dL/g to 0.85 dL/g or 0.69 dL/g to 0.82 dL/g. For other embodiments of the invention, the polyesters useful in the invention may exhibit at least one of the following inherent viscosities as determined in 60/40 (wt/wt) phenol/tetrachloroethane at a concentration of 0.5 g/100 ml at 25° C.: 0.50 to 1.2 dL/g; 0.50 to 1.1 dL/g; 0.50 to 1 dL/g; 0.50 to less than 1 dL/g; 0.50 to 0.98 dL/g; 0.50 to 0.95 dL/g; 0.50 to 0.90 dL/g; 0.50 to 0.85 dL/g; 0.50 to 0.80 dL/g; 0.50 to 0.75 dL/g; 0.50 to less than 0.75 dL/g; 0.50 to 0.72 dL/g; 0.50 to 0.70 dL/g; 0.50 to less than 0.70 dL/g; 0.50 to 0.68 dL/g; 0.50 to less than 0.68 dL/g; 0.50 to 0.65 dL/g; 0.55 to 1.2 dL/g; 0.55 to 1.1 dL/g; 0.55 to 1 dL/g; 0.55 to less than 1 dL/g; 0.55 to 0.98 dL/g; 0.55 to 0.95 dL/g; 0.55 to 0.90 dL/g; 0.55 to 0.85 dL/g; 0.55 to 0.80 dL/g; 0.55 to 0.75 dL/g; 0.55 to less than 0.75 dL/g; 0.55 to 0.72 dL/g; 0.55 to 0.70 dL/g; 0.55 to less than 0.70 dL/g; 0.55 to 0.68 dL/g; 0.55 to less than 0.68 dL/g; 0.55 to 0.65 dL/g; 0.58 to 1.2 dL/g; 0.58 to 1.1 dL/g; 0.58 to 1 dL/g; 0.58 to less than 1 dL/g; 0.58 to 0.98 dL/g; 0.58 to 0.95 dL/g; 0.58 to 0.90 dL/g; 0.58 to 0.85 dL/g; 0.58 to 0.80 dL/g; 0.58 to 0.75 dL/g; 0.58 to less than 0.75 dL/g; 0.58 to 0.72 dL/g; 0.58 to 0.70 dL/g; 0.58 to less than 0.70 dL/g; 0.58 to 0.68 dL/g; 0.58 to less than 0.68 dL/g; 0.58 to 0.65 dL/g; 0.60 to 1.2 dL/g; 0.60 to 1.1 dL/g; 0.60 to 1 dL/g; 0.60 to less than 1 dL/g; 0.60 to 0.98 dL/g; 0.60 to 0.95 dL/g; 0.60 to 0.90 dL/g; 0.60 to 0.85 dL/g; 0.60 to 0.80 dL/g; 0.60 to 0.75 dL/g; 0.60 to less than 0.75 dL/g; 0.60 to 0.72 dL/g; 0.60 to 0.70 dL/g; 0.60 to less than 0.70 dL/g; 0.60 to 0.68 dL/g; 0.60 to less than 0.68 dL/g; 0.60 to 0.65 dL/g; 0.65 to 1.2 dL/g; 0.65 to 1.1 dL/g; 0.65 to 1 dL/g; 0.65 to less than 1 dL/g; 0.65 to 0.98 dL/g; 0.65 to 0.95 dL/g; 0.65 to 0.90 dL/g; 0.65 to 0.85 dL/g; 0.65 to 0.80 dL/g; 0.65 to 0.75 dL/g; 0.65 to less than 0.75 dL/g; 0.65 to 0.72 dL/g; 0.65 to 0.70 dL/g; 0.65 to less than 0.70 dL/g; 0.68 to 1.2 dL/g; 0.68 to 1.1 dL/g; 0.68 to 1 dL/g; 0.68 to less than 1 dL/g; 0.68 to 0.98 dL/g; 0.68 to 0.95 dL/g; 0.68 to 0.90 dL/g; 0.68 to 0.85 dL/g; 0.68 to 0.80 dL/g; 0.68 to 0.75 dL/g; 0.68 to less than 0.75 dL/g; 0.68 to 0.72 dL/g; greater than 0.76 dL/g to 1.2 dL/g; greater than 0.76 dL/g to 1.1 dL/g; greater than 0.76 dL/g to 1 dL/g; greater than 0.76 dL/g to less than 1 dL/g; greater than 0.76 dL/g to 0.98 dL/g; greater than 0.76 dL/g to 0.95 dL/g; greater than 0.76 dL/g to 0.90 dL/g; greater than 0.80 dL/g to 1.2 dL/g; greater than 0.80 dL/g to 1.1 dL/g; greater than 0.80 dL/g to 1 dL/g; greater than 0.80 dL/g to less than 1 dL/g; greater than 0.80 dL/g to 1.2 dL/g; greater than 0.80 dL/g to 0.98 dL/g; greater than 0.80 dL/g to 0.95 dL/g; greater than 0.80 dL/g to 0.90 dL/g.

Solubility Parameter

In an embodiment, the at least one thermoplastic resin, particularly the polyesters, has a solubility parameter ranging from 10.4 to 11.5 $(cal/cm^3)^{0.5}$. In other embodiments of the present invention the solubility parameter ranges from about 9.4 to about 14.0 $(cal/cm^3)^{0.5}$ or from about 10.0 to about 13.6 $(cal/cm^3)^{0.5}$ or about 10.0 to about 12.5 $(cal/cm^3)^{0.5}$ or about 10.4 to about 11.2 $(cal/cm^3)^{0.5}$. Certain embodiments also exhibit excellent toughness and a relatively low processing temperature. The choice of base resins will be dictated by the use conditions such as temperature resistance, toughness, weathering, etc.

Glass Transition Temperature (Tg)

In certain embodiments, the thermoplastic resins, particularly the polyesters, have a glass transition temperature ranging from 60° C. to about 150° C. or from about 70° C. to about 130° C. or about 75° C. to about 115° C. In other embodiments, the thermoplastic resins have a glass transition temperature ranging from 70 to about 150° C. or from 80 to about 150° C. or from 90 to about 150° C. or from 100 to about 150° C. or from 110 to about 150° C. or from 120 to about 150° C. or from 130 to about 150° C. or from 140 to about 150° C. or from 70 to about 140° C. from 80 to about 140° C. or from 90 to about 140° C. or from 100 to about 140° C. or from 110 to about 140° C. or from 120 to about 140° C. or from 130 to about 140° C. or 70 to about 130° C. from 80 to about 130° C. or from 90 to about 130° C. or from 100 to about 130° C. or from 110 to about 130° C. or from 120 to about 130° C. or from 110 to about 120° C. or 70 to about 120° C. from 80 to about 120° C. or from 90 to about 120° C. or from 100 to about 120° C. or 70 to about 110° C. from 80 to about 110° C. or from 90 to about 110° C. or from 100 to about 110° C. or 70 to about 100° C. from 80 to about 100° C. or from 90 to about 100° C. or 70 to about 90° C. from 80 to about 90° C. In other embodiments, the polyester resin has a Tg ranging from 60 to 150° C. or 70 to 130° C. or 75 to 115° C. It is contemplated that compositions useful in the thermoplastic articles of the invention can possess at least one of the inherent viscosity ranges described herein and at least one of the monomer ranges for the compositions described herein unless otherwise stated. It is also contemplated that compositions useful in the thermoplastic articles of the invention can posses at least one of the Tg ranges described herein and at least one of the monomer ranges for the compositions described herein unless otherwise stated. It is also contemplated that compositions useful in the thermoplastic articles of the invention can posses at least one of the solubility ranges described herein and at least one of the monomer ranges for the compositions described herein unless otherwise stated. It is also contemplated that compositions useful in the thermoplastic articles of the invention can posses at least one of the inherent viscosity ranges described herein, at least one of the Tg ranges described herein, at least one of the solubility parameter ranges, and at least one of the monomer ranges for the compositions described herein unless otherwise stated.

Weight Percent Thermoplastic Resin

The coating compositions may comprise 30% by weight to 99% by weight, with respect to the total weight of the composition, of at least one thermoplastic resin. In certain embodiments, the coating compositions may comprise 30% by weight to 95% by weight, with respect to the total weight of the composition, of at least one thermoplastic resin. In certain embodiments, the coating compositions may comprise 30% by weight to 90% by weight, with respect to the total weight of the composition, of at least one thermoplastic resin. In certain embodiments, the coating compositions may comprise 30% by weight to 80% by weight, with respect to the total weight of the composition, of at least one thermoplastic resin. In certain embodiments, the coating compositions may comprise 30% by weight to 70% by weight, with respect to the total weight of the composition, of at least one thermoplastic resin. In certain embodiments, the coating compositions may comprise 30% by weight to 60% by weight, with respect to the total weight of the composition, of at least one thermoplastic resin. In certain embodiments, the coating compositions may comprise 30% by weight to 50% by weight, with respect to the total weight of the composition, of at least one thermoplastic resin.

In certain embodiments, the coating compositions may comprise 40% by weight to 95% by weight, with respect to the total weight of the composition, of at least one thermoplastic resin. In certain embodiments, the coating compositions may comprise 40% by weight to 90% by weight, with respect to the total weight of the composition, of at least one thermoplastic resin. In certain embodiments, the coating compositions may comprise 40% by weight to 80% by weight, with respect to the total weight of the composition, of at least one thermoplastic resin. In certain embodiments, the coating compositions may comprise 40% by weight to 70% by weight, with respect to the total weight of the composition, of at least one thermoplastic resin. In certain embodiments, the coating compositions may comprise 50% by weight to 95% by weight, with respect to the total weight of the composition, of at least one thermoplastic resin. In certain embodiments, the coating compositions may comprise 50% by weight to 90% by weight, with respect to the total weight of the composition, of at least one thermoplastic resin. In certain embodiments, the coating compositions may comprise 50% by weight to 80% by weight, with respect to the total weight of the composition, of at least one thermoplastic resin. In certain embodiments, the coating compositions may comprise 50% by weight to 70% by weight, with respect to the total weight of the composition, of at least one thermoplastic resin. In certain embodiments, the coating compositions may comprise 60% by weight to 80% by weight, with respect to the total weight of the composition, of at least one thermoplastic resin. In certain embodiments, the coating compositions may comprise 60% by weight to 70% by weight, with respect to the total weight of the composition, of at least one thermoplastic resin.

Opacity Modifier

The at least one opacity modifier may be chosen from organic dyes and inorganic dyes. Such opacity modifiers may impart at least one of opacity and color to the coating formulations. Non-limiting examples of suitable opacity modifiers include metal oxides and metal salts, such as, for example, zinc oxide (ZnO), mica, white lead, barium sulfate ($BaSO_4$), zinc sulfide (ZnS), antimony oxide and titanium dioxide ($TiO_2$). The compositions according to the present disclosure may comprise 1% by weight to 15% by weight, with respect to the total weight of the composition, of at least one opacity modifier. In an embodiment, the coating compositions comprise 2% by weight to 12% by weight, with respect to the total weight of the composition, of at least one opacity modifier. In an embodiment, the coating compositions comprise 3% by weight to 10% by weight, with respect to the total weight of the composition, of at least one opacity modifier. In an embodiment, the coating compositions comprise 4% by weight to 7% by weight, with respect to the total weight of the composition, of at least one opacity modifier. In an embodiment, the coating compositions comprise 5% by weight to 7% by weight, with respect to the total weight of the composition, of at least one opacity modifier. In an embodiment, the coating compositions comprise 5% by weight to 6% by weight, with respect to the total weight of the composition, of at least one opacity modifier.

Gloss Modifier

The at least one optional gloss modifier may be chosen from inorganic fillers and polymeric fillers. Non-limiting examples of suitable inorganic fillers include talc (magnesium silicate), silica, kaolin clay, alumina and calcium carbonate ($CaCO_3$). Examples of polymeric fillers include, but are not limited to, BLENDEX BMAT (a cross-linked styrene acrylonitrile in a polystyrene matrix) available from Chemtura, Galata Chemicals, ECDEL elastomers available from Eastman Chemical Company and PARALOID KM-377 (an acrylate polymer) available from Rohm and Haas and The Dow Chemical Company. The at least one optional gloss modifier may impart little or no graying or yellowing to the formulation. The median particle size of the at least one optional gloss modifier may range from less than 1 micron to 50 microns, such as, for example, 3 microns to 20 microns. In certain embodiments, the at least one optional gloss modifier has a median particle size ranging from 5 microns to 50 microns. In certain embodiments, the at least one optional gloss modifier has a median particle size ranging from 1 microns to 50 microns, such as from 1 microns to 40 microns, from 1 microns to 30 microns, or from 1 microns to 20 microns. Incertain embodiments, the at least one optional gloss modifier has a median particle size ranging from 3 microns to 50 microns, such as from 3 microns to 40 microns, 3 microns to 30 microns, or 3 microns to 20 microns. In certain embodiments, the at least one optional gloss modifier has a median particle size ranging from 5 microns to 50 microns, such as from 5 microns to 40 microns, from 5 microns to 30 microns, or from 5 microns to 20 microns. In certain embodiments, the at least one optional gloss modifier has a median particle size ranging from 10 microns to 50 microns, such as from 10 microns to 40 microns, from 10 microns to 30 microns or from 10 microns to 20 microns.

Shape and Weight Percent of Gloss Modifier

The particles of the at least one optional gloss modifier may vary in shape, such as, for example, needles, globular, discs, or cubic shapes. The coating compositions may comprise 0% by weight to 70% by weight, with respect to the total weight of the composition, of at least one optional gloss modifier. In certain embodiments, the coating compositions comprise 0% by weight to 50% by weight, with respect to the total weight of the composition, of at least one gloss modifier. In certain embodiments, the coating compositions comprise 5% by weight to 40% by weight, with respect to the total weight of the composition, of at least one gloss modifier. In certain embodiments, the coating compositions comprise 10% by weight to 40% by weight, with respect to the total weight of the composition, of at least one gloss modifier. In another embodiment, the coating compositions comprise 15% by weight to 40% by weight, with respect to the total weight of the composition, of at least one gloss modifier. In another embodiment, the coating compositions comprise 20% by weight to 40% by weight, with respect to the total weight of the composition, of at least one gloss modifier. In another embodiment, the coating compositions comprise 25% by weight to 40% by weight, with respect to the total weight of the composition, of at least one gloss modifier. In another embodiment, the coating compositions comprise 30% by weight to 40% by weight, with respect to the total weight of the composition, of at least one gloss modifier.

In another embodiment, the coating compositions comprise 5% by weight to 35% by weight, with respect to the total weight of the composition, of at least one gloss modifier. In another embodiment, the coating compositions comprise 5% by weight to 30% by weight, with respect to the total weight of the composition, of at least one gloss modifier. In another embodiment, the coating compositions comprise 5% by weight to 25% by weight, with respect to the total weight of the composition, of at least one gloss modifier. In another embodiment, the coating compositions comprise 5% by weight to 20% by weight, with respect to the total weight of the composition, of at least one gloss modifier. In another embodiment, the coating compositions comprise 5% by weight to 15% by weight, with respect to the total weight of the composition, of at least one gloss modifier. In another embodiment, the coating compositions comprise 5% by weight to 10% by weight, with respect to the total weight of the composition, of at least one gloss modifier.

In an embodiment, the at least one gloss modifier is calcium carbonate. Calcium carbonate may also be able to improve the polar nature of the resulting surface of the composition, as evidenced by improved adhesion of water-based latex paints. The concentration and particle size of the calcium carbonate may be manipulated to produce a desired gloss level, but distinct effects on macroscale surface roughness and overall polymer system toughness are also observed. Increasing the concentration of calcium carbonate may also embrittle polymeric materials. While no visual effects were noted with increasing levels of calcium carbonate, it is expected that extremely high loadings would result in clumping of the finely ground particles resulting in larger apparent particle sizes.

Impact Modifier

The at least one optional impact modifier may be chosen from polymers comprising i) at least one rubbery segment in an amount of 20% by weight to 99% by weight, with respect to the total weight of the polymer, and ii) at least one segment having a higher polarity than said at least one rubbery segment. A combination of impact modifiers may be used to achieve at least one of a desired toughness and a desired solubility parameter. In addition, the at least one optional impact modifier may or may not react with the thermoplastic resin. "Rubbery segment" means a polymeric segment that is amorphous and has a $T_g$<0° C. and in the presence of crosslinking would undergo very large elongations (>500%) with minimal hysteresis. Rubbery segments include polyolefins in which ethylene and/or isobutylene are the olefinic-based rubbery segment (for example, LOTADER 8900 from Arkema, EMAC from Chevron Chemical) or rubbery segments based on isoprene or butadiene (for example, BLENDEX 362 from Chemtura and KANE ACE B564 from Kaneka), polyethers in which polyethylene oxide and polypropylene oxide are the ether-based rubbery segment (for example, ELASTOLLAN 1154D from BASF or TEXIN DP7-1198 from Bayer), polyethyelene propylene diene in which dicyclopentadiene, ethylidene norbornene and vinyl norbornene are the diene-based portion of the polyethyelene propylene diene (for example, ROYALTUF 970E from Chemtura and Nordel NORDEL from Dow Chemical) and polyacrylates in which n-butyl acrylate and octyl acrylate are the acrylic-based rubbery segment (for example, KANE ACE FM grades from Kaneka and ROYALTUF 960A from Chemtura).

Non-limiting examples of the at least one impact modifier include polymers based on a polyolefin rubbery segment, sometimes also referred to as a rubbery phase, polymers based on a polyether rubbery phase, polymers based on an acrylic rubbery phase and polymers based on a butadiene and/or isoprene rubbery phase. In an embodiment, the at least one impact modifier is chosen from poly(acrylonitrile butadiene styrene) (ABS) polymers. In an embodiment, the at least one impact modifier is chosen from polyethylene copolymers comprising some level of more polar functionality, i.e., some portions of the copolymer have more polarity that polyethylene.

In certain embodiments according to the present invention, the coating compositions comprise 0% by weight to 30% by weight, relative to the weight of the total composition, of at least one impact modifier. In certain embodiments, the coating composition comprises 5% by weight to 30% by weight, relative to the weight of the total composition, of at least one impact modifier. In certain embodiments, the coating composition comprises 5% by weight to 25% by weight, relative to the weight of the total composition, of at least one impact modifier. In certain embodiments, the coating composition comprises 5% by weight to 20% by weight, relative to the weight of the total composition, of at least one impact modifier. In another embodiment, the coating composition comprises 5% by weight to 15% by weight, relative to the weight of the total composition, of at least one impact modifier. In certain embodiments, the coating composition comprises 7% by weight to 15% by weight, relative to the weight of the total composition, of at least one impact modifier. In certain embodiments, the coating composition comprises 5% by weight to 10% by weight, relative to the weight of the total composition, of at least one impact modifier.

In certain embodiments, the coating composition comprises 5% by weight to 30% by weight, relative to the weight of the total composition, of at least one impact modifier. In certain embodiments, the coating composition comprises 10% by weight to 30% by weight, relative to the weight of the total composition, of at least one impact modifier. In certain embodiments, the coating composition comprises 15% by weight to 30% by weight, relative to the weight of the total composition, of at least one impact modifier.

In certain embodiments, the coating compositions comprising 0 to 15% opacity modifier, 0 to 50% impact modifier, and 0 to 40% gloss modifier, wherein at least one of the opacity modifier, impact modifier and gloss modifier is not 0% and the weight percents are based on the total weight of the coating composition. In certain embodiments, the coating compositions comprising 1 to 13% opacity modifier, 1 to 43% impact modifier, and 1 to 39% gloss modifier, wherein the weight percents are based on the total weight of the coating composition. In certain embodiments, the coating compositions comprising 2 to 11% opacity modifier, 2 to 36% impact modifier, and 2 to 38% gloss modifier, wherein the weight percents are based on the total weight of the coating composition. In certain embodiments, the coating compositions comprising 3 to 9% opacity modifier, 3 to 30% impact modifier, and 3 to 37% gloss modifier, wherein the weight percents are based on the total weight of the coating composition.

Additional Additives

In addition, it is possible that a variety of other application-specific additives could be used. Such additional additives may include, but are not limited to, flame retardants, UV absorbers, antioxidants, colorants, and optical brighteners. Generally, for polymeric formulations that are to be used as primers, an opaque white coloring is desired. Titanium dioxide a widely used white pigment, but a variety of other metal oxides and salts may be used.

Applications for the coating formulations are only limited by the ability to melt process the composition into the desired form or article. The choice of base resins will be dictated by the use conditions such as temperature resistance, toughness, weathering, etc. The present composition was developed for use as a paint primer replacement in the moulding and trim market and may be used with extrusion technology such as that disclosed in U.S. Pat. Nos. 6,660,086 and 7,374,795. It is envisioned that the coating formulations could be used for coating any linear profile material currently being painted, wrapped, or Gessoed. Such applications that one might anticipate are simple extensions of the technology to door jambs, window jambs, other door/window parts, flat panel shelving, pull-trusion article, exterior moulding and trim, exterior or interior siding. The substrate material could potentially be MDF, particle board, oriented strand board, fiberglass, natural woods, other composite wood products, and synthetic substrates. The substrate material is only limited by the ability of the formulation to adhere during the coating process. It is natural to assume that these articles could find use in both interior and exterior applications and small additions to the composition would compensate for exterior weathering concerns.

One might also anticipate the ability to add a colored pigment to the formulation and produce finished articles with a desired color or design that may be repainted at a later date if so desired. Paintable opaque sheet or film may also be conceivable for the sign industry. Injection molded articles will have less use for painting but the possibility is still there for use.

The coating formulations of this invention can be produced using conventional compounding techniques familiar to those skilled in the art. The formulations can be produced using both continuous and batch-wise processes. The compounding apparatus is usually a twin screw extruder type system with multiple feed ports for the different additives. While the twin screw system may be the most likely equipment used, it is conceivable that a single screw extrusion system with a specifically designed mixing screw, a planetary mixer, or a banbury mixer could be used to produce the formulations of the invention. In addition to compounding the complete formulation, it is conceivable to produce single component concentrates using similar compounding techniques and perform pellet-pellet blending of the concentrates to produce the final formulation. These pellet-pellet blends would be fully compounded during the extrusion process.

The formulations can be produced through melt blending of the specified components in a thermoplastic matrix through high shear dispersion and mixing such as provided through twin screw compounding, single screw compounding, planetary mixing or a continuous mixer operation. The additives, at least one thermoplastic, at least one opacity modifier, optionally at least one gloss modifier, and optionally at least one impact modifier are fed at appropriate ratios into the mixing equipment. In the twin and single screw systems, the formulated polymer strands are passed through a water bath to quench the formulated polymer melt. These quenched strands were run through a pelletizer and cut into polymer pellets of a controlled size. Other methods are known for quenching pellet strands such as chilled belts, chilled air, etc. Another method of producing said compounded additives is by first extruding into a film or sheet thru an extrusion process and grinding said film or sheet to the desired particle size. These methods are known to those skilled in the art.

Article Description

One embodiment according to the present invention comprises an article comprising a substrate at least partially covered with a thermoplastic resin coating, the thermoplastic resin coating wherein the resin has a solubility parameter ranging from about 9.4 to about 14.0 $(cal/cm^3)^{0.5}$; and paint covering at least a portion of the resin coating, wherein the coating is an extruded coating, wherein the thermoplastic resin has a Tg greater than about 60° C. and less than about 150° C.; and wherein the paint has a performance score of from 6 to 10. In certain embodiments of the present invention, the thermoplastic resin is selected from the group consisting of polyesters, polycarbonates, polymethyl methacrylate (PMMA), poly(acrylonitrile-styrene-acrylate) (ASA), poly(acrylonitrile-butadiene-styrene) (ABS), poly (styrene-acrylonitrile) (SAN), cellulose ester and mixtures thereof. In certain embodiments, the substrate comprise MDF, particle board, oriented strand board, fiberglass, natural woods, composite wood products, and synthetic substrates. Alternatively, the Tg of the resin ranges from about 70° C. to about 150° C., or about 70° C. to about 130° C., or about 75° C. to about 115° C. Alternatively, the solubility parameter for a polycarbonate resin of about $10.8(cal/cm^3)^{0.5}$. Alternatively, the solubility parameter for a SAN resin, with 32% acrylonitrile, of about $9.7(cal/cm^3)^{0.5}$. Alternatively, the solubility parameter for a PMMA resin of about $9.45(cal/cm^3)^{0.5}$.

One embodiment of the present invention comprises a resin coating comprising from about 40 wt % to about 100 wt %, based on the total weight of the composition, of a thermoplastic resin, of a thermoplastic resin selected from the group consisting of copolyesters, polycarbonates, polymethyl methacrylate (PMMA), poly(acrylonitrile-styrene-acrylate) (ASA), poly(acrylonitrile-butadiene-styrene) (ABS), poly(styrene-acrylonitrile) (SAN) and mixtures thereof, from about 0 wt % to about 15 wt %, based on the total weight of the composition, of an opacity modifier, from about 0 wt % to about 50 wt %, based on the total weight of the composition, of an impact modifier, from about 0 wt % to about 40 wt %, based on the total weight of the composition, of a gloss modifier, wherein at least one of the opacity modifier, impact modifier or gloss modifier is greater than 0 wt %, wherein the coating is an extruded coating; wherein the thermoplastic resin has a solubility parameter ranging from about 9.4 to about 14.0 $(cal/cm^3)^{0.5}$; and wherein the thermoplastic resin has a Tg greater than about 70° C. and less than about 150° C.

In one embodiment, the resin comprises a polyester having a solubility parameter ranging from about 10.4 to about 11.5 $(cal/cm^3)^{0.5}$.

Extrusion

The extrusion process may be a cross-head die process, for example, as disclosed in U.S. Pat. No. 6,660,086 B1, which is incorporated by reference.

According to the present invention, a coating extrusion method is disclosed that applies a polymer coating to a substrate in a uniform and controlled manner. The coating extrusion apparatus comprises a feeding stage, an optional pre-treatment stage, at least one coating extrusion stage and a finishing stage. The coating stage(s) comprise a polymer feeder and a polymer coating extrusion device. The polymer coating extrusion device includes an aperture or die conforming to the perimeter of a substrate to be completely or partially coated with the extruded polymer. As the substrate passes through the aperture or die, polymer coating material is applied in a uniform and consistent layer typically ranging from 0.001 inch to 0.250 inch. In some embodiments, the polymer coating material also fills minor surface imperfections and blemishes on the substrate to achieve a consistent finish across the whole area where polymer coating material is applied.

Blasting Process

Certain embodiments of this invention disclose blasting media processes (also referred to as "sandblasting" or "blasting process") for altering the physical surface topography of a substrate to enable a change in the surface properties. Certain embodiments of the methods improve the adhesion of paints to a polymeric substrate. Typically, extruded and injection molded polymeric articles exhibit a very smooth non-textured surface. The lack of surface topography decreases the apparent adhesion of paints even when the solubility parameters of the substrate and paint are sufficiently matched. Applicants believe, but are not limited by this hypothesis, that the blasting process increases the surface area and consequently the interaction area as well as creating surface features capable of mechanically interlocking with the paint coating. In other embodiments of the present invention, the blasting processes can be used to modify the resulting gloss level of a substrate, including a polymeric substrate or polymeric coating on a substrate, without the use of formulation gloss modifiers. The size, shape, material nature and process parameters associated with the blasting process can be used to adjust the level of gloss and surface modification. Matte finishing is often used to impart scratch resistance to extruded sheet and these blasting processes enable the ability to produce a matte finish on a non-flat linear article and thereby impart scratch resistance. Any property affected by the topography of the substrate surface can potentially be controlled with this technique. The process can be run as a batch process or an in-line continuous process.

Certain embodiments of the present invention used with polymer extrusion technology and polymer formulation technology enable the production of a primed substrate, for example a MDF trim profile, that has the smooth finish of a Gesso coating with increased coating toughness with almost identical paint adhesion performance. Previously, polymer coating formulation technology used with polymer extrusion technology allowed production of smooth, tough coating but the paint scratch adhesion to this substrate was not as robust to a variety of paints as the competitive offerings. The addition of a post extrusion technique to abrade the polymer surface improves the adhesion of paint to the substrate.

Applicants disclose the use of blasting systems with carefully chosen blast media to impart a specifically designed surface topography on a polymeric or composite substrate surface. Blasting media can primarily be separated into two categories by shape; spherical or irregular/granular. It was found that the spherical shaped particles merely dimpled the surface of the polymeric substrate whereas the granularly shaped particles caused tearing or roughening of the polymer surface creating topographic features that are believed to create more surface interaction and mechanical interlocking Those topographic feature sizes are affected by altering the blasting media particle size as well as changing the "hardness" of either the polymeric substrate or the blasting media. The velocity and angle of incidence of the blasting media on the polymer also influence the size of the topographic features that result on the polymer substrate. In certain embodiments of the present invention, the more irregular granular particles reduced gloss and created higher level of opacities in clear coatings than the spherical blasting media. In some embodiments of the present invention, the spherical particles allowed a reduction of the gloss without severely changing/reducing the transparency. One embodiment of the present invention describes an air driven blasting media process that can be adjusted to provide the desired surface topography needed for specific applications.

Although any conventional air driven blasting system can be used to deliver the blasting media used in the processes of the present invention, the choice of blasting media and the methods of running the blasting equipment affect the results. Media blasting treatment may be carried out by known methods. For example, the blasting process disclosed in U.S. Pat. No. 6,461,792, which is incorporated by reference, may be used. Media blasting is a process for roughening a surface, for example, of a polymer, by spraying a fine-grained abrasive on the surface of the polymer at high speed. For example, alumina oxide particles can be strongly sprayed together with compressed air, optionally followed by washing with water and drying. The control of the surface roughness of the polymer by the blasting treatment can be carried out by adjusting the particle size and treating amount (treating frequency per area) of the particles to be sprayed. A larger particle size and treating amount of the particles results in a higher surface roughness of the polymer surface.

In certain embodiments according to the present invention, the media blasting treatment is surface treatment conducted by spraying the abrasive on the film surface with compressed air, and the irregularities formed thereby are adjusted by the conditions of the media blasting treatment.

The abrasive media is blown off through a media blasting blow-off nozzle to spray onto the polymer. The treating conditions are adjusted to control the blow-off amount (blast amount) of the abrasive media, and the angle and spacing between the media blasting blow-off nozzle and the polymer (blast angle and blast distance). The abrasive media in a hopper is blown off through the media blasting blow-off nozzle by compressed air sent out of an air chamber to spray it on the polymer surface, thereby conducting the media blasting treatment under conditions made proper for each polymer. Examples of these methods are described, for example, in JP-A-8-34866, JP-A-11-90827 and JP-A-11-254590.

Factors Affecting Surface Topography

The shape, size, mechanical properties such as hardness, incidence angle and velocity of the particles in the blasting media affect the resulting surface topography.

Shape

One factor affecting the topography that results from air blasting is the shape of the blasting media particle. A uniformly shaped spherical particle will simply form a deformation or dimple in the surface by directly transferring its shape to the location that it contacts on the substrate. The size of these dimples can be altered by changing the particle size and to a lesser extent by changing the velocity of the particle.

On the other hand, particles with non-uniform shape which can be described as irregular or granular will have a different effect on the surface. The terms non-uniform shape, irregular and granular are used interchangeably. Rather than dimpling the surface, these non-uniform particles that have edges are believed to rip and tear the surface on a microscopic level. Changing the size of either the spherical particles or the granular particles will affect the size of the surface topographic features including the spacing between the features and the depth of the features. Optical and SEM micrograph images (FIGS. 1*a-f* and 2*a-g*) show a distinct change in the size of the features with the changing particle size (diameter for spherical particles and grit or mesh size for irregular particles). Also, while these changes are primarily occurring in the microscale regime, there is some effect on the observable surface roughness with the extremes of large and small particles leading to differences in the smoothness of the surface that are detectable by touch and by roughness measurements. Increasing the velocity of the particle striking the surface may serve to increase the depth of the features while typically not changing the distance between the features. Overall, the feature depth is dependent on the momentum of the particle which is a direct function of the mass (weight) and velocity of the particle.

Incident Angle

The incident angle also affects the overall surface results. Using a 90° incident angle (perpendicular to the substrate surface), may result in some dilution of the force (smaller dimple size) and particle density (less number of hits) of the blast stream as the particles that have hit the surface will reflect straight back up and interfere with the other particles coming down to the polymer substrate.

Hardness of Blasting Media

Another property of the blasting media particles that affect the surface topography of the substrate surface is the mechanical properties of the blasting media particle. Softer particles derived from materials like walnut shells and corn cob can be used as a blasting media but will not be as aggressive in terms of depth and efficiency, defined as increased surface roughness per amount of media used, on the surface compared to a similar sized harder particle, such as aluminum oxide. For some softer media, the particles were altered by the impact as well as the substrate surface being treated.

Coating Adhesion

The usefulness of the blasting methods of the present invention pertains to any property of the substrate that is governed by the nature of the surface topography. In particular the ability to modify the surface using this methods of the present invention have shown significant effects on the resulting adhesion of paint coatings. While the formulation also affects overall paint adhesion, it was found that the surface roughness is also a factor in the resultant paint adhesion, particularly for the paint scratch adhesion.

Paint Adhesion

In certain applications paint adhesion to a polymeric coating or substrate is the primary concern. Certain embodiments of the invention comprise processes comprising: blasting a polymer or composite substrate surface with a blasting media particle for a period of time sufficient to produce a surface roughness ($R_a$) ranging from about 50 to about 370 micro inches, wherein the blasting media particles have a size ranging from about 1 micron to about 700 microns. In some embodiments, the incidence angle of the blasting media particles ranges from 20 to about 90° or from 20 to 85°. In certain embodiments the particles have an irregular shape. Examples of blasting media particle materials include, but are not limited to, aluminum oxide, crushed glass, silicon carbide, steel grit, walnut shells, sand, jet mag, calcium carbonate or any other conventional abrasive material. In certain embodiment, the blasting media particle size ranges from about 50 to about 100 microns. In certain embodiments the gloss ranges from about 1-40 or 3 to 15.

In certain embodiments of the present invention, the paint on the coating has a tape line test score of at least 3 or at least 4 or at least 5. In certain embodiments of the present invention, the paint on the coating has a cross hatch value of at least 3 or at least 4 or at least 5. In certain embodiments, the paint on the coating has a combined cross hatch value and tape line test score ranging from 3 to 10, or 3 to 9, or 3 to 8, or 3 to 7, or 3 to 6, or 4 to 10, or 4 to 9, or 4 to 8, or 4 to 7, or 4 to 6, or 5 to 10, or 5 to 9, or 5 to 8, or 5 to 7, or 5 to 6, or 6 to 10, or 6 to 9, or 6 to 8, or 7 to 10, or 7 to 9, or 7 to 8, or 8 to 10, or 8 to 9, or 9 to 10. In certain embodiments, the scratch adhesion value for a blast media treated polymer surface is at least about 50% or at least about 100% greater than the scratch adhesion value for the untreated polymer surface. In some embodiments, the paint on the coating has a tape line test score of at least 3 or at least 4 or at least 5 and the scratch adhesion value for a blast media treated polymer surface is at least about 50% or at least about 100% greater than the scratch adhesion value for the untreated polymer surface. In some embodiments, the paint on the coating has a cross hatch value of at least 3 or at least 4 or at least 5 and the scratch adhesion value for a blast media treated polymer surface is at least about 50% or at least about 100% greater than the scratch adhesion value for the untreated polymer surface. In certain embodiments, the paint on the coating has a combined cross hatch value and tape peel value ranging from 3 to 10, or 3 to 9, or 3 to 8, or 3 to 7, or 3 to 6, or 4 to 10, or 4 to 9, or 4 to 8, or 4 to 7, or 4 to 6, or 5 to 10, or 5 to 9, or 5 to 8, or 5 to 7, or 5 to 6, or 6 to 10, or 6 to 9, or 6 to 8, or 7 to 10, or 7 to 9, or 7 to 8, or 8 to 10, or 8 to 9, or 9 to 10 and the scratch adhesion value for a blast media treated polymer surface is at least about 50% or at least about 100% greater than the scratch adhesion value for the untreated polymer surface. In certain embodiments, the scratch adhesion test, expressed in force units of Newtons, on a blast media treated polymer surface is at least 10 or 11 or 12 or 13 Newtons.

Gloss

In certain embodiments of the present invention, the surface topography exhibits a significant influence on the surface gloss of the substrate. The desired gloss level can be controlled on a coating by using different blasting process factors, for example, particle shape, size, velocity, and media material. The processes of the present invention apply to a variety of application areas including applications associated with an injection molding operation, a sheet/film extrusion operation, or any other operation that generates a polymeric surface coating.

Certain embodiments of the present invention comprise processes comprising:blasting a polymer or composite substrate surface with a blasting media particle that has a regular shape (substantially or completely without sharp corners and edges) for a period of time sufficient to produce a surface roughness ranging from about 50 to about 70 micro inches, wherein the blasting media particles have a size ranging from about 1 micron to about 700 microns and wherein the incidence angle of the blasting media particles ranges from 20 to about 90. Examples of blasting media particle materials include, but are not limited to glass beads, ceramic shot, steel shot, plastic shot or other manufactured bead. In certain embodiment, the blasting media particle size ranges from about 50 to about 100 microns. In certain embodiments the gloss ranges from about 1 to 80 gloss units.

EXAMPLES

Tests for Paintability

Cross-Hatch Test

For the cross-hatch adhesion test (and, as discussed below, the scratch paint adhesion test), flattened polymer films or flat polymer-coated MDF substrates were coated with the paints to be tested. The paints were drawn down on the substrates using a Byrd applicator type device to generate a consistent film thickness over the entire test area and from one sample to the next. The film thickness varied from 3 to 10 millimeters wet for the different sets of specimens but was consistent within each set.

ASTM D3359-02 "Standard Test Methods for Measuring Adhesion by Tape Test," which is better known as the "cross-hatch adhesion test," is the industry standard test for paint adhesion. In this test, a series of scratches were made with a razor blade in a cross-hatched pattern using a steel template. The template had ten parallel slits (2 mm apart) that guided the razor blade. After one set of ten cuts, the template was rotated 90° and ten more cuts were made perpendicular to the first set of cuts. The blade passed completely through the paint. After the pattern was cut, a prescribed tape (Permacil 99) was used to cover the cross-hatch pattern and was pressed against the coating until no air bubbles remained. The tape was peeled off the pattern within 90 seconds of application at as close to a 180° peel angle as possible. The tape was removed at a rapid rate in a controlled continuous motion. The area was then inspected for removal of the paint coating and scored based on the amount of paint that was removed.

| | Classification | % Area Paint Removed |
|---|---|---|
| 1 | 5B | 0% |
| 2 | 4B | <5% |
| 3 | 3B | 5-15% |
| 4 | 2B | 15-35% |
| 5 | 1B | 35-65% |
| 6 | 0B | >65% |

Scratch Test—Minimum Scratch Force with No Peeling

In addition to the cross-hatch adhesion test, a scratch test was used to measure the paint adhesion in a shear delamination testing mode. The test samples were prepared in an identical manner as the samples for the cross hatch adhesion test. Each sample was placed on a testing table and secured to the table. A TABER® 710 Multi-Finger Scratch/Mar Tester with a 1 mm tip and a range of finger forces (2N-20N) that are available at discreet values not continuous over the 2-20N range was used. The fingers were lowered down onto the testing sample with calibrated force blocks. The fingers were then pneumatically driven across the sample over a 10 inch test length. The samples were assessed based on the critical force that was required to cause delamination of the paint coating. Based on experimentation, it was found that the particular paint used in the testing can significantly affect the resulting critical force. Consequently, a comparative rating system was used in some cases to evaluate the performance of specimen and the values were normalized to a numerical scale (Scratch Score) to compare performance across different paints. The Scratch Adhesion Test performed during the evaluation of the different potential formulations was not standardized, for polymer coatings not treated to a media blasting process, with times varying from 18-48 h for testing after application and paint films thicknesses of 3 and 6 mils were used. As a consequence the results of the scratch adhesion test are only roughly qualitative. The scratch adhesion test results for the media treated polymer coatings are were standardized to 18 h and the paint film thickness was standardized to 3 mil and are quantitatively reliable.

Tape Line Test

The final test used to evaluate the paintability of the coatings was a tape line test. This test was designed to mimic the use of the coating in a moulding and trim application where the wall is "masked" with tape and the trim is painted. A panel (film only or film-covered wood substrate) was cut to 12-16 inches long and a piece of tape (masking tape or blue painter's tape) was placed all the way across the panel perpendicular to the length of the panel every 1-2 inches. Five pieces of tape were placed on each panel, one for each of 5 different test interval times (3, 6, 24, 30 and 48 h). The tape was smoothed firmly onto the panel and was painted with a thick coat of paint using a standard paint brush. The thickness of the paint was approximately that of two coats of paint in a typical moulding and trim application. The same two analysts were used for all the tape line testing to minimize variance. The tape was then removed at the prescribed interval time using a nearly 180° peel angle and a constant peel rate. The paint lines that remained were evaluated for delaminating edges. The delaminations were graded as small (<1 cm) or large (>1 cm). The performance was designated NP for no peeling/delamination, SP for small peeling/delamination, and LP for large peeling/delamination. The tape line test scores, referred to as tape scores for each film, were calculated by starting at five and subtracting 1 point for each large delamination and 0.5 for each small delamination. If large delaminations were observed at all the time intervals then the film was scored a zero and, if no delaminations were observed at any time intervals, then the film was scored a five. Intermediate performance led to a score between five and zero.

It should be noted that scratch values obtained from the tests above may not be representative of the actual forces experienced during use in moulding and trim applications and, thus, failure in one or all of the above tests does not guarantee failure in the application. The values merely provide a method for comparative examination of potential formulations.

Test for Adhesion of Coating to Substrate

The adhesion of the coating composition to substrate material was measured using a 90° peel test on an Adhesion/Release Tester AR-1000 manufactured by ChemInstruments in Fairfield, Ohio with a 10 lb load cell. The test specimens were prepared using a 9"×½" template to trace the peel sample with a razor blade. The samples were fixed in the sliding, 90° peel rig and tested at a peel rate of 12 inches per minute. The average peel force was then recorded. In addition to peel force, the observable level of fiber pull-off was also evaluated. The amount of MDF fiber that was residual on the back of the peel specimen was used to indicate the level of adhesion that was present.

Roughness Test

The roughness of the coatings was measured using a Mitutoyo SURFTEST SJ-201P roughness tester that determined the average amplitude of surface variation of a sample. A flat panel sample was tested using the scanning mode which traverses a 2.5 mm sample length over 5 mm sample length area. A stylus is dragged across the test area and it measures the deflection in the vertical direction. The SURFTEST SJ-201P calculates the average deflection and the maximum deflection in both the up and down direction.

Gloss Test

The gloss of the compositions was measured using a BYK Gardner micro-TRI-gloss instrument that conforms to ASTM D 523 and ISO 2813. The tests were performed according to ASTM Test Method D 2457. The tests were all performed on film-only samples (i.e., samples were not coated boards). A 60° incident and reflection angle was used, as it closely represents visual impression of glossiness. Gloss is represented by the amount of light detected and is reported as 0% to 100% gloss level.

Opacity Test

The opacity of the compositions was measured in a conventional manner using a HunterLab ULTRASCAN XE SpectroPhotometer manufactured by Hunter Associates Laboratory, Inc., Reston, Va. The instrument was operated using HunterLab Universal Software (version 4.1). Calibration and operation of the instrument was according to the HunterLab User Manual and was largely directed by the Universal Software. The instrument conformed to relevant standards such as ASTM E 1164 and E 308. The HunterLab equipment obtains opacity by simply using the CIE Tristimulus Y value and calculating opacity based on the following equation: opacity $(Y)=100*Y_{black}/Y_{white}$, where black and white refer to the backing used in a reflectance reading. The tests were all performed in film-only samples using a D65 light source with a 10° observer angle in reflectance mode with specular included.

Toughness Test

In order to assess the toughness of the compositions formulated in the various experiments, a film-based tensile test was used that employed a pre-crack feature with a crack/ligament length of 12.7 mm. Films (7-8 mils) were extruded on a 1" Kilion with a general purpose screw. One inch wide by five inch film samples were cut from the extruded film rolls. A 12.7 mm cut was made from the edge to the middle of the film strip in the width direction. The films were placed in an Instron 5565 with a 5 kN static load cell with a 3 inch gap between the pneumatic clamps. The films were secured in the clamps and the specimens are pulled at a constant rate of 50 mm per minute. The load/displacement curve was obtained, from which the total energy, integration of the load displacement curve, was calculated. The total energy was used to compare the toughness of the various compositions. The toughness of the films was also evaluated based on the mode of fracture (brittle/ductile/mixed).

In addition to film testing, examination of the toughness of a coating on a MDF substrate was performed. The coated MDF profile was cut using a Dewalt miter saw at 90° and 45°. Examination of the cut line for fracturing/chipping of the coating is used to determine if adequate toughness has been achieved in the coating formulation.

Given the balance required for acceptable performance of the coating formulations, and overall Performance Score was defined as the sum of the Crosshatch Adhesions Score (using the number without the B, i.e., a 5B was added as a 5) plus the Tape Score. The higher the Performance Score, the better the coating formulation. The overall performance score was used in choosing formulations for each next set of experiments.

Examples 1 through 6

Evaluation of Base Resins for Paintability

Paint adhesion performance was tested on the following unfilled base resins: poly(styrene-acrylonitrile) (SAN), poly (acrylonitrile-butadiene-styrene) (ABS), polycarbonate (PC), polymethyl methacrylate (PMMA), poly(acrylonitrile-styrene-acrylate) (ASA), and glycol-modified poly(ethylene terephthalate) (PETG). These polymers were extruded on a 1" Kilion with a general purpose screw with film thickness varying from 7-8 mils within each film. The films were tested using the paint adhesion protocols detailed above.

Four paints were tested on each film to provide a broad range of paint exposure (variety of base resins and VOC levels). The paints were Devoe WONDER SPEED Semi-gloss, Sherwin Williams PROMAR Semigloss, Valspar GUARDIAN Semigloss, and ICI Alkyd Semigloss. The first three are water based latex paints, and the last is a solvent borne paint. The paints were all tinted with 2 ounces of Engelhard Blue per gallon of white paint in order to make delaminations more easily observed on the white/clear films samples. However, the PETG sample was run at a different time than the other unfilled resins.

Table 1 shows the results for paint evaluations on each of the base resins with each of the paints. Although the minimum scratch forces shown in the table are the actual values, those values were also normalized to a 0-5 numerical scale for comparative purposes.

TABLE 1

Paint protocol results for base resins.

| | Resin | Minimum Scratch Force with No Peeling* | Cross Hatch Adhesion Score | Tape Peel Test (NP = no peel, SP = small peel, LP = large peel) 3 h | 6 h | 24 h | 30 h | 48 h |
|---|---|---|---|---|---|---|---|---|
| | Devoe WONDER SPEED Semigloss White Paint | | | | | | | |
| 1 | PETG | 5 | 5B | NP | NP | NP | NP | NP |
| 2 | SAN | <13 | 5B | SP | NP | NP | NP | NP |
| 3 | ABS | 13 | 5B | NP | NP | NP | NP | NP |
| 4 | PC | 18 | 5B | NP | NP | NP | NP | NP |
| 5 | PMMA | <13 | 5B | NP | NP | NP | NP | NP |
| 6 | ASA | <<13 | 0B | SP | NP | NP | SP | SP |
| | Sherwin Williams PROMAR Semigloss White Paint | | | | | | | |
| 1a | PETG | 6 | 0B | NP | NP | NP | NP | NP |
| 2a | SAN | 6 | 5B | NP | NP | NP | NP | NP |
| 3a | ABS | 13 | 5B | NP | NP | NP | NP | NP |
| 4a | PC | 20 | 5B | NP | NP | NP | NP | NP |
| 5a | PMMA | 13 | 5B | NP | NP | NP | NP | NP |
| 6a | ASA | <8 | 5B | NP | NP | NP | SP | NP |

TABLE 1-continued

Paint protocol results for base resins.

| | Resin | Minimum Scratch Force with No Peeling* | Cross Hatch Adhesion Score | Tape Peel Test (NP = no peel, SP = small peel, LP = large peel) 3 h | 6 h | 24 h | 30 h | 48 h |
|---|---|---|---|---|---|---|---|---|
| | Valspar GUARDIAN Semigloss White Paint | | | | | | | |
| 1b | PETG | 13 | 5B | NP | NP | NP | NP | NP |
| 2b | SAN | <13 | 5B | SP | SP | NP | NP | SP |
| 3b | ABS | <<13 | 5B | NP | NP | SP | NP | NP |
| 4b | PC | 15 | 5B | SP | NP | NP | NP | NP |
| 5b | PMMA | <13 | 5B | SP | NP | NP | NP | NP |
| 6b | ASA | <<<13 | 5B | SP | NP | NP | SP | SP |
| | ICI Alkyd Semigloss White Paint | | | | | | | |
| 1c | PETG | <5 | 3B | NP | NP | NP | NP | NP |
| 2c | SAN | <6 | 4B | NP | NP | NP | NP | NP |
| 3c | ABS | <6 | 5B | NP | NP | NP | NP | NP |
| 4c | PC | <6 | 5B | NP | NP | NP | NP | NP |
| 5c | PMMA | <6 | 3B | NP | NP | NP | NP | NP |
| 6c | ASA | <6 | 0B | NP | NP | NP | NP | NP |

*<, <<, and <<< denote the severity of the scratching delamination and suggest how much less force would be necessary to cause delamination The base resin used in all of the following examples was a PET resin modified with a nominal 31 mole % cyclohexanedimethanol (CHDM) hydroxyl component, based on 100 mole % hydroxyl component.

Examples 7 Through 27

Evaluation of Additive Effects on Paintability

A series of glycol-modified poly(ethylene terephthalate) (PETG) samples were formulated in order to evaluate the effects of additives on the paint adhesion performance of the same four tinted paints used above in Examples 1-6. The additives included an opacity modifier, gloss modifiers, impact modifiers, and potential adhesion modifiers. The only opacity modifier examined was $TiO_2$. The rest of the additives were categorized as gloss modifiers or impact modifiers.

The additives were present in the PETG samples at 20% by weight based on the dilution of concentrates compounded at 40% by weight, except that SURLYN 8527 and Exxon Mobil EXXACT 4011 were compounded as 20% by weight concentrates and were not diluted when extruding as films. In addition, the film with the Ester Gum 8LM additive was not compounded due to potential particulate hazards.

The PETG samples were extruded on a 1" Kilion with a general purpose screw based on concentrate blending with film thickness varying from 7-8 mils within each film. The films were tested using the paint adhesion protocols detailed above, but tape line testing was only performed on selected samples. The results are set forth in Tables 2A-2D below.

TABLE 2A

Additive list and performance in paint testing protocol (20 wt % additive in PETG)
Devoe WONDER SPEED Semigloss White Paint

| | Additive | Description | Modifier | Minimum Scratch Force with No Peeling* | Cross Hatch Adhesion Score | Tape Peel Test (NP = no peel, SP = small peel, LP = large peel) 3 h | 6 h | 24 h | 30 h | 48 h |
|---|---|---|---|---|---|---|---|---|---|---|
| 7 | Cellulose Acetate CA398-30 | 39.8% acetyl, drop ball-30 sec | impact | <5 | 3B | | | | | |
| 8 | TENITE CA105E4T 62328 | same as CA398-30 with 28% plasticizer | impact | <5 | 2B | | | | | |
| 9 | OMYACARB FT | $CaCO_3$ 1.4 microns, surface treated | gloss | 5 | 4B | | | | | |
| 10 | EMFORCE Additive | high aspect ratio $CaCO_3$ | gloss | <5 | 4B | | | | | |
| 11 | EMFORCE B10 Additive | high aspect ratio $CaCO_3$ treated surface | gloss | 5 | 4B | | | | | |
| 12 | 9107 Talc | 60%$SiO_2$ 30% $MgO_2$, 6-8 microns | gloss | 5 | 5B | NP | NP | NP | NP | NP |
| 13 | EMAC/LOTADER 75/25 Blend | 75% EMAC (72% polyethylene, 28% methyl acrylate) and 25% Lotader 8900 (64% polyethylene, 28% methyl acrylate, 8% glycidyl methacrylate) | impact | <5 | 0B | | | | | |
| 14 | PARALOID 2314 | acrylic core shell reactive modifier | impact | 5 | 5B | | | | | |
| 15 | Exxon Mobil EXXACT 4011 | polyethylene based butene plastomer | impact | <<5 | 0B | | | | | |
| 16 | Crompton BLENDEX 338 | Acrylonitrile Butadiene Styrene Copolymer | impact | <5 | 5B | | | | | |
| 17 | LEVAMELT 400 | Poly(ethylene-co-vinyl acetate) 40% VAc | impact | <<5 | 0B | | | | | |
| 18 | LEVAMELT 700 | Poly(ethylene-co-vinyl acetate) 70% VAc | impact | 5 | 0B | | | | | |
| 19 | SURLYN 8527 | poly(ethylene-co-methacrylic acid) | impact | <<5 | 0B | | | | | |
| 20 | Ester Gum 8LM | not compounded-mechanical and HSE issues | | | | | | | | |
| 21 | ULTREX 95 | kaolin clay-high opacity, $TiO_2$ extender, pulverized | gloss | 7 | 5B | | | | | |
| 22 | SATINTONE SPECIAL | kaolin clay-high brightness for flat coatings | gloss | 5 | 5B | | | | | |
| 23 | #10 White | $CaCO_3$—12 microns | gloss | 5 | 5B | | | | | |
| 24 | HELIACAL 3000 | $CaCO_3$—3 microns | gloss | 5 | 5B | NP | NP | NP | NP | NP |
| 25 | $TiO_2$ | $TiO_2$ | opacity | 5 | 0B | NP | NP | NP | NP | NP |
| 26 | Dimethyl PEG 2K | 2000 g/mol polyethylene glycol with methyl endgroups | impact | <13 | 0B | NP | NP | NP | NP | NP |
| 27 | TEXIN DP7-300B | Bayer Polyurethane | impact | <<<13 | 0B | SP | LP | LP | SP | LP |

*<, <<, and <<< denote the severity of the scratching delamination and suggest how much less force would be necessary to cause delamination

TABLE 2B

Additive list and performance in paint testing protocol (20 wt % additive in PETG)
Sherwin Williams PROMAR Semigloss White Paint

| | Additive | Description | Modifier | Minimum Scratch Force with No Peeling* | Cross Hatch Adhesion Score | Tape Peel Test (NP = no peel, SP = small peel, LP = large peel) |
|---|---|---|---|---|---|---|
| 7 | Cellulose Acetate CA398-30 | 39.8% acetyl, drop ball-30 sec | impact | 4.5 | 4B | |
| 8 | TENITE CA105E4T 62328 | same as CA398-30 with 28% plasticizer | impact | 6 | 5B | |
| 9 | OMYACARB FT | $CaCO_3$ 1.4 microns, surface treated | gloss | <4.5 | 0B | |
| 10 | EMFORCE Additive | high aspect ratio $CaCO_3$ | gloss | <<4.5 | 0B | |
| 11 | EMFORCE B10 Additive | high aspect ratio $CaCO_3$ treated surface | gloss | <<4.5 | 0B | |
| 12 | 9107 Talc | 60%$SiO_2$ 30% $MgO_2$, 6-8 microns | gloss | <<<4.5 | 0B | NP NP NP NP NP |
| 13 | EMAC/LOTADER 75/25 Blend | 75% EMAC (72% polyethylene, 28% methyl acrylate) and 25% Lotader 8900 (64% polyethylene, 28% methyl acrylate, 8% glycidyl meth acrylate) | impact | <<4.5 | 0B | |
| 14 | PARALOID 2314 | acrylic core shell reactive modifier | impact | 6 | 0B | |

TABLE 2B-continued

Additive list and performance in paint testing protocol (20 wt % additive in PETG)
Sherwin Williams PROMAR Semigloss White Paint

| | Additive | Description | Modifier | Minimum Scratch Force with No Peeling* | Cross Hatch Adhesion Score | Tape Peel Test (NP = no peel, SP = small peel, LP = large peel) | | | | |
|---|---|---|---|---|---|---|---|---|---|---|
| 15 | Exxon Mobil EXXACT 4011 | polyethylene based butene plastomer | impact | <<<4.5 | 4B | | | | | |
| 16 | Crompton BLENDEX 338 | Acrylonitrile Butadiene Styrene copolymer | impact | 6 | 0B | | | | | |
| 17 | LEVAMELT 400 | Poly(ethylene-co-vinyl acetate) 40% VAc | impact | <<4.5 | 2B | | | | | |
| 18 | LEVAMELT 700 | Poly(ethylene-co-vinyl acetate) 70% VAc | impact | 4.5 | 0B | | | | | |
| 19 | SURLYN 8527 | poly(ethylene-co-methacrylic acid) | impact | <<<4.5 | 0B | | | | | |
| 20 | Ester Gum 8LM | not compounded-mechanical and HSE issues | | — | — | | | | | |
| 21 | ULTREX 95 | kaolin clay-high opacity, $TiO_2$ extender, pulverized | gloss | 4.5 | 0B | | | | | |
| 22 | SATINTONE SPECIAL | kaolin clay-high brightness for flat coatings | gloss | 6 | 0B | | | | | |
| 23 | #10 White | $CaCO_3$—12 microns | gloss | 6 | 2B | | | | | |
| 24 | HELIACAL 3000 | $CaCO_3$—3 microns | gloss | 6 | 2B | NP | NP | NP | NP | NP |
| 25 | $TiO_2$ | $TiO_2$ | opacity | <4.5 | 0B | NP | SP | NP | NP | NP |
| 26 | Dimethyl PEG 2K | 2000 g/mol polyethylene glycol with methyl endgroups | impact | <<8 | 0B | NP | NP | NP | NP | SP |
| 27 | TEXIN DP7-300B | Bayer polyurethane | impact | <<8 | 0B | NP | SP | LP | LP | LP |

*<, <<, and <<< denote the severity of the scratching delamination and suggest how much less force would be necessary to cause delamination

TABLE 2C

Additive list and performance in paint testing protocol (20 wt % additive in PETG)
Valspar GUARDIAN Semigloss White Paint

| | Additive | Description | Modifier | Minimum Scratch Force with No Peeling* | Cross Hatch Adhesion Score | Tape Peel Test (NP = no peel, SP = small peel, LP = large peel) | | | | |
|---|---|---|---|---|---|---|---|---|---|---|
| 7 | Cellulose Acetate CA398-30 | 39.8% acetyl, drop ball-30 sec | impact | <10 | 5B | | | | | |
| 8 | TENITE CA105E4T 62328 | same as CA398-30 with 28% plasticizer | impact | <10 | 5B | | | | | |
| 9 | OMYACARB FT | $CaCO_3$ 1.4 microns, surface treated | gloss | <10 | 5B | | | | | |
| 10 | EMFORCE Additive | high aspect ratio $CaCO_3$ | gloss | <10 | 5B | | | | | |
| 11 | EMFORCE B10 Additive | high aspect ratio $CaCO_3$ treated surface | gloss | <10 | 5B | | | | | |
| 12 | 9107 Talc | 60%$SiO_2$ 30% $MgO_2$, 6-8 microns | gloss | <10 | 5B | NP | NP | NP | NP | NP |
| 13 | EMAC/LOTADER 75/25 Blend | 75% EMAC (72% polyethylene, 28% methyl acrylate) and 25% Lotader 8900 (64% polyethylene, 28% methyl acrylate, 8% glycidyl methacrylate) | impact | >18 | 5B | | | | | |
| 14 | PARALOID 2314 | acrylic core shell reactive modifier | impact | 10 | 5B | | | | | |
| 15 | Exxon Mobil EXXACT 4011 | polyethylene based butene plastomer | impact | <10 | 1B | | | | | |
| 16 | Crompton BLENDEX 338 | Acrylonitrile Butadiene Styrene copolymer (70% butadiene) | impact | 10 | 5B | | | | | |
| 17 | LEVAMELT 400 | Poly(ethylene-co-vinyl acetate) 40% VAc | impact | <10 | 4B | | | | | |
| 18 | LEVAMELT 700 | Poly(ethylene-co-vinyl acetate) 70% VAc | impact | 13 | 4B | | | | | |
| 19 | SURLYN 8527 | poly(ethylene-co-methacrylic acid) | impact | <10 | 0B | | | | | |
| 20 | Ester Gum 8LM | not compounded-mechanical and HSE issues | | — | — | | | | | |
| 21 | ULTREX 95 | kaolin clay-high opacity, $TiO_2$ extender, pulverized | gloss | <10 | 3B | | | | | |
| 22 | SATINTONE SPECIAL | kaolin clay-high brightness for flat coatings | gloss | <13 | 2B | | | | | |
| 23 | #10 White | $CaCO_3$—12 microns | gloss | 10 | 5B | | | | | |
| 24 | HELIACAL 3000 | $CaCO_3$—3 microns | gloss | 15 | 5B | SP | NP | NP | NP | NP |
| 25 | $TiO_2$ | $TiO_2$ | opacity | 10 | 5B | SP | NP | NP | NP | NP |

TABLE 2C-continued

Additive list and performance in paint testing protocol (20 wt % additive in PETG)
Valspar GUARDIAN Semigloss White Paint

| | Additive | Description | Modifier | Minimum Scratch Force with No Peeling* | Cross Hatch Adhesion Score | Tape Peel Test (NP = no peel, SP = small peel, LP = large peel) | | | | |
|---|---|---|---|---|---|---|---|---|---|---|
| 26 | Dimethyl PEG 2K | 2000 g/mol polyethylene glycol with methyl endgroups | impact | <<<13 | 5B | SP | SP | SP | SP | SP |
| 27 | TEXIN DP7-300B | Bayer polyurethane | impact | <13 | 2B | SP | NP | NP | NP | NP |

*<, <<, and <<< denote the severity of the scratching delamination and suggest how much less force would be necessary to cause delamination

TABLE 2D

Additive list and performance in paint testing protocol (20 wt % additive in PETG)
ICI Alkyd Semigloss White Paint

| | Additive | Description | Modifier | Minimum Scratch Force with No Peeling* | Cross Hatch Adhesion Score | Tape Peel Test (NP = no peel, SP = small peel, LP = large peel) | | | | |
|---|---|---|---|---|---|---|---|---|---|---|
| 7 | Cellulose Acetate CA398-30 | 39.8% acetyl, drop ball-30 sec | impact | <4.5 | 3B | | | | | |
| 8 | TENITE CA105E4T 62328 | same as CA398-30 with 28% plasticizer | impact | 4.5 | 1B | | | | | |
| 9 | OMYACARB FT | $CaCO_3$ 1.4 microns, surface treated | gloss | 3 | 0B | | | | | |
| 10 | EMFORCE Additive | high aspect ratio $CaCO_3$ | gloss | 4.5 | 1B | | | | | |
| 11 | EMFORCE B10 Additive | high aspect ratio $CaCO_3$ treated surface | gloss | 3 | 0B | | | | | |
| 12 | 9107 Talc | 60%$SiO_2$ 30% $MgO_2$, 6-8 microns | gloss | 3 | 2B | NP | NP | NP | NP | NP |
| 13 | EMAC/LOTADER 75/25 Blend | 75% EMAC (72% polyethylene, 28% methyl acrylate) and 25% Lotader 8900 (64% polyethylene, 28% methyl acrylate, 8% glycidyl methacrylate) | impact | 3 | 2B | | | | | |
| 14 | PARALOID 2314 | acrylic core shell reactive modifier | impact | 3 | 0B | | | | | |
| 15 | Exxon Mobil EXXACT 4011 | polyethylene based butene plastomer | impact | 3 | 4B | | | | | |
| 16 | Crompton BLENDEX 338 | Acrylonitrile Butadiene Styrene copolymer | impact | 3 | 4B | | | | | |
| 17 | LEVAMELT 400 | Poly(ethylene-co-vinyl acetate) 40% VAc | impact | 3 | 3B | | | | | |
| 18 | LEVAMELT 700 | Poly(ethylene-co-vinyl acetate) 70% VAc | impact | 4.5 | 5B | | | | | |
| 19 | SURLYN 8527 | poly(ethylene-co-methacrylic acid) | impact | 3 | 5B | | | | | |
| 20 | Ester Gum 8LM | not compounded-mechanical and HSE issues | | — | — | | | | | |
| 21 | ULTREX 95 | kaolin clay-high opacity, $TiO_2$ extender, pulverized | gloss | 3 | 2B | | | | | |
| 22 | SATINTONE SPECIAL | kaolin clay-high brightness for flat coatings | gloss | <3 | 5B | | | | | |
| 23 | #10 White | $CaCO_3$—12 microns | gloss | 3 | 4B | | | | | |
| 24 | HELIACAL 3000 | $CaCO_3$—3 microns | gloss | 3 | 5B | NP | NP | NP | NP | NP |
| 25 | $TiO_2$ | $TiO_2$ | opacity | 4.5 | 4B | NP | NP | NP | NP | NP |
| 26 | Dimethyl PEG 2K | 2000 g/mol polyethylene glycol with methyl endgroups | impact | <6 | 5B | NP | NP | NP | NP | NP |
| 27 | TEXIN DP7-300B | Bayer polyurethane | impact | <6 | 5B | NP | NP | NP | NP | NP |

*<, <<, and <<< denote the severity of the scratching delamination and suggest how much less force would be necessary to cause delamination Of the gloss modifiers that were tested, the untreated, calcium carbonate-containing samples demonstrated the most marked improvement in paint adhesion compared to the unfilled control sample. In addition to paint adhesion, some of the calcium carbonate films resulted in noticeably tougher films at the 20% by weight loading compared to the talc loaded films. However, the effects of the calcium carbonate particle size and shape may account for that difference.

Unlike gloss modifiers, the presence of impact modifiers did not result in a noticeable improvement in paintability compared to the control. However, the BLENDEX 338, PARALOID 2314, and LEVAMELT 700 compositions had a small reduction in paintability. In particular, the impact modifiers that contained a high proportion of polyethylene rubber segment performed poorly in the paint adhesion tests. Direct comparison of the LEVAMELT 400 (poly(ethylene-co-vinyl acetate) 40% VAc) with LEVAMELT 700 (poly (ethylene-co-vinyl acetate) 70% VAc) revealed that increasing the amount of vinyl acetate, a polar functional group, lead to improved painting performance. However, highly polar additives like polyethylene glycol and polyurethane demonstrated poor paint performance, and cellulose ester additives showed only minimal improvement of paint adhesion performance.

Examples 28 Through 50

Design of Experiment-Effect of Calcium Carbonate Size, Calcium Carbonate Level, Impact Modifier, and Impact Modifier Level A series of glycol-modified poly(ethylene terephthalate) (PETG) samples containing calcium carbonate as a gloss modifier and one of three polar potential impact modifiers were formulated in order to evaluate the effects of the size and concentration of the gloss modifier and the effects of the nature and concentration of the impact modifier on the paint adhesion performance of the same four tinted paints used above in the previous examples.

The size of the calcium carbonate was either 3 microns ("Small") or 20 microns ("Large"), while the concentration of calcium carbonate was either 20% by weight or 30% by weight.

The three polar, potential impact modifiers were PEBAX 5533 (segmented poly(ether-co-amide)), HYTREL 5526 (segmented poly(ether-co-urethane)), ECDEL 9965 (segmented poly(ether-co-ester)), each of which comprised a polyether rubber segment rather than the polyethylene or polyacrylate rubbery segments examined in the previous experiments. The concentration of the impact modifier was either 5% by weight or 10% by weight of the total composition.

The polymers were extruded on the 1" Kilion with a general purpose screw based on concentrate blending with film thickness varying from 7-8 mils within each film. The films were tested using the paint adhesion protocol detailed above. Two paints were tested on each film and these paints were Valspar Guardian Semigloss and Behr Premium Plus Semigloss Enamel. The paints were tinted with 2 ounces of Engelhard Blue per gallon of white paint in order to make delaminations more easily observed on the white films samples.

Performance in each of the paint testing protocol tests was examined. Table 3 lists the run combinations in the order that they were extruded and coated. Each of the different elastomer types was evaluated independently for concentration effects as well as synergistic effects with the calcium carbonate size and concentration. The cross-hatch adhesion test results were not used due to a lack of sensitivity in the results as all the samples produced the same score of zero (i.e. all samples had >65% area paint removed).

TABLE 3

DOE to evaluate effects of calcium carbonate size, calcium carbonate level, impact modifier, and impact modifier level. Valspar Guardian Semigloss White Paint

| Resin | PETG | Calcium Carbonate | Impact Modifier | Impact Modifier Type | Calcium Carbonate Particle Size | Relative Scratch Score | Cross Hatch Adhesion Score | Tape Peel Test (NP = no peel, SP = small peel, LP = large peel) 3 h | 6 h | 24 h | 30 h | 48 h | tape score |
|---|---|---|---|---|---|---|---|---|---|---|---|---|---|
| 28a | 65 | 30 | 5 | PEBAX 5533 | Small | 8 | 0B | L | L | L | L | L | 0 |
| 29a | 70 | 20 | 10 | PEBAX 5533 | Small | 7 | 0B | L | L | L | L | L | 0 |
| 30a | 65 | 30 | 5 | HYTREL 5526 | Large | 5 | 0B | S | S | L | L | L | 1 |
| 31a | 75 | 20 | 5 | HYTREL 5526 | Large | 4 | 0B | N | S | S | S | L | 2.5 |
| 32a | 75 | 20 | 5 | PEBAX 5533 | Small | 6 | 0B | S | S | N | L | S | 2.5 |
| 33a | 70 | 20 | 10 | PEBAX 5533 | Large | 6 | 0B | L | L | L | L | L | 0 |
| 34a | 70 | 20 | 10 | HYTREL 5526 | Large | 3 | 0B | L | L | S | N | L | 1.5 |
| 35a | 75 | 20 | 5 | PEBAX 5533 | Large | 6 | 0B | S | S | S | L | N | 2.5 |
| 36a | 70 | 20 | 10 | HYTREL 5526 | Small | 5 | 0B | S | L | L | L | L | 0.5 |
| 37a | 60 | 30 | 10 | HYTREL 5526 | Small | 3 | 0B | S | L | L | L | L | 0.5 |
| 38a | 60 | 30 | 10 | PEBAX 5533 | Large | 4 | 0B | L | L | L | S | L | 0.5 |
| 39a | 75 | 20 | 5 | HYTREL 5526 | Small | 5 | 0B | S | S | S | S | S | 2.5 |
| 40a | 60 | 30 | 10 | HYTREL 5526 | Large | 3 | 0B | L | L | L | L | L | 0 |
| 41a | 65 | 30 | 5 | HYTREL 5526 | Small | 5 | 0B | N | S | S | S | L | 2.5 |
| 42a | 65 | 30 | 5 | PEBAX 5533 | Large | 6 | 0B | L | N | S | L | L | 1.5 |
| 43a | 60 | 30 | 10 | PEBAX 5533 | Small | 5 | 0B | L | L | L | L | L | 0 |
| 44a | 65 | 30 | 5 | ECDEL 9965 | Large | 4 | 0B | S | N | S | S | S | 3 |
| 45a | 75 | 20 | 5 | ECDEL 9965 | Large | 1 | 0B | S | S | S | N | N | 3.5 |
| 46a | 70 | 20 | 10 | ECDEL 9965 | Large | 2 | 0B | S | S | N | L | S | 2.5 |
| 47a | 70 | 20 | 10 | ECDEL 9965 | Small | 3 | 0B | L | L | S | L | S | 1 |
| 48a | 60 | 30 | 10 | ECDEL 9965 | Small | 6 | 0B | L | S | L | L | L | 0.5 |
| 49a | 75 | 20 | 5 | ECDEL 9965 | Small | 2 | 0B | L | S | S | L | L | 1 |
| 50a | 60 | 30 | 10 | ECDEL 9965 | Large | 1 | 0B | S | N | S | S | N | 3.5 |
| 28b | 65 | 30 | 5 | PEBAX 5533 | Small | 4 | 0B | S | L | L | L | L | 0.5 |
| 29b | 70 | 20 | 10 | PEBAX 5533 | Small | 7 | 0B | S | L | S | L | N | 2 |
| 30b | 65 | 30 | 5 | HYTREL 5526 | Large | 1 | 0B | S | S | S | L | S | 2 |
| 31b | 75 | 20 | 5 | HYTREL 5526 | Large | 3 | 0B | N | N | L | L | L | 2 |
| 32b | 75 | 20 | 5 | PEBAX 5533 | Small | 2 | 0B | N | N | N | L | L | 3 |
| 33b | 70 | 20 | 10 | PEBAX 5533 | Large | 8 | 0B | L | N | L | N | L | 2 |
| 34b | 70 | 20 | 10 | HYTREL 5526 | Large | 6 | 0B | S | L | L | N | N | 2.5 |
| 35b | 75 | 20 | 5 | PEBAX 5533 | Large | 4 | 0B | N | N | N | N | N | 5 |
| 36b | 70 | 20 | 10 | HYTREL 5526 | Small | 6 | 0B | N | N | L | N | L | 3 |
| 37b | 60 | 30 | 10 | HYTREL 5526 | Small | 7 | 0B | N | S | L | L | L | 1.5 |
| 38b | 60 | 30 | 10 | PEBAX 5533 | Large | 5 | 0B | L | S | N | N | L | 2.5 |
| 39b | 75 | 20 | 5 | HYTREL 5526 | Small | 3 | 0B | N | N | N | N | N | 5 |
| 40b | 60 | 30 | 10 | HYTREL 5526 | Large | 5 | 0B | N | L | L | N | L | 2 |
| 41b | 65 | 30 | 5 | HYTREL 5526 | Small | 1 | 0B | N | N | L | L | L | 2 |
| 42b | 65 | 30 | 5 | PEBAX 5533 | Large | 4 | 0B | L | L | L | L | N | 1 |
| 43b | 60 | 30 | 10 | PEBAX 5533 | Small | 8 | 0B | N | N | L | N | N | 4 |
| 44b | 65 | 30 | 5 | ECDEL 9965 | Large | 2 | 0B | N | S | N | N | L | 3.5 |
| 45b | 75 | 20 | 5 | ECDEL 9965 | Large | 1 | 0B | N | N | N | N | L | 5 |
| 46b | 70 | 20 | 10 | ECDEL 9965 | Large | 2 | 0B | N | L | N | L | L | 2 |

TABLE 3-continued

DOE to evaluate effects of calcium carbonate size, calcium carbonate level, impact modifier, and impact modifier level. Valspar Guardian Semigloss White Paint

| Resin | PETG | Calcium Carbonate | Impact Modifier | Impact Modifier Type | Calcium Carbonate Particle Size | Relative Scratch Score | Cross Hatch Adhesion Score | Tape Peel Test (NP = no peel, SP = small peel, LP = large peel) 3 h | 6 h | 24 h | 30 h | 48 h | tape score |
|---|---|---|---|---|---|---|---|---|---|---|---|---|---|
| 47b | 70 | 20 | 10 | ECDEL 9965 | Small | 2 | 0B | N | N | L | L | L | 2 |
| 48b | 60 | 30 | 10 | ECDEL 9965 | Small | 7 | 0B | S | N | L | L | L | 1.5 |
| 49b | 75 | 20 | 5 | ECDEL 9965 | Small | 3 | 0B | N | N | L | L | L | 2 |
| 50b | 60 | 30 | 10 | ECDEL 9965 | Large | 1 | 0B | N | N | N | L | L | 3 |

The concentration of ECDEL 9965 had no statistically significant effect on the tape test or the scratch test. However, the results suggested that a lower concentration of calcium carbonate having larger particles sizes would improve paint adhesion when using ECDEL 9965 as the impact modifier.

The presence of HYTREL 5526 was detrimental to the adhesion performance for both the tape and scratch tests. However, in contrast to ECDEL 9965, smaller calcium carbonate particle sizes lead to improved adhesion performance. Varying the concentration of calcium carbonate for this series resulted in mixed performances: the scratch performance improved when the concentration of calcium carbonate was increased, but the tape score decreased.

For PEBAX 5533, lower concentrations lead to improved adhesive performance. While the scratch performance was unaffected by the concentration or particle size of the calcium carbonate, the tape performance improved with larger particle sizes and lower overall concentration. Table 4 lists the relationships between the factors and responses.

TABLE 4

DOE factor and response relationships for improving paint testing scores.

| Examples | Factor | ECDEL 9965 Scratch | ECDEL 9965 Tape | HYTREL 5526 Scratch | HYTREL 5526 Tape | PEBAX 5533 Scratch | PEBAX 5533 Tape |
|---|---|---|---|---|---|---|---|
| 1 | $CaCO_3$ | lower | n/a | higher | lower | n/a | lower |
| 2 | Elastomer | n/a | n/a | lower | lower | lower | lower |
| 3 | Particle Size | higher | higher | lower | lower | n/a | higher |

The effects of particle size and concentration of calcium carbonate were used to guide further experimentation using ECDEL 9965 as a potential impact modifier, although the efficacy of ECDEL 9965 as an impact modifier was still unknown and required further experimentation.

Examples 51 Through 53

Initial Evaluations of Compositions with ABS

A film of PETG comprising talc, titanium dioxide, and EMAC (polyethylene-co-methyl acrylate) with LOTADER 8900 were prepared. The two experimental films employed calcium carbonate instead of talc as the gloss modifier and ABS instead of EMAC as the impact modifier, while all the films employed titanium dioxide for opacity modification. In addition, the last experimental film contained a small amount of cellulose ester, which previously demonstrated some paint adhesion improvement when used alone at 20 wt %. The films were extruded on a 1" Kilion with a general purpose screw based on concentrate blending with film thickness varying from 7-8 mils within each film.

The films were tested using the paint adhesion protocol detailed above using the same four tinted paints used in the previous examples were tested. The compositions and their performance in the paint testing protocol are detailed in Table 5.

TABLE 5

Formulated composition performance. (PETG 6763 resin modified as shown)

| | Additives | Minimum Scratch Force with no peeling | Cross Hatch Adhesion Score | Tape Peel Test (NP = no peel, SP = small peel, LP = large peel) 3 h | 6 h | 24 h | 30 h | 48 h |
|---|---|---|---|---|---|---|---|---|
| | Devoe WONDER SPEED Semigloss White Paint | | | | | | | |
| 51 | 24% talc, 8% EMAC/LOTADER (75/25), 8% $TiO_2$ | 5 | 0B | LP | LP | LP | LP | LP |
| 52 | 24% $CaCO_3$, 8% BLENDEX 338 (ABS), 8% $TiO_2$ | <5 | 0B | NP | NP | NP | NP | NP |
| 53 | 24% $CaCO_3$, 8% BLENDEX 338 (ABS), 4% CA9830, 4% $TiO_2$ | <5 | 0B | NP | NP | NP | NP | NP |

TABLE 5-continued

| Formulated composition performance. (PETG 6763 resin modified as shown) | | | | | | | | |
|---|---|---|---|---|---|---|---|---|
| | | Minimum Scratch Force with | Cross Hatch Adhesion | Tape Peel Test (NP = no peel, SP = small peel, LP = large peel) | | | | |
| | Additives | no peeling | Score | 3 h | 6 h | 24 h | 30 h | 48 h |
| | Sherwin Williams PROMAR Semigloss White Paint | | | | | | | |
| 51a | 24% talc, 8% EMAC/LOTADER (75/25), 8% $TiO_2$ | 4.5 | 0B | LP | LP | LP | LP | LP |
| 52a | 24% $CaCO_3$, 8% BLENDEX 338 (ABS), 8% $TiO_2$ | <4.5 | 0B | NP | NP | NP | NP | NP |
| 53[a] | 24% $CaCO_3$, 8% BLENDEX 338 (ABS), 4% CA9830, 4% $TiO_2$ | 4.5 | 0B | NP | NP | NP | NP | NP |
| | Valspar GUARDIAN Semigloss White Paint | | | | | | | |
| 51b | 24% talc, 8% EMAC/LOTADER (75/25), 8% $TiO_2$ | <10 | 4B | LP | LP | NP | NP | NP |
| 52b | 24% $CaCO_3$, 8% BLENDEX 338 (ABS), 8% $TiO_2$ | 13 | 5B | NP | NP | NP | NP | NP |
| 53b | 24% $CaCO_3$, 8% BLENDEX 338 (ABS), 4% CA9830, 4% $TiO_2$ | 10 | 5B | NP | NP | NP | NP | NP |
| | ICI Alkyd Semigloss White Paint | | | | | | | |
| 51c | 24% talc, 8% EMAC/LOTADER (75/25), 8% $TiO_2$ | <4.5 | 5B | NP | NP | NP | NP | NP |
| 52c | 24% $CaCO_3$, 8% BLENDEX 338 (ABS), 8% $TiO_2$ | <4.5 | 5B | NP | NP | NP | NP | NP |
| 53c | 24% $CaCO_3$, 8% BLENDEX 338 (ABS), 4% CA9830, 4% $TiO_2$ | <4.5 | 5B | NP | NP | NP | NP | NP |

The cross-hatch adhesion test results did not show significant differences among the formulations for three of the paints tested. On the other hand, the scratch scores and tape line test performance demonstrated a significant difference, with the experimental sample containing ABS and calcium carbonate showing a markedly improved performance, especially in the tape line test. The improvement in the performance of the coating comprising the cellulose ester material was not significant. The inclusion of LOTADER 8900 could potentially reduce the effects nonpolar, polyethylene-based impact modifiers since it is reactive and will not possess the same mobility as an unreactive modifier. That lack of mobility may account for part of the acceptable adhesion performance by the talc, titanium dioxide, and EMAC/LOTADER 8900 film.

Examples 54 Through 61

Evaluation of Formulated Compositions Containing Calcium Carbonate, ABS and Lotader 8900/EMAC Several compositions comprising LOTADER 8900 and/or EMAC (the most effective impact modifiers) were formulated. Films were extruded on a 1" Kilion with a general purpose screw based on concentrate blending with film thickness varying from 7-8 mils within each film. The films were tested using the paint adhesion protocol detailed above. The same four paints used in the previous examples were tested. The compositions and their performance in the paint testing protocol are detailed in Table 6. The values for the scratch testing reflect the normalized comparative values instead of the absolute values for the critical delamination force.

TABLE 6

Films of PETG 6763 Resin formulated compositions examining the effects of $CaCO_3$, ABS, and Lotader/EMAC on paint

| | Resin | Relative Scratch Score | Cross Hatch Adhesion Score | Tape Peel Test (NP = no peel, SP = small peel, LP = large peel) 3 h | 6 h | 24 h | 30 h | 48 h | tape score |
|---|---|---|---|---|---|---|---|---|---|
| | Valspar GUARDIAN Semigloss White Paint | | | | | | | | |
| 54a | 20 wt % #10 white (12 micron), 10% ABS (GP-22), 2.5% LOTADER 8900/EMAC (25/75) | 1 | 5B | N | N | N | N | N | 5.00 |
| 55a | 20 wt % #10 white (12 micron), 10% ABS (GP-22), 5% LOTADER 8900/EMAC (25/75) | 1 | 1B | N | N | N | N | N | 5.00 |
| 56a | 20 wt % #10 white (12 micron), 2.5% LOTADER 8900/EMAC (25/75) | 1 | 5B | N | N | N | N | N | 5.00 |
| 57a | 20 wt % #10 white (12 micron), 5% LOTADER 8900/EMAC (25/75) | 5 | 5B | N | N | N | N | N | 5.00 |
| 58a | 20 wt % microwhite (20 micron), 10% ABS (GP-22), 2.5% Lotader 8900/EMAC (25/75) | 1 | 5B | N | N | N | N | N | 5.00 |
| 59a | 20 wt % microwhite (20 micron), 10% ABS (GP-22), 5% LOTADER 8900/EMAC (25/75) | 1 | 5B | N | N | N | N | N | 5.00 |
| 60[a] | 20 wt % microwhite (20 micron), 2.5% LOTADER 8900/EMAC (25/75) | 1 | 5B | N | N | N | N | N | 5.00 |
| 61a | 20 wt % microwhite (20 micron), 5% LOTADER 8900/EMAC (25/75) | 1 | 5B | N | N | N | N | N | 5.00 |
| | Behr PREMIUM PLUS Semigloss Enamel White Paint | | | | | | | | |
| 55b | 20 wt % #10 white (12 micron), 10% ABS (GP-22), 2.5% LOTADER 8900/EMAC (25/75) | 1 | 0B | N | N | L | S | N | 3.50 |
| 56b | 20 wt % #10 white (12 micron), 10% ABS (GP-22), 5% LOTADER 8900/EMAC (25/75) | 5 | 0B | N | N | L | L | N | 3.00 |
| 57b | 20 wt % #10 white (12 micron), 2.5% LOTADER 8900/EMAC (25/75) | 2 | 0B | N | N | N | L | N | 4.00 |
| 58b | 20 wt % #10 white (12 micron), 5% LOTADER 8900/EMAC (25/75) | 4 | 0B | S | N | N | L | N | 3.50 |
| 59b | 20 wt % microwhite (20 micron), 10% ABS (GP-22), 2.5% LOTADER 8900/EMAC (25/75) | 5 | 0B | N | N | S | S | N | 4.00 |
| 60b | 20 wt % microwhite (20 micron), 10% ABS (GP-22), 5% LOTADER 8900/EMAC (25/75) | 4 | 0B | N | S | L | N | N | 3.50 |
| 61b | 20 wt % microwhite (20 micron), 2.5% LOTADER 8900/EMAC (25/75) | 3 | 0B | N | N | L | N | N | 4.00 |
| 62b | 20 wt % microwhite (20 micron), 5% LOTADER 8900/EMAC (25/75) | 3 | 0B | N | N | N | N | N | 5.00 |
| | Valspar COLOR STYLE Semigloss White Paint | | | | | | | | |
| 51c | 20 wt % #10 white (12 micron), 10% ABS (GP-22), 2.5% LOTADER 8900/EMAC (25/75) | 1 | 5B | N | N | S | N | S | 4.00 |
| 52c | 20 wt % #10 white (12 micron), 10% ABS (GP-22), 5% LOTADER 8900/EMAC (25/75) | 1 | 5B | S | N | N | N | N | 4.50 |
| 53c | 20 wt % #10 white (12 micron), 2.5% LOTADER 8900/EMAC (25/75) | 5 | 5B | N | N | N | N | N | 5.00 |
| 54c | 20 wt % #10 white (12 micron), 5% LOTADER 8900/EMAC (25/75) | 5 | 3B | N | S | S | S | S | 3.00 |
| 55c | 20 wt % microwhite (20 micron), 10% ABS (GP-22), 2.5% LOTADER 8900/EMAC (25/75) | 1 | 2B | N | N | N | N | N | 5.00 |
| 56c | 20 wt % microwhite (20 micron), 10% ABS (GP-22), 5% LOTADER 8900/EMAC (25/75) | 1 | 0B | N | S | N | N | S | 4.00 |
| 57c | 20 wt % microwhite (20 micron), 2.5% LOTADER 8900/EMAC (25/75) | 1 | 5B | S | N | N | N | N | 4.50 |
| 58c | 20 wt % microwhite (20 micron), 5% LOTADER 8900/EMAC (25/75) | 1 | 5B | S | N | N | S | N | 4.00 |
| | Valspar PROFESSIONAL Semigloss White Paint | | | | | | | | |
| 51d | 20 wt % #10 white (12 micron), 10% ABS (GP-22), 2.5% LOTADER 8900/EMAC (25/75) | 4 | 5B | L | S | S | N | N | 3.00 |
| 52d | 20 wt % #10 white (12 micron), 10% ABS (GP-22), 5% LOTADER 8900/EMAC (25/75) | 1 | 5B | L | N | N | S | S | 3.00 |
| 53d | 20 wt % #10 white (12 micron), 2.5% LOTADER 8900/EMAC (25/75) | 3 | 5B | L | L | S | S | N | 2.00 |
| 54d | 20 wt % #10 white (12 micron), 5% LOTADER 8900/EMAC (25/75) | 5 | 1B | L | L | L | S | L | 1.50 |
| 55d | 20 wt % microwhite (20 micron), 10% ABS (GP-22), 2.5% LOTADER 8900/EMAC (25/75) | 3 | 1B | L | S | S | S | N | 2.50 |
| 56d | 20 wt % microwhite (20 micron), 10% ABS (GP-22), 5% LOTADER 8900/EMAC (25/75) | 4 | 1B | L | N | S | S | N | 3.00 |

TABLE 6-continued

Films of PETG 6763 Resin formulated compositions examining the effects of $CaCO_3$, ABS, and Lotader/EMAC on paint

| | Resin | Relative Scratch Score | Cross Hatch Adhesion Score | Tape Peel Test (NP = no peel, SP = small peel, LP = large peel) 3 h | 6 h | 24 h | 30 h | 48 h | tape score |
|---|---|---|---|---|---|---|---|---|---|
| 57d | 20 wt % microwhite (20 micron), 2.5% LOTADER 8900/EMAC (25/75) | 2 | 5B | L | S | N | N | N | 3.50 |
| 58d | 20 wt % microwhite (20 micron), 5% LOTADER 8900/EMAC (25/75) | 3 | 3B | L | S | N | S | N | 3.00 |

The compositions enabled a direct comparison between the particles sizes of calcium carbonate that were being examined. In all cases, particles that had mean diameter of 12 microns yielded superior results compared to those having a mean diameter of 20 microns. In addition, samples that included ABS performed more poorly as compared to samples without the ABS, possibly due to the higher overall impact modifier content. Furthermore, increasing concentrations of LOTADER 8900/EMAC (25/75) decreased the paint adhesion performance. That result is consistent with the initial additives screening experimentation that suggested none of the impact modifiers actually improved paint adhesion.

Based on the results, a composition comprising PETG resin, calcium carbonate, and titanium dioxide would seem to have potential from a paintability standpoint, but the presence of the inorganic fillers requires an impact modifier in order to produce a coating that can be fabricated (mitered, routed, nailed, etc.).

All of the films shown in Table 6 exhibited brittle or mixed mode fractures using the tensile test for film toughness and noting the mode of fracture as described above. That suggested that further impact modification was necessary to achieve formulations that could be fabricated for moulding and trim applications.

Examples 62 Through 67

Paint Adhesion Performance and Toughness of Coated MDF Substrate Materials—Set 1

Six compositions were tested to determine whether results from the film sample test correlate with the results using coated board samples. Three of the six compositions were experimental formulations with the base resin being a PET modified with nominally 31 mole % 1,4-cyclohexanedimethanol. The samples noting 6763 had a nominal inherent viscosity of 0.75 dL/g and the samples noting 5011 had a nominal inherent viscosity of 0.59 dL/g. In addition, a sample that was previously coated with a formulation containing talc, EMAC and titanium dioxide that had performed poorly as a film in adhesion tests was examined. Finally, a Gesso and a PVC, were used as controls for comparison.

The compositions were run on an extrusion coating line at 35 ft/min. with an extruder melt temperature of 500° F. and a die temperature of 530° F.

Five paints were tested on each film. Those paints included Sherwin Williams PROMAR Semigloss, Devoe WONDER SPEED Semigloss, Valspar GUARDIAN Semigloss, ICI Alkyd Semigloss, and Behr PREMIUM PLUS Semigloss Enamel. The paints were tinted with 2 ounces of Engelhard Blue per gallon of white paint in order to make delaminations more easily observed on the white films samples. The coated wood substrates were tested using the paint adhesion protocols detailed above.

Table 7 details the results of the paint testing. The scratch scores were normalized to a zero to five scale similar to the cross-hatch scale in order to determine the comparative performance of the different materials.

TABLE 7

Coated board samples paint performance.

| | Resin/Composition | Cross Hatch Adhesion Score | Relative Scratch Force | Tape Peel Test (NP = no peel, SP = small peel, LP = large peel) 3 h | 6 h | 24 h | 30 h | 48 h |
|---|---|---|---|---|---|---|---|---|
| | Devoe WONDER SPEED Semigloss White Paint | | | | | | | |
| 62a | PVC | 4B | 0 | SP | LP | LP | SP | LP |
| 63a | 6763, 30% talc, 10% EMAC (29% methyl acrylate), 10% $TiO_2$ | 1B | 4 | NP | NP | NP | NP | NP |
| 64a | 6763, 30% $CaCO_3$ (3 micron), 2.5% ABS (HH-106), 5% $TiO_2$ | 5B | 2 | NP | NP | NP | NP | NP |
| 65[a] | 6763, 30% $CaCO_3$ (3 micron), 5% ABS (HH-106), 5% $TiO_2$, 5% CTA (CA983-30) | 5B | 3 | SP | NP | NP | NP | NP |
| 66a | 5011, 30% $CaCO_3$ (3 micron), 5% ABS (HH-106), 5% $TiO_2$ | 5B | 1 | NP | NP | NP | NP | NP |
| 67a | Gesso | 3B | 5 | SP | SP | NP | NP | NP |

TABLE 7-continued

Coated board samples paint performance.

| | Resin/Composition | Cross Hatch Adhesion Score | Relative Scratch Force | Tape Peel Test (NP = no peel, SP = small peel, LP = large peel) 3 h | 6 h | 24 h | 30 h | 48 h |
|---|---|---|---|---|---|---|---|---|
| | Sherwin Williams PROMAR Semigloss White Paint | | | | | | | |
| 62b | PVC | 5B | 0 | LP | LP | SP | SP | SP |
| 63b | 6763, 30% talc, 10% EMAC (29% methyl acrylate), 10% $TiO_2$ | 1B | 2 | LP | LP | SP | SP | LP |
| 64b | 6763, 30% $CaCO_3$ (3 micron), 2.5% ABS (HH-106), 5% $TiO_2$ | 5B | 3 | NP | NP | NP | NP | NP |
| 65b | 6763, 30% $CaCO_3$ (3 micron), 5% ABS (HH-106), 5% $TiO_2$, 5% CTA (CA983-30) | 5B | 4 | NP | NP | NP | NP | NP |
| 66b | 5011, 30% $CaCO_3$ (3 micron), 5% ABS (HH-106), 5% $TiO_2$ | 1B | 1 | NP | NP | NP | NP | NP |
| 67b | Gesso | 2B | 5 | LP | SP | SP | NP | NP |
| | Valspar GUARDIAN Semigloss White Paint | | | | | | | |
| 62c | PVC | 5B | 0 | LP | LP | SP | SP | NP |
| 63c | 6763, 30% talc, 10% EMAC (29% methyl acrylate), 10% $TiO_2$ | 3B | 5 | NP | NP | NP | NP | NP |
| 64c | 6763, 30% $CaCO_3$ (3 micron), 2.5% ABS (HH-106), 5% $TiO_2$ | 5B | 5 | NP | NP | NP | NP | NP |
| 65c | 6763, 30% $CaCO_3$ (3 micron), 5% ABS (HH-106), 5% $TiO_2$, 5% CTA (CA983-30) | 5B | 5 | NP | NP | NP | NP | NP |
| 66c | 5011, 30% $CaCO_3$ (3 micron), 5% ABS (HH-106), 5% $TiO_2$ | 5B | 5 | SP | NP | SP | NP | NP |
| 67c | Gesso | 2B | 5 | NP | SP | NP | NP | NP |
| | ICI Alkyd Semigloss White Paint | | | | | | | |
| 62d | PVC | 5B | 0 | NP | NP | NP | SP | NP |
| 63d | 6763, 30% talc, 10% EMAC (29% methyl acrylate), 10% $TiO_2$ | 3B | 3 | NP | NP | NP | NP | NP |
| 64d | 6763, 30% $CaCO_3$ (3 micron), 2.5% ABS (HH-106), 5% $TiO_2$ | 5B | 4 | NP | NP | NP | NP | NP |
| 65d | 6763, 30% $CaCO_3$ (3 micron), 5% ABS (HH-106), 5% $TiO_2$, 5% CTA (CA983-30) | 5B | 4 | NP | NP | NP | NP | NP |
| 66d | 5011, 30% $CaCO_3$ (3 micron), 5% ABS (HH-106), 5% $TiO_2$ | 4B | 4 | NP | NP | NP | SP | NP |
| 67d | Gesso | 3B | 5 | NP | NP | NP | NP | NP |
| | Behr PREMIUM PLUS Semigloss Enamel White Paint | | | | | | | |
| 62e | PVC | 5B | 0 | SP | NP | NP | NP | NP |
| 63e | 6763, 30% talc, 10% EMAC (29% methyl acrylate), 10% $TiO_2$ | 2B | 0 | LP | LP | LP | LP | LP |
| 64e | 6763, 30% $CaCO_3$ (3 micron), 2.5% ABS (HH-106), 5% $TiO_2$ | 5B | 2 | NP | NP | NP | NP | NP |
| 65e | 6763, 30% $CaCO_3$ (3 micron), 5% ABS (HH-106), 5% $TiO_2$, 5% CTA (CA983-30) | 5B | 4 | NP | NP | NP | NP | NP |
| 66e | 5011, 30% $CaCO_3$ (3 micron), 5% ABS (HH-106), 5% $TiO_2$ | 5B | 3 | NP | NP | NP | NP | NP |
| 67e | Gesso | 2B | 5 | LP | SP | SP | SP | SP |

In the cross-hatch adhesion test, the experimental compositions exhibited better performance than Gesso and better or comparable performance than the PVC, regardless of the paint used. In addition, the experimental compositions significantly outperformed the composition comprising talc, LOTADER 8900, and titanium dioxide.

In the scratch test, Gesso exhibited slightly better performance compared to the experimental compositions regardless of paint used, but the experimental compositions showed better performance than the PVC and talc-containing composition except with one paint, Devoe WONDER SPEED Semigloss paint.

In the tape peel test, the experimental compositions did not demonstrate any failures, whereas the other compositions showed some degree of failure with at least one of the paints tested. A small amount of paint adhesion improvement was noted with the inclusion of the cellulose ester additive.

The formulation based on the 5011 base resin (low Ih.V. PETG) exhibited slightly rougher surfaces based when tested using a Mitutoyo Surftest instrument.

WONDER SPEED Fabrication efforts using the miter saw test showed the presence of some brittleness with cracking and flaking characterizing the cut lines for the experimental compositions.

Examples 68 Through 75

Adhesion Performance and Toughness of Coated MDF Substrate Materials—Set 2

Eight compositions were compounded, six of which were experimental compositions. A Gesso control and a vacuum-coated control was used for comparison.

The six experimental compositions were run on a coating line at 35 ft/min. with an extruder melt temperature of 480° F. and a die temperature of 500° F. Two paints were tested on each film and these paints included Valspar COLOR STYLE Semigloss and Behr PLUS PREMIUM Semigloss Enamel. The paints were tinted with 2 ounces of Engelhard Blue per gallon of white paint in order to make delaminations more easily observed on the white films samples. The coated wood substrates were tested using the paint adhesion protocol detailed above. Table 8 details the results.

TABLE 8

Coated board samples paint performance.

| | Coated Board Composition | Relative Scratch Score | Cross Hatch Adhesion Score | Tape Peel Test (NP = no peel, SP = small peel, LP = large peel) 3 h | 6 h | 24 h | 30 h | 48 h | tape score |
|---|---|---|---|---|---|---|---|---|---|
| | Valspar COLOR STYLE Semigloss White Paint | | | | | | | | |
| 68a | vac coated (M&M) | 5 | 0 | N | L | N | N | N | 4 |
| 69a | Gesso coated (Lowe's) | 5 | 0 | N | S | N | N | N | 4.5 |
| 70a | 6763, 30% $CaCO_3$ (3 micron), 10% Ecdel 9965, 2.5% LOTADER 8900, 5% $TiO_2$ | 0 | 0 | L | L | L | L | N | 1 |
| 71a | 6763, 20% CaCO3 (12 micron), 10% ECDEL 9965, 5% TiO2 | 2 | 0 | L | L | N | N | S | 2.5 |
| 72a | 6763, 20% CaCO3 (20 micron), 10% ECDEL 9965, 5% TiO2 | 4 | 1 | L | L | N | N | N | 3 |
| 73[a] | 6763, 20% CaCO3 (12 micron), 10% GP-22 (ABS), 2.5% LOTADER 8900, 5% TiO2 | 4 | 1 | N | L | S | L | S | 2 |
| 74[a] | 6763, 20% CaCO3 (12 micron), 10% GP-22 (ABS), 5% LOTADER 8900, 5% TiO2 | 4 | 0 | L | L | L | L | L | 0 |
| 75a | 6763, 20% CaCO3 (20 micron), 5% LOTADER 8900, 5% TiO2 | 2 | 0 | L | L | L | N | L | 1 |
| | Behr PREMIUM PLUS Semigloss Enamel White Paint | | | | | | | | |
| 68b | vac coated (M&M) | 5 | 2 | L | S | N | N | N | 3.5 |
| 69b | Gesso coated (Lowe's) | 5 | 0 | L | N | S | L | N | 2.5 |
| 70b | 6763, 30% $CaCO_3$ (3 micron), 10% ECDEL 9965, 2.5% Lotader LOTADER 8900, 5% $TiO_2$ | 0 | 0 | N | L | N | N | N | 4 |
| 71b | 6763, 20% CaCO3 (12 micron), 10% ECDEL 9965, 5% TiO2 | 4 | 5 | N | N | N | N | M | 5 |
| 72b | 6763, 20% CaCO3 (20 micron), 10% Ecdel ECDEL 9965, 5% TiO2 | 4 | 5 | N | N | N | S | S | 4 |
| 73b | 6763, 20% CaCO3 (12 micron), 10% GP-22 (ABS), 2.5% LOTADER 8900, 5% TiO2 | 2 | 5 | N | N | N | N | N | 5 |
| 74b | 6763, 20% CaCO3 (12 micron), 10% GP-22 (ABS), 5% LOTADER 8900, 5% TiO2 | 4 | 5 | S | N | N | N | N | 4.5 |
| 75b | 6763, 20% CaCO3 (20 micron), 5% LOTADER 8900, 5% TiO2 | 2 | 2 | N | N | N | S | S | 4 |

The presence of LOTADER 8900 was observed to decrease paint adhesion performance and, without other impact modifiers, the samples containing LOTADER 8900 did not show acceptable performance in any of the tests. Increasing the particle size of the calcium carbonate was observed to at least slightly improve performance.

The Gesso and vacuum-coated control compositions exhibited paint performance that was similar to the best performing experimental compositions. Cross-hatch adhesion scores were higher for the experimental compositions, whereas the scratch scores were higher for the Gesso and vacuum-coated samples. Tape line testing scores were comparable between the best performing experimental compositions and the two control compositions.

In addition to paint adhesion testing, the experimental formulations were cut with a Dewalt miter saw to evaluate toughness. The Gesso exhibited very small chipping, whereas the vacuum-coated sample showed no signs of brittleness. All of the experimental compositions showed some observable level of chipping, with the exception of the composition containing 20% $CaCO_3$ (12 micron), 10% GP-22 (ABS), 2.5% Lotader 8900, and 5% $TiO_2$ and the composition containing 20% $CaCO_3$ (12 micron), 10% GP-22 (ABS), 5% LOTADER 8900, and 5% $TiO_2$ which showed little if any chipping.

Surface roughness was also evaluated. In general, no distinct effect was found due to changing the particle size of the calcium carbonate. However, the presence of Lotader 8900 and the absence of a co-impact modifier increased surface roughness.

Examples 76 Through 105

Adhesion of Coating to the MDF Substrate

Experiments were conducted to examine the adhesion of the coating to the substrate based on the speed of the coating line (50, 100, 120 or 150 ft/min), the temperature of the board coming into the die (55, 74, 90, 120, or 150° F.), and the temperature of the compounded material melt (460, 480, 500, or 520° F.). The test composition comprised Eastman PET G. 6763 resin (PETG with Ih.V.=0.75 dL/g), 30% calcium carbonate (3 micron), 10% Ecdel, and 5% $TiO_2$. The rheology of this composition was similar to the experimental compositions tested in previous examples.

Table 9 shows the variety of process conditions as well as the peel force data. For each set of conditions, two boards were tested and three points on each board were tested. The reported peel force was the average of those six measurements. 1S, 1M, 1E=start, middle, end of board 1; 2S, 2M, 2E=start, middle, end of board 2.

TABLE 9

Coating adhesion to substrate investigation.

| Process Parameters | | | Adhesion Force (90° T-Peel) (lbs) | | | | | | | | | | |
|---|---|---|---|---|---|---|---|---|---|---|---|---|---|
| Melt Temp (° F.) | Board Temp (° F.) | Line Speed (ft. min) | 1S | 1M | 1E | 2S | 2M | 2E | board 1 ave | board 2 ave | difference | average | std dev |
| 480 | 90 | 50 | 0.432 | 0.399 | 0.367 | 0.489 | 0.481 | 0.444 | 0.40 | 0.47 | 0.07 | 0.44 | 0.05 |
| 480 | 90 | 100 | 0.239 | 0.253 | 0.223 | 0.301 | 0.286 | 0.269 | 0.24 | 0.29 | 0.05 | 0.26 | 0.03 |
| 480 | 90 | 150 | 0.224 | 0.316 | 0.284 | 0.425 | 0.441 | 0.424 | 0.27 | 0.43 | 0.16 | 0.35 | 0.09 |
| 480 | 120 | 50 | 0.254 | 0.28 | 0.181 | 0.157 | 0.181 | 0.191 | 0.24 | 0.18 | 0.06 | 0.21 | 0.05 |
| 480 | 120 | 100 | 0.382 | 0.373 | 0.39 | 0.338 | 0.342 | 0.228 | 0.38 | 0.30 | 0.08 | 0.34 | 0.06 |
| 480 | 120 | 150 | 0.353 | 0.338 | 0.33 | 0.368 | 0.345 | 0.357 | 0.34 | 0.36 | 0.02 | 0.35 | 0.01 |
| 480 | 150 | 50 | 0.292 | 0.287 | 0.322 | 0.43 | 0.505 | 0.26 | 0.30 | 0.40 | 0.10 | 0.35 | 0.10 |
| 480 | 150 | 100 | 0.363 | 0.413 | 0.466 | 0.396 | 0.317 | 0.429 | 0.41 | 0.38 | 0.03 | 0.40 | 0.05 |
| 480 | 150 | 150 | 0.237 | 0.324 | 0.252 | 0.261 | 0.299 | 0.25 | 0.27 | 0.27 | 0.00 | 0.27 | 0.03 |
| 460 | 90 | 100 | 0.484 | 0.357 | 0.389 | 0.344 | 0.316 | 0.362 | 0.41 | 0.34 | 0.07 | 0.38 | 0.06 |
| 460 | 120 | 100 | 0.368 | 0.34 | 0.457 | 0.424 | 0.326 | 0.44 | 0.39 | 0.40 | 0.01 | 0.39 | 0.06 |
| 460 | 150 | 100 | 0.423 | 0.381 | 0.484 | 0.359 | 0.378 | 0.364 | 0.43 | 0.37 | 0.06 | 0.40 | 0.05 |
| 500 | 90 | 100 | 0.385 | 0.344 | 0.355 | 0.361 | 0.33 | 0.446 | 0.36 | 0.38 | 0.02 | 0.37 | 0.04 |
| 500 | 120 | 100 | 0.491 | 0.631 | 0.513 | 0.203 | 0.466 | 0.334 | 0.55 | 0.33 | 0.21 | 0.44 | 0.15 |
| 500 | 150 | 100 | 0.412 | 0.426 | 0.461 | 0.345 | 0.453 | 0.409 | 0.43 | 0.40 | 0.03 | 0.42 | 0.04 |
| 480 | 74 | 50 | | 0.315 | | | 0.279 | | 0.315 | 0.279 | 0.04 | 0.30 | 0.03 |
| 480 | 55 | 50 | | 0.303 | | | 0.319 | | 0.303 | 0.319 | 0.02 | 0.31 | 0.01 |
| 480 | 74 | 100 | | 0.258 | | | 0.233 | | 0.258 | 0.233 | 0.03 | 0.25 | 0.02 |
| 480 | 55 | 100 | | 0.113 | | | 0.175 | | 0.113 | 0.175 | 0.06 | 0.14 | 0.04 |
| 500 | 74 | 50 | | 0.221 | | | 0.264 | | 0.221 | 0.264 | 0.04 | 0.24 | 0.03 |
| 500 | 56 | 50 | | 0.261 | | | 0.206 | | 0.261 | 0.206 | 0.06 | 0.23 | 0.04 |
| 500 | 74 | 100 | | 0.235 | | | 0.19 | | 0.235 | 0.19 | 0.05 | 0.21 | 0.03 |
| 500 | 56 | 100 | | 0.227 | | | 0.242 | | 0.227 | 0.242 | 0.02 | 0.23 | 0.01 |
| 500 | 74 | 120 | | 0.685 | | | 0.199 | | 0.685 | 0.199 | 0.49 | 0.44 | 0.34 |
| 500 | 56 | 120 | | 0.133 | | | 0.143 | | 0.133 | 0.143 | 0.01 | 0.14 | 0.01 |
| 520 | 74 | 50 | | 0.386 | | | 0.339 | | 0.386 | 0.339 | 0.05 | 0.36 | 0.03 |
| 520 | 58 | 50 | | 0.274 | | | 0.263 | | 0.274 | 0.263 | 0.01 | 0.27 | 0.01 |
| 520 | 74 | 100 | | 0.323 | | | 0.298 | | 0.323 | 0.298 | 0.03 | 0.31 | 0.02 |
| 520 | 58 | 100 | | 0.327 | | | 0.284 | | 0.327 | 0.284 | 0.04 | 0.31 | 0.03 |
| 480 | 55 | 100 | | 0.161 | | | 0.196 | | 0.161 | 0.196 | 0.04 | 0.18 | 0.02 |

The results demonstrated no apparent trends in the data based on any of the investigated variables. The 90° peel forces were similar for all samples and exhibited no distinct trends. In addition, examination of the back of the coating after the peel tests revealed similar amounts of MDF "pull-off," which is indicative of the level of adhesion. Some of the variance in the 90° peel force data can be attributed to variations in the coating thickness, which will affect the resulting peel values.

It is anticipated that some level of heat is minimally necessary to provide enough flow of the compounded polymer melt onto the surface of the MDF substrate in the time that the profile spends in the die. Based on the results of this study, the conditions using a 55° F. board at elevated line speeds may be approaching those minimum conditions are for adequate adhesion when a lower (480° F.) melt temperature is used. It should be noted that the rheology of the formulation will play an important role in the ability to adhere to the MDF substrate when operating close to the minimum conditions.

Examples 106 Through 114

Controlling the Gloss of the Resulting Formulation

Both of the currently available Gesso and vacuum coatings possess a non-glossy surface, with gloss numbers for both being around 2.5 on a zero to 100 scale. Films containing only PETG and one gloss modifier (talc or $CaCO_3$) were extruded on a 1" Kilion with a general purpose screw based on concentrate blending at 7-8 mils thickness. The films were examined for gloss at a 60° observer angle. The results are shown in Table 10.

TABLE 10

Gloss modifier effects on film gloss

| Example | gloss modifier | gloss modifier concentration (wt %) | gloss modifier size (μm) | gloss (60°) |
|---|---|---|---|---|
| 106 | $CaCO_3$ | 9 | 3 | 71.00 |
| 107 | $CaCO_3$ | 20 | 3 | 36.00 |
| 108 | $CaCO_3$ | 40 | 3 | 18.00 |
| 109 | $CaCO_3$ | 20 | 1.4 | 70.00 |
| 110 | $CaCO_3$ | 20 | 12 | 18.00 |
| 111 | $CaCO_3$ | 20 | 20 | 13.00 |
| 112 | talc | 10 | 7 | 42.35 |

TABLE 10-continued

| Gloss modifier effects on film gloss | | | | |
|---|---|---|---|---|
| Example | gloss modifier | gloss modifier concentration (wt %) | gloss modifier size (μm) | gloss (60°) |
| 113 | talc | 20 | 7 | 52.80 |
| 114 | talc | 30 | 7 | 35.65 |

For talc, concentrations of 10, 20 or 30% by weight resulted in gloss levels between 35 and 52, with some scattering. The scattering may be due to translucency of the films, which can affect the gloss measurement. On the other hand, inclusion of calcium carbonate resulted in a more gradual decrease in gloss levels. And lower gloss values were able to be obtained using calcium carbonate as compared to talc.

Another factor for consideration in gloss modification is the particle size of the gloss modifying particle. The increasing size leads to a significant decrease in the gloss level but seemed to demonstrate a limiting effect around a 10% gloss level.

The gloss modifier can lead to brittleness of the composition. Ductile-to-brittle transition curves were generated for compositions comprising various concentrations of talc (7 μm) and two compositions comprising various concentrations of calcium carbonate (3 or 12 μm). All of the transitions occurred in the 12-17% by weight of gloss modifier, although the specific inflection point was difficult to identify due to scatter in the data. Compositions with gloss modifiers near or above those concentrations will require impact modification in order to create a tough composition.

Examples 115 Through 120

Controlling the Opacity of the Resulting Formulation

One of the primary functions of a primer coat is coverage of the underlying surface color. Therefore, opacity was evaluated to determine whether the compositions were sufficiently opaque at the targeted film thickness (6-7 mils). $TiO_2$ is widely used as an opacity modifier due to its high efficacy. A series of 7 mil films comprising a PETG as the base resin were extruded on a 1" Kilion with a general purpose screw based on concentrate blending. Table 11 details the resulting opacity.

TABLE 11

| Opacity modifier effects on film opacity | | |
|---|---|---|
| Examples | wt % TiO2 | opacity |
| 115 | 0 | 0.26 |
| 116 | 0.5 | 41.88 |
| 117 | 1 | 64.5 |
| 118 | 2 | 77.88 |
| 119 | 4 | 85.84 |
| 120 | 8 | 92.99 |

Opacity increased quickly, and began to level off above 3% by weight. Gloss modifiers and any other incompatible additives will contribute to the opacity of the compositions, but the effects will be minimal compared to the titanium dioxide. For example, the opacity due to the presence of 30% by weight of talc was only 11.82, and the opacity due to the presence of 30% by weight of Lotader 8900 was 48. Both of those values were surpassed using less than 1% by weight of titanium dioxide. No effect on the toughness of the composition using the low concentrations of titanium dioxide having small particle sizes (0.3 μm).

The paint performance and toughness of the various formulations were parameters used in the design of the most useful formulations. In general, the performance of the extruded films was able to be used to predict the performance of identical formulations coated onto MDF substrates with a few exceptions. Some improvement in the performance of the coatings on the MDF substrates could be attributed to the presence of microscale roughness that would not be present in film extrusion. The examples confirmed the hypothesized concept that improved paint adhesion would result from increasing the level of polar additives; however, some limits to this seem to exist as inclusion of the polyether based rubber impact modifiers did not show a marked improvement in the paint adhesion performance. Also, based on the testing around toughness it became apparent that some level of polyethylene- or polybutadiene-based impact modifier would be necessary to achieve the desired level of toughness. Adhesion of the coating to the substrate was determined to be a minimal issue over the range of processing conditions that were tested. In addition, it was determined that the opacity and gloss could be tuned to desired levels although the gloss level influences the toughness as well.

Sandblasting Examples

Examples 121-132

Effect of Blasting Media Nature on Paint Adhesion Performance

Glass beads of different sizes, aluminum oxide, crushed glass and walnut shells were used to treat the surfaces of extrusion coated MDF substrates. The substrates were coated with a polymeric formulation consisting of 65% PETG 6763, 20% #10 white calcium carbonate, 10% KANE ACE B564 impact modifier, and 5% TIPURE W-41 titanium dioxide. These samples were blasted in a standard blast cabinet with a suction blast system (used suction blasting which has one set velocity versus pressure blasting which has adjustable particle velocity). These samples were blasted at 45° and 90° to evaluate the effect of incident angle. The surfaces were treated with enough exposure to generate a uniform surface appearance.

Initially, these samples were examined with optical microscopy and the surface roughness tester. Table 12 lists the roughness for each sample that was tested. The aluminum oxide, crushed glass and walnut shells samples demonstrated the largest surface roughness values corresponding to the aggressiveness of the irregularly shaped blasting media. The glass beads on the other hand showed relatively low surface roughness values (55-63) which were close to the value for a control sample (~60) with no surface treatment. Some effect was also observed in the incident angle used to treat the samples where the 90° degree angle gave lower roughness values. This is consistent with the hypothesis that the reflected blasting particles are interfering with the new particles that are heading toward the substrate surface. Samples that required multiple passes to generate a uniform looking surface showed a diminished incident angle affect presumably because more treatment time would allow the 90° samples to eventually achieve the same topography as the 45° samples, although it would more time to get the same number of particles hitting the surface due to the interference.

Optical micrographs (FIGS. 1*a*-1*f*) of the surface magnified to 155× confirmed the roughness measurements with the glass bead treated samples showing only a dimpled surface and the irregular particles treated samples showing significant tearing, i.e., irregular surface. Scanning electron microscopy (FIGS. 1*a*-1*f*) also showed a similar trend in the nature of the surfaces after being treated.

The paint adhesion of two paints was also tested with these treated samples and a control sample. The performance matches the hypothesis that the highly textured or irregular surfaces from aggressive blasting media show better scratch adhesion performance compared to the less textured surfaces of samples blasted with the glass beads (GRAND NORTHERN supplied 188 μm size). The samples with aluminum oxide, crushed glass and walnut shells all showed significant scratch improvements, i.e., at least doubling the force exhibited by the control. On the other hand, no measurable improvement was observed for the glass bead treated sample.

In order to verify this effect, the aluminum oxide and crushed glass (GRAND NORTHERN 155 μm) treated samples were tested with a wider variety of paints including those with high and low VOC's from the US and Canada and with different gloss finishes. Table 13 shows the results from the broad paint examination test. While some paints did show only minimal improvement (<50%), the majority showed a significant improvement (>50% or >100%) over the untreated control samples. In addition, it should be noted that the mechanism of failure also changed with the surface treatment in that the delamination area before treatment was always larger than the area of the scratch tip and after treatment the delamination area was restricted to only the size of the scratch tip.

Examples 132-145

Effect of Blasting Media Size on the Surface Roughness and Paint Adhesion Performance The effect of particle size on the resulting surface performance was important since the surface roughness would eventually become so great that it would detract from the look and feel of the treated substrate surface. The aluminum oxide was available in a variety of sizes and was used to examine this effect. Aluminum oxide ranging in size from 254 microns down to 34 microns was used to treat two surfaces. One surface consisted of 65% PETG 6763, 20% #10 white calcium carbonate, 10% KANE ACE B564 impact modifier, and 5% TIPURE W-41 titanium dioxide (labeled X-095) and the other was 95% PETG 6763 with 5% TIPURE W-41 titanium dioxide (labeled PETG). These surfaces were examined to determine if compositional effects were still important or if the presence of the surface roughness was the single influencing factor for paint adhesion. Kilz Casual Colors Semi-Gloss, Olympic Premium Satin and Genesis Semi-Gloss whites were used as the paints to test the effect of particle size and composition. Table 14 shows the results for the paint testing and surface roughness. As expected, the increasing particle size resulted in greater surface roughness with similar roughness values seen for both types of surface compositions at identical media particle sizes. FIGS. 2*a*-2*g* shows the blasting media and micrograph images of the resultant treated surfaces. The paint adhesion effects due to particle size are fairly minimal with some random outliers showed higher scratch values, but no apparent trends being observed. In general, over the range of particle sizes that were examined, there is little to no effect on the resulting paint adhesion. Based on this, the smallest sized particle would be preferred to give the optimal combination of surface appeal (smoothness) and paint adhesion. On the other hand, the scratch paint adhesion showed a general improvement in the X-095 composition compared to the PETG composition. This result is hypothesized to be due to the inclusion of additives in the X-095 composition, specifically calcium carbonate, that are potentially exposed with the media blasting treatment. SEM was used to examine the nature of the surfaces of the treated substrates. The intensity of the electron beam in the SEM was varied to determine the depth of penetration necessary to begin to see the inorganic mineral particle. Analysis of a sample that has not been treated showed that at low voltages no inorganic particles interacted with the electron beam; however, increasing voltages showed increasing levels of interaction. Based on the analysis, it was determined that an approximately 12 μm thick copolyester coating was covering the inorganic additive. In contrast, the analysis of the sample treated with aluminum oxide showed no voltage dependence on observation of the inorganic particles suggesting that the polymer layer had been removed with the blasting treatment. The exposure of the inorganic additive is expected to account for the difference in performance in scratch paint adhesion between the X-095 and PETG with $TiO_2$. Furthermore, an X-095 sample was treated with glass beads and subsequently analyzed with SEM. A dependence on electron beam voltage was again observed which suggests that the inorganic is still covered with a polymer layer after treatment with glass beads. This observation confirmed the previous assertion that the spherically shaped glass beads are less aggressive than the granular aluminum oxide particles.

Examples 146-151

Media Type Effects on Surface Gloss

In addition to paint adhesion, this process can be used to control the substrate surface gloss. Disruption of the light reflected of the surface controls the gloss and both tearing and dimpling will affect that level of reflection. The tearing will result in a greater scattering of light whereas the dimpling will still reduce the gloss but not to the same extent. Table 14 details the effect of various media treatments on the resulting surface gloss. Compared to the control, a significant change is seen in all the samples but the spherical glass bead treatment induced less gloss reduction. It should be noted that the control sample possesses a relatively low gloss level due to the inclusion of calcium carbonate which does disrupt the surface and scatter light. An unfilled polymer system would show higher initial gloss but still be able to be reduced to the gloss levels reported here. The transparency of an unfilled system is going to be affected in a similar manner to the gloss based on the type of media and the level of treatment (particle velocity, number of passes, etc.).

Examples 152-158

Effect of Particle Size on the Resulting Gloss

The effect of particle size on the resulting gloss was also investigated and it was observed that there is little effect on the resulting gloss. Particle sizes ranging from 34 to 254 μm were examined and the gloss levels are practically identical for each sample within a specific blasting media. Changing aluminum oxide size did not affect the resulting surface gloss. Further, changing the glass bead particle size did not affect the resulting surface gloss. These results are detailed in table 15.

TABLE 12

Effects of media type on surface roughness and paint adhesion

| media | particle size (μm) | angle | distance | passes | roughness $R_a$ (μin) | force to fail scratch score (N) Sherwin Williams PROMAR Semigloss | Minimum Scratch Force with no peeling (N) RONA Semigloss |
|---|---|---|---|---|---|---|---|
| 121 aluminum oxide | 99 | 90 | 4" | 1 | 87 | ND | ND |
| 122 aluminum oxide | 99 | 45 | 4" | 1 | 120 | 18 | 13 |
| 123 crushed glass | 155 | 90 | 4" | 1 | 76 | ND | ND |
| 124 crushed glass | 155 | 45 | 4" | 1 | 110 | 18 | 18 |
| 125 Eastman glass beads | 100 | 90 | 4" | 5 | 55 | ND | ND |
| 126 Eastman glass beads | 100 | 45 | 4" | 5 | 59 | ND | ND |
| 127 walnut shells | 475 | 90 | 4" | 3 | 115 | ND | ND |
| 128 walnt shells | 475 | 45 | 4" | 3 | 109 | 15 | 13 |
| 129 GNP glass beads | 188 | 90 | 4" | 2 | 63 | ND | ND |
| 130 GNP glass beads | 188 | 45 | 4" | 2 | 62 | 6 | 6 |
| 131 control | NA | NA | NA | NA | 60 | 7 | 5 |

TABLE 13

Effect of aluminum oxide and crushed glass treatment on paint adhesion

| | | | | 18 hr Minimum Scratch Force with no peeling (N) | | 3 wk Minimum Scratch Force with no peeling (N) | | | |
|---|---|---|---|---|---|---|---|---|---|
| | Paint | Paint Supplier | Base Resin | Control | Crushed glass | $Al_2O_3$ | Control | Crushed glass | Al2O3 |
| 1 | BEHR PREMIUM PLUS Semi-gloss | Behr Process Corporation | acrylic | 6 | 15 | 15 | 6 | 18 | 18 |
| 2 | KILZ CASUAL COLORS Semi-gloss | Masterchem Industries LLC (Behr) | acrylic | 6 | 13 | 13 | 3 | 18 | 18 |
| 3 | Benjamin Moore REGAL Semi-gloss | Benjamin Moore and Co. | acrylic | 6 | 15 | 18 | 6 | 18 | 15 |
| 4 | Sherwin Williams PROMAR 400 Semi-gloss | Sherwin Williams | vinyl-acrylic | 7 | 15 | 20 | 6 | 18 | — |
| 5 | EASY LIVING LIFETIME Semi-gloss | Sears Roebuck and Co. (SW) | vinyl-acrylic | 10 | 18 | >20 | 10 | >20 | — |
| 6 | Sherwin Williams CASHMERE MEDIUM LUSTRE | Sherwin Williams Company | vinyl-acrylic | 6 | 15 | >20 | 5 | >20 | — |
| 7 | Glidden ULTRA-HIDE Semi-gloss | ICI (Akzo NoBel) | vinyl-acrylic | 8 | 20 | >20 | 6 | — | — |
| 8 | Glidden AMERICA'S FINEST Semi-gloss | ICI (Akzo NoBel) | vinyl-acrylic | 8 | >20 | 20 | — | — | — |
| 9 | RALPH LAUREN Semi-gloss | ICI (Akzo NoBel) | acrylic | 6 | 20 | >20 | — | — | — |
| 10 | Devoe WONDER SPEED Semi-gloss | ICI (Akzo NoBel) | vinyl-acrylic | 6 | 20 | 20 | — | — | — |
| 11 | Olympic PREMIUM SATIN | PPG Architectural Finishes Inc. | acrylic | 6 | 10 | 13 | 5 | — | 18 |
| 12 | SIGNATURE COLORS MATTE | The Valspar Corporation | acrylic | 6 | 13 | 13 | 5 | 13 | 15 |
| 13 | SIGNATURE COLORS SATIN | The Valspar Corporation | acrylic | 7 | 18 | 15 | 7 | — | >20 |
| 14 | SIGNATURE COLORS SEMI-GLOSS | The Valspar Corporation | acrylic | 5 | 20 | >20 | — | — | — |
| 15 | Valspar GUARDIAN Semi-gloss | The Valspar Corporation | vinyl-acetate ethylene | 13 | 20 | 20 | — | — | — |
| 16 | Valspar PROFESSIONAL Semi-gloss | The Valspar Corporation | vinyl-acrylic | 8 | 20 | 20 | — | — | — |
| 17 | GENESIS Semigloss | Duron | acrylic | 5 | 18 | 13 | 6 | 18 | 18 |
| 18 | HARMONY Semigloss | Sherwin Williams | styrenated acrylic/EVA | 5 | 20 | >20 | — | — | — |
| 19 | Covedale Semigloss White | Cloverdale | vinyl-acrylic | 6 | 18 | >20 | 6 | 18 | — |
| 20 | CIL SMART Semigloss | CIL | acrylic | 7 | 10 | 13 | 6 | 18 | 15 |
| 21 | CIL DULUX Semigloss | CIL | | 5 | 18 | 13 | — | — | — |
| 22 | CIL CILUX | CIL | acrylic | 3 | 5 | 7 | 5 | 10 | 13 |
| 23 | Sico SHANTUNG | Sico | acrylic | 3 | 13 | 13 | 3 | 13 | 20 |
| 24 | RONA | Sico | acrylic | 6 | 13 | 13 | 6 | 20 | 20 |
| 25 | Sico CLASSIC | Sico | acrylic | 5 | 20 | >20 | — | — | — |

TABLE 13-continued

Effect of aluminum oxide and crushed glass treatment on paint adhesion

| | Paint | Paint Supplier | Base Resin | 18 hr Minimum Scratch Force with no peeling (N) | | 3 wk Minimum Scratch Force with no peeling (N) | | | |
|---|---|---|---|---|---|---|---|---|---|
| | | | | Control | Crushed glass | $Al_2O_3$ | Control | Crushed glass | Al2O3 |
| 26 | EXPRESSIONS MASTERCHEM | Behr Process Corporation | | 5 | 18 | >20 | 5 | 18 | — |
| 27 | Colverdale Semigloss Green | Cloverdale | vinyl-acrylic | 6 | 13 | 10 | 6 | 18 | 18 |

TABLE 14

Effect of media particle size on surface roughness and paint adhesion

| Substrate | $Al_2O_3$ grit | $Al_2O_3$ particle size (micron) | 18 hr Minimum Scratch Force with no peeling (N) Kilz SG | OLYMPIC SATIN | GENESIS SG | roughness (μin) |
|---|---|---|---|---|---|---|
| 132 PETG control | NA | NA | | 5 | | 52.5 |
| 133 X30327-095 Control | NA | NA | 5 | 5 | 5 | 57 |
| 134 PETG | 60 | 254 | 8 | 5 | 10 | 125 |
| 135 X30327-095 | 60 | 254 | 13 | >20 | 13 | 167 |
| 136 PETG | 70 | 203 | 8 | 10 | 10 | 130 |
| 137 X30327-095 | 70 | 203 | 18 | 15 | 18 | 140 |
| 138 PETG | 80 | 155 | 10 | 20 | 13 | 100 |
| 139 X30327-095 | 80 | 155 | 18 | 18 | 15 | 135 |
| 140 PETG | 150 | 74 | 15 | 8 | 10 | 72 |
| 141 X30327-095 | 150 | 74 | 18 | 18 | 13 | 75 |
| 142 PETG | 220 | 56 | 13 | 8 | 13 | 69 |
| 143 X30327-095 | 220 | 56 | 20 | 13 | 13 | 65 |
| 144 PETG | 320 | 34 | 13 | 5 | 13 | 42 |
| 145 X30327-095 | 320 | 34 | 18 | 13 | 13 | 63 |
| 146 PE untreated | | | <2 | <2 | NA | |
| 147 PE treated | 120 | 99 | <2 | <2 | <2 | |
| 148 PP untreated | | | <2 | <2 | NA | |
| 149 PP treated | 120 | 99 | 5 | 2 | <2 | |

TABLE 15

Effect of media type on glass

| media | particle size (μm) | # of passes | 60° gloss |
|---|---|---|---|
| aluminum oxide | 99 | 1 | 3 |
| crushed glass | 155 | 1 | 3 |
| Eastman glass beads | 100 | 5 | 9 |
| walnut shells | 475 | 3 | 3 |
| GNP glass beads | 188 | 2 | 9 |
| control | NA | NA | 21 |

TABLE 16

Effect of media particle size on glass

| media | particle size (μm) | passes | grit | 60° gloss |
|---|---|---|---|---|
| $Al_2O_3$ | 254 | 1 | 60 | 3 |
| $Al_2O_3$ | 203 | 1 | 70 | 3 |
| $Al_2O_3$ | 155 | 1 | 80 | 2 |
| $Al_2O_3$ | 99 | 1 | 120 | 3 |
| $Al_2O_3$ | 74 | 1 | 150 | 3 |
| $Al_2O_3$ | 56 | 1 | 220 | 4 |
| $Al_2O_3$ | 34 | 1 | 320 | 3 |
| glass beads | 188 | 2 | NA | 9 |
| glass beads | 95 | 5 | NA | 9 |

TABLE 17

| | Paint Adhesion Test | | | | | | | | |
|---|---|---|---|---|---|---|---|---|---|
| | Tape Line Test | | | | | | | | |
| | Sears LIFETIME | Valspar GUARDIAN | Behr PREMIUM | X-hatch | | | Paint Test Composite Score | | |
| Film Description | Semi-Gloss | Semi-Gloss | Semi-Gloss | Sears | Valspar | Behr | Sears | Valspar | Behr |
| 1 6763, 5% LOTADER 8900, 5% TiO2, 25% Talc 9107 | 1 | 3 | 3.5 | 0B | 0B | 0B | 1 | 3 | 3.5 |
| 2 6763, 5% LOTADER 8900, 5% TiO2, 25% HELIACAL 3000 | 1 | 4 | 4 | 0B | 0B | 0B | 1 | 4 | 4 |
| 3 6763, 10% KANE ACE B564, 5% TiO2, 25% Talc 9107 | 5 | 5 | 5 | 0B | 5B | 2B | 5 | 10 | 7 |
| 4 6763, 5% LOTADER 8900, 5% TiO2, 25% #10 white | 0.5 | 2 | 3 | 0B | 0B | 0B | 0.5 | 2 | 3 |
| 5 6763, 5% TiO2, 25% Talc 9107 | 5 | 5 | 5 | 4B | 5B | 5B | 9 | 10 | 10 |
| 6 6763, 5% LOTADER 8900, 5% TiO2 | 4 | 4.5 | 5 | 0B | 3B | 0B | 4 | 7.5 | 5 |
| 7 6763, 5% TiO2, 30% HELIACAL 3000, 5% KANE ACE B564 | 5 | 5 | 5 | 2B | 5B | 4B | 7 | 10 | 9 |
| 8 6763, 5% TiO2, 20% HELIACAL 3000, 5% KANE ACE B564 | 5 | 5 | 5 | 4B | 5B | 5B | 9 | 10 | 10 |
| 9 6763, 5% TiO2, 10% HELIACAL 3000, 5% KANE ACE B564 | 5 | 5 | 5 | 5B | 5B | 5B | 10 | 10 | 10 |
| 10 polystyrene, 5% TiO2, 20% HELIACAL 3000, 10% KANE ACE B564 | 3.5 | 4.5 | 5 | 0B | 0B | 4B | 3.5 | 4.5 | 9 |
| 11 HDPE, 5% TiO2, 20% HELIACAL 3000, 10% KANE ACE B564 | 0 | 0 | 0 | 0B | 0B | 0B | 0 | 0 | 0 |
| 12 6763 PETG, 5% TiO2, 10% KANE ACE B564, 20% FILMLINK 500 | 5 | 5 | 5 | 1B | 2B | 4B | 6 | 7 | 9 |
| 13 Paint grade PVC trim-it | 2.5 | 4.5 | 5 | 0B | 0B | 4B | 2.5 | 4.5 | 9 |
| 14 Prefinished PVC trim | NA | 3 | 5 | 0B | 0B | 0B | NA | 3 | 5 |

The invention claimed is:

1. A method of making an article comprising a wood or wood composite substrate at least partially covered with a thermoplastic resin coating comprising a polyester, the method comprising;

(a) melt extruding the polyester coating wherein the polyester has a solubility parameter ranging from about 9.4 to about 14.0 $(cal/cm^3)^{0.5}$ onto the wood or wood composite substrate; and (b) applying a water-based paint covering to at least a portion of the polyester coating to form a paint coating;

wherein the thermoplastic resin has a Tg greater than about 70° C. and less than about 150° C.; and wherein the paint coating on the polyester coating has a performance score ranging from 6 to 10, and wherein the performance score is the sum of a cross hatch value and a tape line test score.

2. The method according to claim 1, wherein the polyester coating is abraded with a blasting media to form an abraded polyester resin surface before the paint coating is applied.

3. The method according to claim 2, wherein the abraded polyester resin surface has a surface roughness ranging from 10 to 370 micro inches.

4. The method according to claim 3, wherein the blasting media is granular.

5. The method according to claim 3, wherein the blasting media is selected from the group of aluminum oxide, crushed glass, silicon carbide, steel grit, walnut shells, sand, jet mag, and calcium carbonate.

6. The method according to claim 2, wherein the performance score of the paint on the abraded polyester resin surface has a cross-hatch value of at least 3.

7. The method according to claim 2, wherein the performance score of the paint on the abraded polyester resin surface has a tape line test score of at least 3.

8. The method according to claim 2, wherein the performance score of the paint on the abraded polyester resin surface has a scratch adhesion value at least 50% higher than the scratch adhesion value on the untreated surface.

9. The method according to claim 1, where the polyester comprises:

(i) an acid component comprising:

(a) at least 70 mole % of acid residues from terephthalic acid, derivatives of terephthalic acid and mixtures thereof;

(b) from 0 to 30 mole % of acid residues from aromatic dicarboxylic acids; and (c) from 0 to 10 mole % of acid residues from aliphatic dicarboxylic acids having up to 20 carbon atoms;

(ii) a glycol component comprising:

(a) from 20 to 70 mole % of glycol residues from cyclohexanedimethanol;

(b) from 0 to 80 mole % of glycol residues from ethylene glycol; and (c) from 0 to 80 mole % of glycol residues from glycols having up to 20 carbon atoms, wherein the acid residues are based on 100 mole % of acid residues and the glycol residues are based on 100 mole % of glycol residues.

10. The method according to claim 1, wherein the thermoplastic resin coating comprises:

(i) an acid component comprising:

(a) at least 70 mole % of acid residues from terephthalic acid, deriavatives of terephthalic acid and mixtures thereof;

(b) from 0 to 30 mole % of acid residues from aromatic dicarboxylic acids; and (c) from 0 to 10 mole % of acid residues from aliphatic dicarboxylic acids having up to 20 carbon atoms; and (ii) a glycol component comprising:

(a) from 20 to 70 mole % of glycol residues from cyclohexanedimenthanol;

(b) from 0 to 80 mole % of glycol residues from ethylene glycol; and (c) from 0 to 80 mole % of glycol residues from glycols having up to 20 carbon atoms, wherein the acid residues are based on 100 mole % of acid residues and the glycol residues are based on 100 mole % of glycol residues.

11. The method according to claim 1, wherein the thermoplastic resin coating comprises:

(a) 30% by weight to 70% by weight of at least one copolyester;

(b) 1% by weight to 10% by weight of titanium dioxide;

(c) 10% by weight to 40% by weight of calcium carbonate; and (d) 5% by weight to 20% by weight of at least one impact modifier comprising at least one polymer chosen from polybutadiene, polyisoprene, polyurethanes, polyethers, polyesters, polyacrylates, and polyolefins, and copolymers thereof, wherein the weight percents are based on the total weight of the coating.

* * * * *